US007009590B2

(12) United States Patent
Numao

(10) Patent No.: US 7,009,590 B2
(45) Date of Patent: Mar. 7, 2006

(54) DISPLAY APPARATUS AND DISPLAY METHOD

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 213 days.

(21) Appl. No.: 10/137,602

(22) Filed: May 2, 2002

(65) Prior Publication Data

US 2003/0011314 A1 Jan. 16, 2003

(30) Foreign Application Priority Data

May 15, 2001 (JP) ..... 2001-145504
Nov. 8, 2001 (JP) ..... 2001-343711
Mar. 22, 2002 (JP) ..... 2002-081833

(51) Int. Cl.
*G09G 3/30* (2006.01)

(52) U.S. Cl. ..... 345/76; 345/77; 345/690

(58) Field of Classification Search ..... 345/36, 345/45, 76–83, 75.2, 90, 93, 98, 87, 690–693; 315/169.3

See application file for complete search history.

(56) References Cited

U.S. PATENT DOCUMENTS 4,649,517 A * 3/1987 Kitazima et al. ..... 365/108
4,719,457 A * 1/1988 Kitajima et al. ..... 345/104
4,996,523 A 2/1991 Bell et al. ..... 340/781
5,945,972 A * 8/1999 Okumura et al. ..... 345/98
6,204,610 B1 * 3/2001 Komiya ..... 315/169.3
6,339,417 B1 * 1/2002 Quanrud ..... 345/98
6,501,227 B1 * 12/2002 Koyama ..... 315/169.3
6,518,962 B1 * 2/2003 Kimura et al. ..... 345/211
2001/0024187 A1 * 9/2001 Sato et al. ..... 345/98
2002/0180721 A1 12/2002 Kimura et al.
2004/0070558 A1 * 4/2004 Cok et al. ..... 345/76

FOREIGN PATENT DOCUMENTS

EP 0261901 A2 3/1988
JP 08-194205 7/1996
JP 09-212140 8/1997
JP 09-329806 12/1997

(Continued)

OTHER PUBLICATIONS

Machine Translation of JP 10-254410 A to Kunio.*

(Continued)

*Primary Examiner*—Xiao Wu
(74) *Attorney, Agent, or Firm*—Edwards Angell Palmer & Dodge LLP; David G. Conlin; George W. Hartnell

(57) ABSTRACT

A display apparatus conducting time-division gradation display is provided with: a capacitor for keeping a signal level captured by a first TFT; at least one pixel memory, for keeping the signal level captured by the first TFT; a second TFT matched with the corresponding pixel memory; and a bit selecting line for selectively-driving the second TFT, wherein, when a scanning signal line is selected, the first TFT sets the display signal level is set in the capacitor via the first TFT and the second TFT is selectively driven so that the display signal level is set in the at least one pixel memory, whereas the TFT is selectively driven so that a display signal level which has been displayed is switched to the display signal level supplied from the at least one pixel memory.

15 Claims, 36 Drawing Sheets

FOREIGN PATENT DOCUMENTS

| | | |
|---|---|---|
| JP | 10-254410 | 9/1998 |
| JP | 10-301536 | 11/1998 |
| JP | 2000-020020 | 1/2000 |
| JP | 2000-187467 | 7/2000 |
| JP | 2000-330517 | 11/2000 |
| JP | 2001-060076 | 3/2001 |
| JP | 2003-511746 | 3/2003 |
| KR | 2000-10923 | 2/2000 |
| WO | WO 98/40871 | 9/1998 |

OTHER PUBLICATIONS

Machine Translation of JP 2000-187467 to Satoshi.*
U.S. Appl. No. 10/035,440, filed Jan. 4, 2002, T. Numao.
U.S. Appl. No. 10/034,251, filed Jan. 3, 2002, T. Numao.
Japanese Office Action for corresponding Japanese Patent Application No. 2001-145504 mailed Aug. 10, 2004 (2 pgs.), including English Translation (4 pgs.).

* cited by examiner (1) PARTIAL PERIOD
(2) Sa1
(3) TOTAL DISPLAY TIME OF THE DATA OF BIT4
(4) S1
(5) WEIGHT OF BIT
(6) G1
(7) G2
(8) G3
(9) G4
(10) G5
(11) G6
(12) G7
(13) G8
(14) G9
(15) G10
(16) G11
(17) G12
(18) G13
(19) G14
(20) G15
(21) G16
(22) TOTAL TIME

DISPLAY APPARATUS AND DISPLAY METHOD

FIELD OF THE INVENTION

The present invention relates to a display apparatus composed of electro-optical devices such as an organic EL (Electro Luminescence) device and an FED (Field Emission Device) being arranged in a matrix manner.

BACKGROUND OF THE INVENTION

Recently thin display apparatuses using self-luminous devices such as an organic EL device and an FED have actively been developed. It is known that the self-luminous devices have characteristics such that the luminance of the device is proportional to the current density of the current passing through the device. It is also known that the characteristics of the devices, especially the characteristics of the applied voltage-current fluctuate so that a drive circuit using a constant current source is preferably used for the devices. However, it is difficult to construct the constant current source in reality and hence a constant current drive circuit is arranged using a constant voltage source. For this case, a proposed method is to provide means for detecting a current passing through a device and control the current detected by the means to be consistent.

FIG. 33 illustrates an organic EL display 101 which is an example of luminance correction using the above-identified current detection means, disclosed in Japanese Laid-Open Patent Publication No. 2000-187467 (Tokukai 2000-187467; published on Jul. 4, 2000). This display 101 is a passive drive display, including an organic EL panel 102 which is arranged such that a plurality of cathodes c0 to cn and a plurality of anodes s0 to sm, which are intersecting with each other, partition a display area in a matrix manner, and an organic EL device 103 is provided in each portion of the partitioned display area.

Outside of or being integrated into the organic EL panel 102, a cathode drive circuit 104 for driving the cathodes c0 to cn, anode drive circuits pg0 to pgm for driving each of the anodes s0 to sm individually, and current detection circuits is0 to ism for detecting each output current from the anode drive circuits pg0 to pgm. The current detection circuits is0 to ism (collectively termed is) detects a current value so as to supply the same to a control device 105, and in accordance with the detected current value, a luminous period or a luminous current, which is matched with the display information of each portion of the display area, is controlled.

The current detection circuit is is, as shown in FIG. 34, arranged such that a current detection resistor r1 is inserted in series with a line connected to one of the anodes s0 to sm, and an inter-terminal voltage of the current detection resistor r1 is detected in an A/D conversion circuit 106 so as to be output.

FIG. 35 illustrates an organic EL display 111 which is another example of luminance correction using the above-identified current detection means, disclosed in Japanese Laid-Open Patent Publication No. 10-254410/1998 (Tokukaihei 10-254410; published on Sep. 25, 1998). This display 111 is an active drive display, arranged such that the sum-total of the current values passing through all pixels is regulated by: (i) driving all organic EL devices of a display panel 112, by a controller 113, at a constant voltage via a scanning circuit 114 and a power source circuit 115; (ii) storing a current value, which is measured using. a method described below, in a current value memory 116; (iii) processing the stored data and display data in an arithmetic circuit 118, the latter data being supplied from the outside via an A/D conversion circuit 117; and (iv) supplying the display data obtained in (iii) to each pixel via a frame memory 119 and a write circuit 120.

In the case of this active drive, each pixel 121 of the display panel 112 is arranged as illustrated in FIG. 36. That is, the pixel 121 includes: a TFT 122 for capturing the display data; a capacitor 123 for storing the captured display data; an organic EL device 124, a TFT 125 for driving the organic EL device 124 in accordance with an output voltage of the capacitor 123; and a current detector 126 for detecting a current passing through the organic EL device 124.

The TFT 122 is brought into conduction by selecting a scanning signal line, and a voltage of a data signal line is stored in the capacitor 123. Using the voltage stored in the capacitor 123, a TFT 125 is controlled even when the TFT 122 is out of conduction so that an amount of the current passing through the organic EL device 124 is regulated. So in this case the above-identified regulation of the sum-total of the current values is done by: providing the current detector 126 between the TFT 125 and the organic EL device 124; converting the output of the current detector 126 into digital data in an A/D conversion circuit 127; and storing the data in the current value memory 116.

In the above-identified prior art, a passive drive display apparatus such as the display 101 disclosed in Japanese Laid-Open Patent Publication No. 2000-187467 successively selects the cathodes c0 to cn so that measuring currents passing through the anodes s0 to sm is to measure the current of the organic EL device 103 which is intersected with the selected cathode. In the meantime, an active drive display apparatus such as the organic EL display 111 disclosed in Japanese Laid-Open Patent Publication No. 10-254410/1998 is arranged so that, as described above, even if the scanning signal line is not selected, the TFT 125 is controlled using the voltage of the capacitor 123 so that a current passes through the organic EL device 124. Thus the measurement of the current of each organic EL device 124 can be carried out only on a device-by-device basis so that it is not possible to effectively measure the current passing through organic EL device(s) by simply measuring the current of each signal line, from outside of the display area as in the case of the passive drive. Moreover, it is also not possible to enlarge the area of each organic EL device 124, i.e. to increase the numerical aperture.

SUMMARY OF THE INVENTION

The objective of the present invention is to provide a display apparatus which can effectively detect current values of electro-optical devices and improve the numerical aperture, even though the apparatus is actively driven.

Another objective of the present invention is to provide a display apparatus and a display method in which a display period of each bit precisely corresponds to the weight of each bit and a control circuit is easily controlled.

A display apparatus in accordance with the present invention, provided with electro-optical devices P in respective areas partitioned by a plurality of first signal lines G and a plurality of second signal lines D intersecting with each other, each of the electro-optical devices P being driven so as to carry out displaying in accordance with a signal level supplied via the corresponding second signal line D while a first active device Q1 being selected via the corresponding first signal line G, comprises: current measuring means K, provided along the plurality of the corresponding second signal lines D, for measuring currents running through a plurality of corresponding first power supply lines E which supply load currents to the electro-optical devices P; storing means M for storing data measured by the current measuring means K; and correction means B for correcting externally supplied display data using the data which are read out from the storing means M so as to create the respective signal levels to be supplied to the plurality of the second signal lines D, wherein, a measuring period in which: along with selection via the plurality of the first signal lines, predetermined signal levels are supplied to the plurality of the second signal lines D so that each of the current measuring means K conducts measurement, is periodically included in a unit display period in which: along with selection via the plurality of the first signal lines G, the signal levels in accordance with display data are supplied to the plurality of the second signal lines D.

According to this arrangement, the display apparatus, in which the electro-optical devices P such as organic EL devices are provided in the electro-optical devices P provided in the respective areas partitioned in a matrix manner by the plurality of first signal lines G and the plurality of second signal lines D, and the electro-optical devices P are successively selected by the corresponding first active devices Q1 such as TFTs via the first signal lines G so as to carry out displaying in accordance with the signal levels supplied via the corresponding second signal lines D, is arranged so that the current measuring means K are provided along the plurality of the corresponding second signal lines D so as to measure currents running through the plurality of the corresponding first power supply lines E and the display data are corrected in accordance with the result of the measurement, and the current measurement is periodically carried out every unit of time or once in several units of time.

Thus, to dynamically correct the display data, which is for obtaining a desired gradation, in accordance with the variation of the temperature of the surroundings, it is unnecessary to provide the current measuring means K in each of the areas (electro-optical device P) even if the active matrix method is adopted so that the current measuring means K can be shared between the areas provided along each of the first power supply lines E (=the second signal lines D) or several of the first power supply lines E. On this account, it is possible to effectively detect the current value of each of the electro-optical devices P, and enlarge the space occupied with the electro-optical device P on each of the areas, in other words, increase the numerical aperture.

Moreover, the display apparatus in accordance with the present invention is preferably arranged so as to comprise electric potential keeping means C1, in accordance with the electro-optical devices P, for keeping signal levels captured by the first active devices Q1, wherein: (i) a scanning controller 3 for supplying selective-outputs to the plurality of the first signal lines G; and (ii) a signal controller 4 for supplying the signal levels to the plurality of the second signal lines D conduct scanning so as to initialize the electric potential keeping means C1 and so as to make the electro-optical devices P in a state of non-luminosity, immediately before the measuring period.

According to this arrangement, the scanning controller 3 and the signal controller 4 carry out the scanning to supply the above-identified signal levels to each of the electric potential keeping means which is realized by a capacitor, etc. so as to set the condition of the display, and to periodically insert the measuring period in at least one display period as described above, the scanning controller 3 and the signal controller 4 carry out the scanning to make the electro-optical devices P in a state of non-luminosity by initializing the electric potential keeping means C1, immediately before the measuring period.

This scanning to make the electro-optical devices P in a state of non-luminosity immediately before the measuring period makes it possible to measure the load current of a desired electro-optical device without being influenced by other electro-optical devices The display apparatus in accordance with the present invention, provided with electro-optical devices P in respective areas partitioned by a plurality of first signal lines G and a plurality of second signal lines D intersecting with each other, each of the electro-optical device P being driven so as to carry out displaying in accordance with a signal level supplied via the second signal line D while a first active device G being selected via the corresponding first signal line G, is arranged so as to comprise: second active devices Q10 corresponding to the electro-optical device P; pixel memories R1 and R2, corresponding to the second active devices Q10, for storing signal levels captured by the second active devices Q10; electric potential keeping means C1 for keeping a signal level captured by the first active device Q1 from the corresponding first power supply line E; and bit selecting lines Sa and Sb for selective-scanning the second active devices Q10, wherein, while the first signal line G is selected and a display signal level is set in the electric potential keeping means C1 through the first active device Q1, the second active devices Q10 are selectively driven so that the display signal levels are also set in the pixel memories R1 and R2, and the second active device Q10 are selectively driven when the first signal lines are not selected, so that a display signal level of the electro-optical device P is switched to the display signal level in the pixel memories R1 and R2.

Incidentally, the display signal levels of the pixel memories R1 and R2 are set either via the first active device Q1 and the second active device Q2 or via a new sixth active device.

According to the former arrangement, displaying is carried out by the scanning of the first signal line G, and at the same time, by selecting the bit selecting lines Sa and Sb, the display signal levels can be written in the pixel memories R1 and R2 corresponding to the bit selecting lines Sa and Sb. Then by selecting the bit selecting lines Sa and Sb while the first signal line G is not selected, the display signal levels can be read out from the pixel memories R1 and R2.

According to the latter arrangement, it is possible to write the display signal levels in the pixel memories R1 and R2 while the sixth active device is selected. Then by selecting the bit selecting lines Sa and Sb while the first signal line G is not selected, the display signal levels can be read out from the pixel memories R1 and R2.

Thus, within one scanning period in which the first scanning signal lines G are successively scanned, it is possible to use the time, which is remained after displaying the data of the lower bits, for displaying the data of the higher bits. On this account, the display period of each bit can be precisely matched with the weight of each bit. For instance, when data for 4 bits is displayed, it is possible to precisely match the proportion between the bits with 1:2:4:8, i.e. the proportion of the weight between the bits. Moreover, it is possible to link the selective periods of the bits in neighboring scanning signal lines G so that it becomes easy to control the control circuit (scanning controller) which responds to externally supplied synchronous signals so as to output selective signals to the scanning signal lines G.

Furthermore, the display apparatus in accordance with the present invention is preferably arranged so as to further comprise a third active device Q3 each provided to each of the electric potential keeping means C1, for supplying a signal level, which is different from the signal level supplied to the second signal line D, to the electric potential keeping means, in response to a selective-output supplied from a third signal line S which supplies an output while the first signal lines G does not supply an output, wherein the first active device Q1 sets the display signal level, meanwhile the third active device Q3 sets an erase signal level.

According to this arrangement, after displaying is started by dint of the scanning of the first signal lines G, it is possible to erase the display by the third active device Q3 before all of the first signal lines G are scanned. In other words, it is possible to make the unit of the display time shorter than the scanning period.

Thus, in conducting the digital gradation control, it is possible to carry out short-time displaying which is precisely matched with the weight of lower bits, so that it becomes possible to carry out a delicate gradation control with the large number of bits.

Moreover, the display apparatus in accordance with the present invention is arranged so that the electric potential keeping means is constituted by a fourth active device Q4 and a capacitor C1.

According to this arrangement, when the second active device Q10 is selectively driven while the first signal line G is not selected, by subjecting the fourth active device to the non-selective driving, it is possible to prevent the display signal levels kept in the pixel memories R1 and R2 being unnecessarily altered by the influence of the capacitor C1.

Thus it is possible to enlarge the capacity of the capacitor C1 so that it is possible to reduce the variation of the electric potential of the capacitor C1, which occurs with the passage of time.

Moreover, the display apparatus in accordance with the present invention is preferably arranged so that a fifth active device Q5 is provided between an input of the pixel memory R1 and an output of the pixel memory R2, and while the fifth active device Q5 is subjected to non-selective driving, the display signal levels of the pixel memories R1 and R2 are set.

According to this arrangement, provided that a static memory arrangement, in which the input and output of a first inverter circuit INV1 are connected to the output and input of a second INV2 respectably, is adopted as the pixel memories R1 and R2, the output of the second inverter circuit INV2 influences on the input of the first inverter circuit INV1 in the case of direct connection between the input terminal of the first inverter circuit INV1 and the output terminal of the second inverter circuit INV2, so that the output impedance of the second inverter circuit INV2 has to be adjusted, to eliminate the influence of the output terminal of the second inverter circuit INV2 so as to correctly input a signal from the second signal line D to the input terminal of the first inverter circuit INV1. In the meantime, when the fifth active device Q5 is provided between the input terminal of the first inverter circuit INV1 and the output of the second inverter circuit INV2, it is possible to prevent the output of the second inverter circuit INV2 being supplied to the input terminal of the first inverter circuit INV1 by making the fifth active device Q5 in the state of non-selection at the moment of inputting a signal from the second signal line D to the input terminal of the first inverter circuit INV1, so that the display signal levels of the pixel memory R1 and R2 can be set.

Also, when the first signal line G is not selected while the fifth active device Q5 is selected, the outputs of the pixel memories R1 and R2 are supplied to the input terminals thereof so that the static memory circuit is constituted, and consequently the display signal levels of the pixel memories R1 and R2 are kept.

Furthermore, the display apparatus in accordance with the present invention is arranged so that the pixel memories R1 and R2 receive power from a second power supply line Ea which is independent from a first power supply line E that provides a load current to the electro-optical device P.

According to this arrangement, when the first active device Q1 is selected, it is possible to arrange the first power supply line E to have an electric potential such as a GND potential with which the load current cannot pass through the first power supply line E, so that the signal levels are written in the electric potential keeping means C1 and the pixel memories R1 and R2 without carrying out displaying. Moreover, it is possible to control the display period of the electro-optical device P in accordance with the data stored in the electric potential keeping means C1 and the pixel memories R1 and R2 in isolation from the scanning period of the first active device Q1, so that time-division gradation display can be realized in the display period.

A display method of the present invention, including electro-optical devices P in respective areas partitioned by a plurality of first signal lines G and a plurality of second signal lines D intersecting with each other, each of the electro-optical devices P carrying out displaying in accordance with a signal level supplied via the corresponding second signal line D while a first active device Q1 being selected via the corresponding first signal line G, comprises the steps of: setting a display signal level in the electro-optical device P via the first active device Q1 while the first signal line G is selected, and selectively driving the second active device Q10 so that the display signal levels are set in the pixel memories R1 and R2; and switching a display signal level of the electro-optical device P to the display signal levels set in the pixel memories R1 and R2, by selectively driving the second active device Q10 while the first signal line G is not selected.

In this method, it is possible to precisely match the display period of each bit with the weight of each bit, as in the above-mentioned display apparatus in accordance with the present invention. Also, it is possible to link the selective periods of the bits in neighboring scanning signal lines so that the control circuit can be controlled easily.

For a fuller understanding of the nature and advantages of the invention, reference should be made to the ensuing detailed description taken in conjunction with the accompanying drawings.

DESCRIPTION OF THE EMBODIMENTS

Referring to FIGS. 1 to 4, a first embodiment in accordance with the present invention will be described as below.

Figure 1:
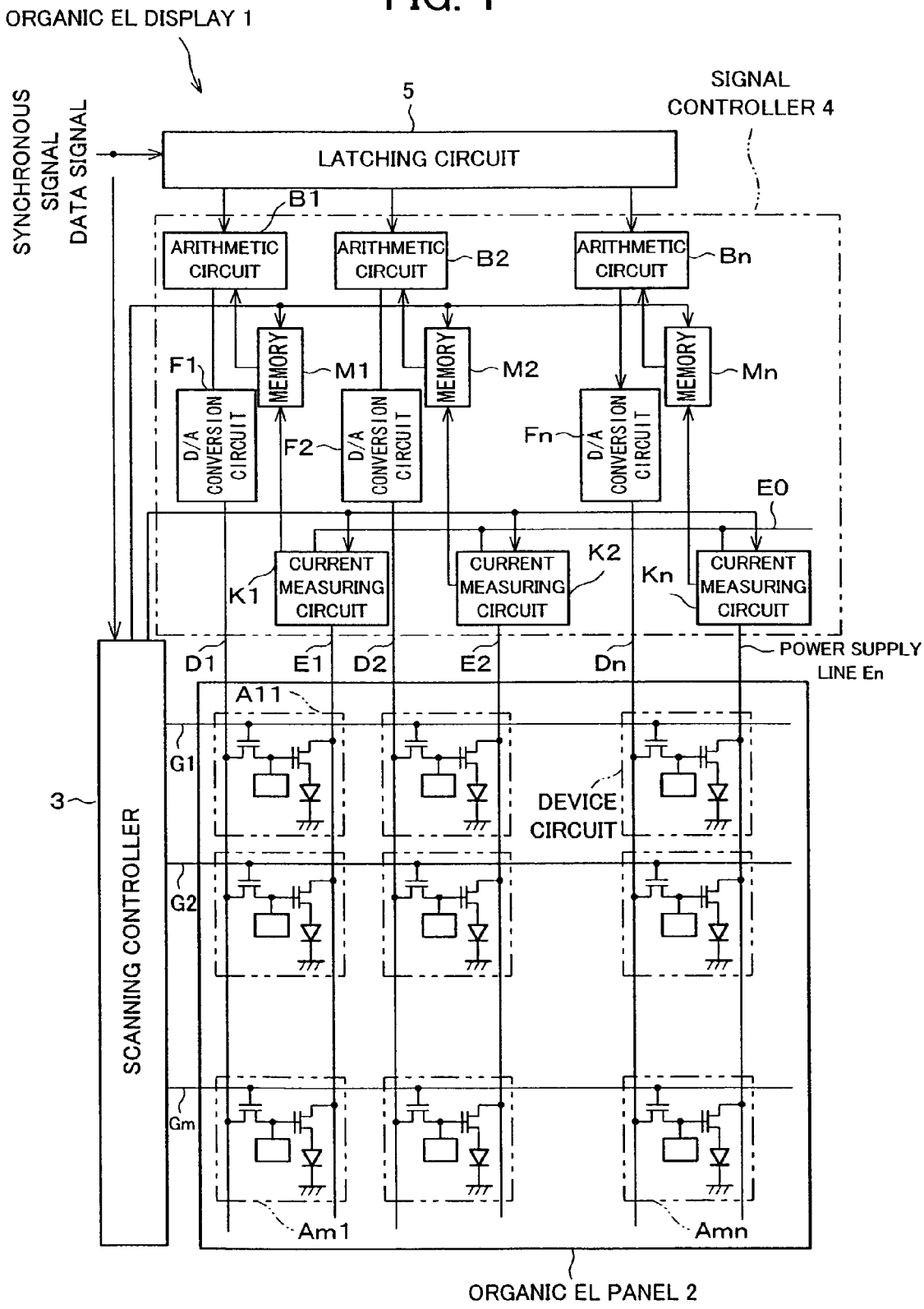
FIG. 1 illustrates an overall arrangement of an organic EL display in accordance with a first embodiment of the present invention.

FIG. 1 illustrates an overall arrangement of an organic EL display 1 in accordance with the first embodiment of the present invention. The organic EL display 1 is basically composed of an organic EL panel 2, a scanning controller 3, a signal controller 4, and a latching circuit 5. The organic EL panel 2 is partitioned by: (i) scanning signal lines G1, G2, . . . , Gm (collectively termed G) which are a plurality of first signal lines; and (ii) data signal lines D1, D2, . . . , Dn (collectively termed D) which are a plurality of second signal lines, the lines (i) and (ii) intersecting with each other, and in the partitioned areas arranged in a matrix manner, device circuits A11, A12, . . . , A1*n*; A21, . . . , Amn (collectively termed A) are formed. While the scanning controller 3 is selecting a scanning signal line G, the corresponding device circuits A capture signal levels supplied from the signal controller 4 to the corresponding data signal lines D, so as to carry out displaying matched with the signal levels.

To this organic EL display 1, synchronous signals and data signals are supplied from outside. Responding to the synchronous signals, the scanning controller 3 sends selecting signals to the scanning signal lines G. Also responding to the synchronous signals, the latch circuit 5 successively latches incoming serial data signals and store the signals for one line, so as to produce parallel data signals in accordance with data signal lines D1 to Dn and sends the signals to the signal controller 4. In the signal controller 4, D/A conversion circuits F1 to Fn (collectively termed F), which are matched with the data signal lines D1 to Dn, convert the data signals into analog signals. The analog signals are supplied to the data signal lines D1 to Dn.

To the organic EL panel 2, power is supplied from a power supply line E0 by passing through the device circuits A, and power supply lines E1 to En (collectively termed E) which are first power supply lines are provided in parallel with the data signal lines D1 to Dn. At the ends of the power supply lines E1 to En, which ends being close to the signal controller 4, current measuring circuits K1 to Kn (collectively termed K) are provided. In the current measuring circuits K, a current passing through each of the device circuits A11 to Amn via the power supply lines E1 to En is measured line by line, at a predetermined timing of the measurement. The results of the measurement are set as correction values (or voltage data for providing a necessary current value) of the device circuits A, so as to be stored respectively in memories M1 to Mn (collectively termed M) which are storing means. Then when the data signals are written in via the data signal lines D1 to Dn, arithmetic circuits B1 to Bn (collectively termed B) which are correction means correct the data signals from the latch circuit 5 using the data of the memories M1 to Mn so that the data signals are supplied to the D/A conversion circuits F1 to Fn, as described above. In this manner, the luminance correction of the device circuits A is conducted.

Figure 2:
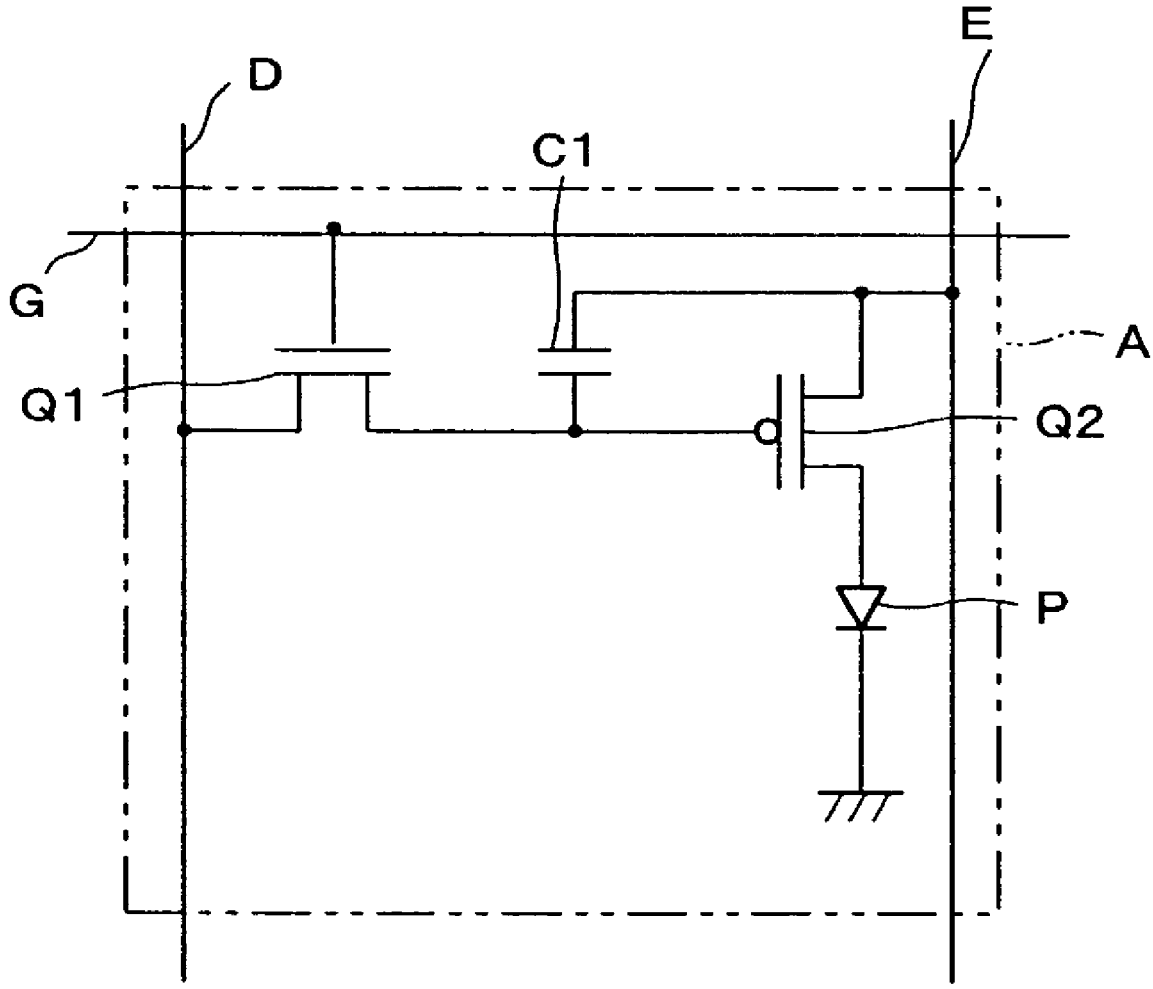
FIG. 2 is an electrical circuit diagram of a device circuit in the organic EL display shown in FIG. 1.

FIG. 2 is an electrical circuit diagram of a single device circuit A. This device circuit A is composed of: an n-type TFT Q1 which is a first active device, in which a gate is connected to the scanning line G whereas a source (drain) is connected to the data signal line D, and while the TFT Q1 is selected via the scanning signal line G, the data signals are captured from the corresponding data signal line D; a capacitor (memory device) C1 which is electric potential keeping means (signal keeping means) being connected to the drain (source) of the TFT Q1 and keeping the captured data signals; an organic EL device P which is an electro-optical device; and a p-type TFT Q2 (current controlling means) for controlling a current which runs from the power supply lines E to the organic EL device P, in accordance with the charging voltage of the capacitor C1.

Figure 3:
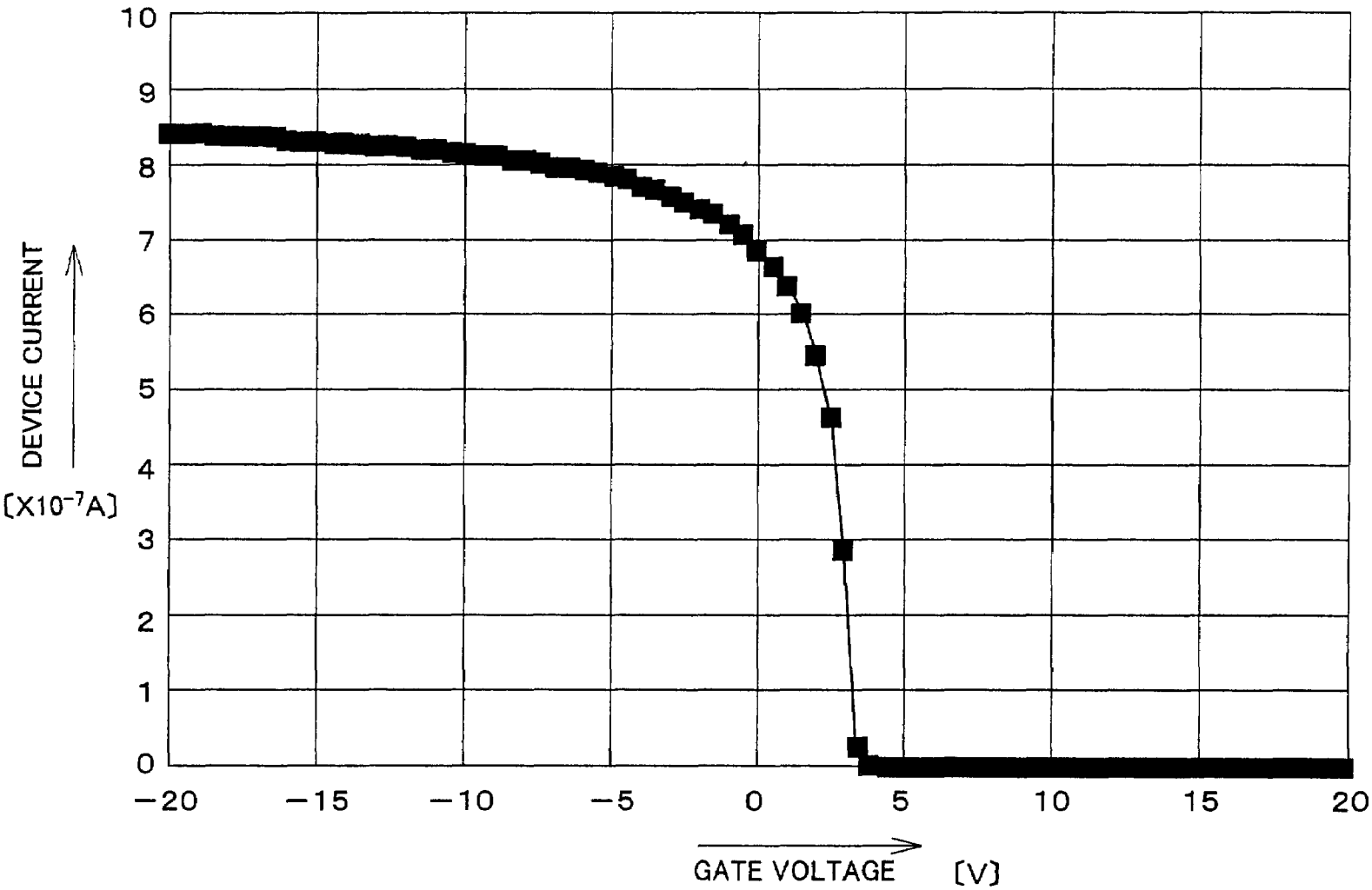
FIG. 3 is a graph showing the current characteristics of an electro-optical device.

FIG. 3 illustrates the characteristics of: (i) the gate voltage of the TFT Q2; and (ii) the device current of the organic EL device P, in an electro-optical device composed of the TFT Q2 and the organic EL device P. Incidentally, these characteristics are in the case when the voltage of the power supply lines E in FIG. 1 is +6V. By correcting the electric charges in the capacitors C1 using the correction. values stored in the memories M as described above, the device currents of the organic EL devices P can be corrected in the arithmetic circuits B, and this makes it possible to conduct the luminance correction to keep the luminance consistent regardless of the change over time and the temperature characteristics of the organic El devices P.

Incidentally, although FIGS. 1 and 2 describe the device circuit A as a single pixel, this is for the sake of simplifying the explanation so that in reality each of R, G, and B of the device circuit A in FIG. 2 may individually constitute a pixel, or each of R, G, and B elements may be composed of a plurality of the device circuits A.

Figure 4:
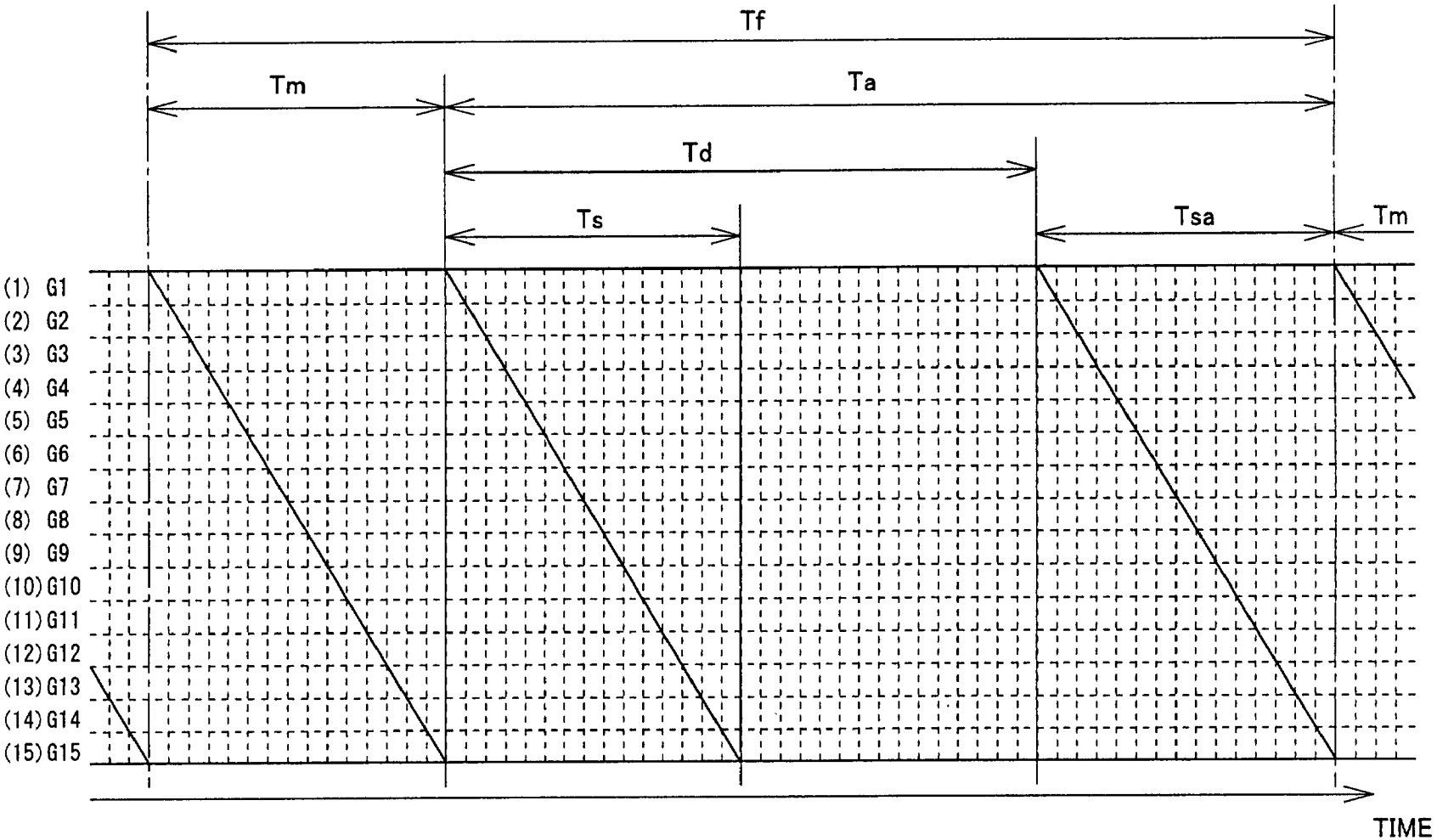
FIG. 4 illustrates an example of a driving method of the organic EL display shown in FIG. 1.

FIG. 4 illustrates an example of the driving method of the above-identified organic El display 1. As described above, the organic EL display 1 converts the data signals into corresponding analog voltage levels in the D/A conversion circuits F, so that in accordance with this voltage levels, the TFT Q2 conducts an analog gradation control to control the current running through the organic EL device P. In FIG. 4, 15 scanning signal lines from G1 to G15 are set as one group, and (1) to (15) in FIG. 4 show which scanning signal line is selected from the lines G1 to G15.

In this example of the scanning, one frame period Tf is composed of a current measuring period Tm and a display period Ta, and the scanning is conducted at intervals of several tens of [Hz]. In the current measuring period Tm, the scanning signal lines G1 to G15 are successively selected, and since the arithmetic circuits B supply a predetermined voltage to the organic EL devices P of the device circuits A, the current characteristics of the organic EL circuits P are successively measured. The following display period Ta is composed of a luminous period Td and an erase period Tsa. In a scanning period Ts which is included in the luminous period Td, the scanning signal lines G1 to G15 are successively selected as in the current measuring period Tm so that data signals are captured in the capacitors C1, whereas the rest of the luminous period Td is allocated for displaying in accordance with the data signals. Then, in the present invention, the scanning signal lines G1 to G15 are successively selected in the erase period Tsa before conducting the current measurement so that the data in the capacitors C1 are erased and initialized.

In this way, the currents are measured in the device circuits A including the capacitors C1 which are the electric potential keeping means after initializing all of the device circuits A, so that since the currents running through the power supply lines E are load currents of only the device circuits A of the selected scanning signal line G, it becomes possible to conduct the current measurement of all of the power supply lines E (data signal lines D) on a line-by-line basis, by dint of the control by the signal controller 4 outside of the display area. On this account, when the display data for acquiring desired gradation is dynamically corrected in accordance with the change of the temperature of the surroundings etc., even if the organic El panel 2 is arranged in an active matrix manner, it is possible to effectively detect the current value of the organic EL devices P and enlarge the area of the organic EL devices P on the device circuits A, i.e. increase the numerical aperture.

Incidentally, although the current measurement is conducted in every display period Ta (frame period Tf) in the example of FIG. 4, in the case of conducting the current measurement at intervals of several periods, the erase period Tsa is provided in a frame just before the frame in which the current is measured, and the erase period Tsa is followed by the current measuring period Tm.

Figure 5:
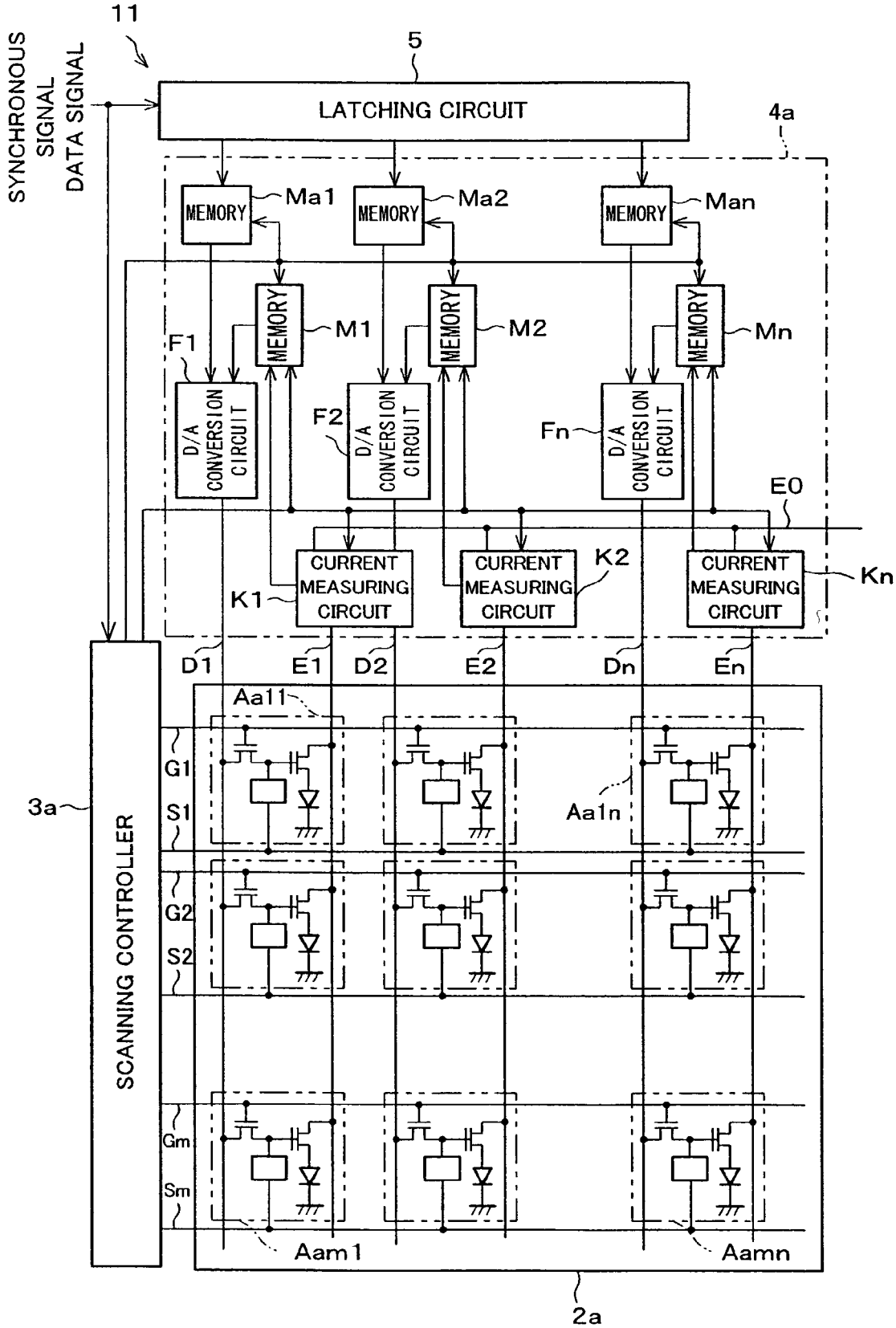
FIG. 5 illustrates an overall arrangement of an organic EL display in accordance with a second embodiment of the present invention.
Figure 6:
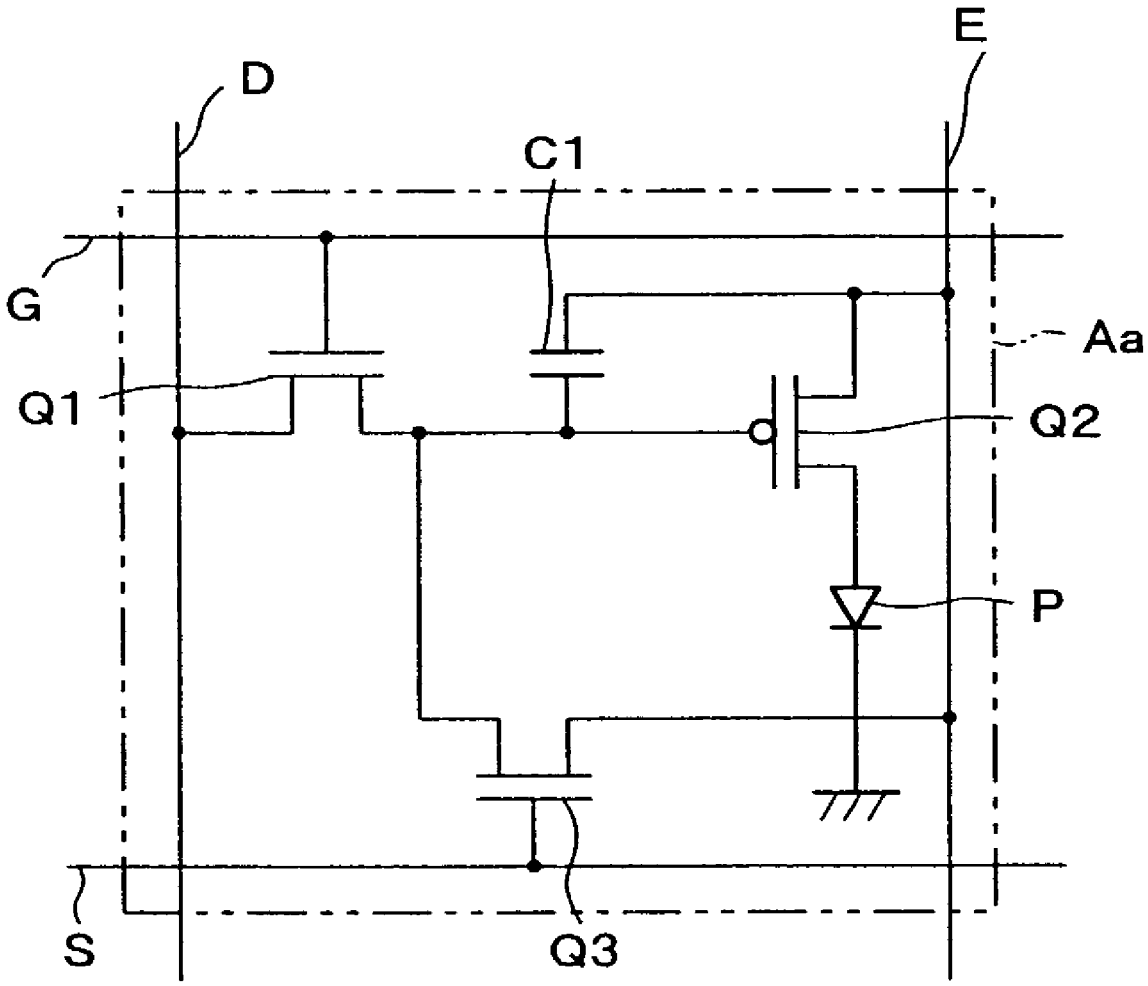
FIG. 6 is an electrical circuit diagram of a device circuit in the organic EL display shown in FIG. 5.
Figure 7:
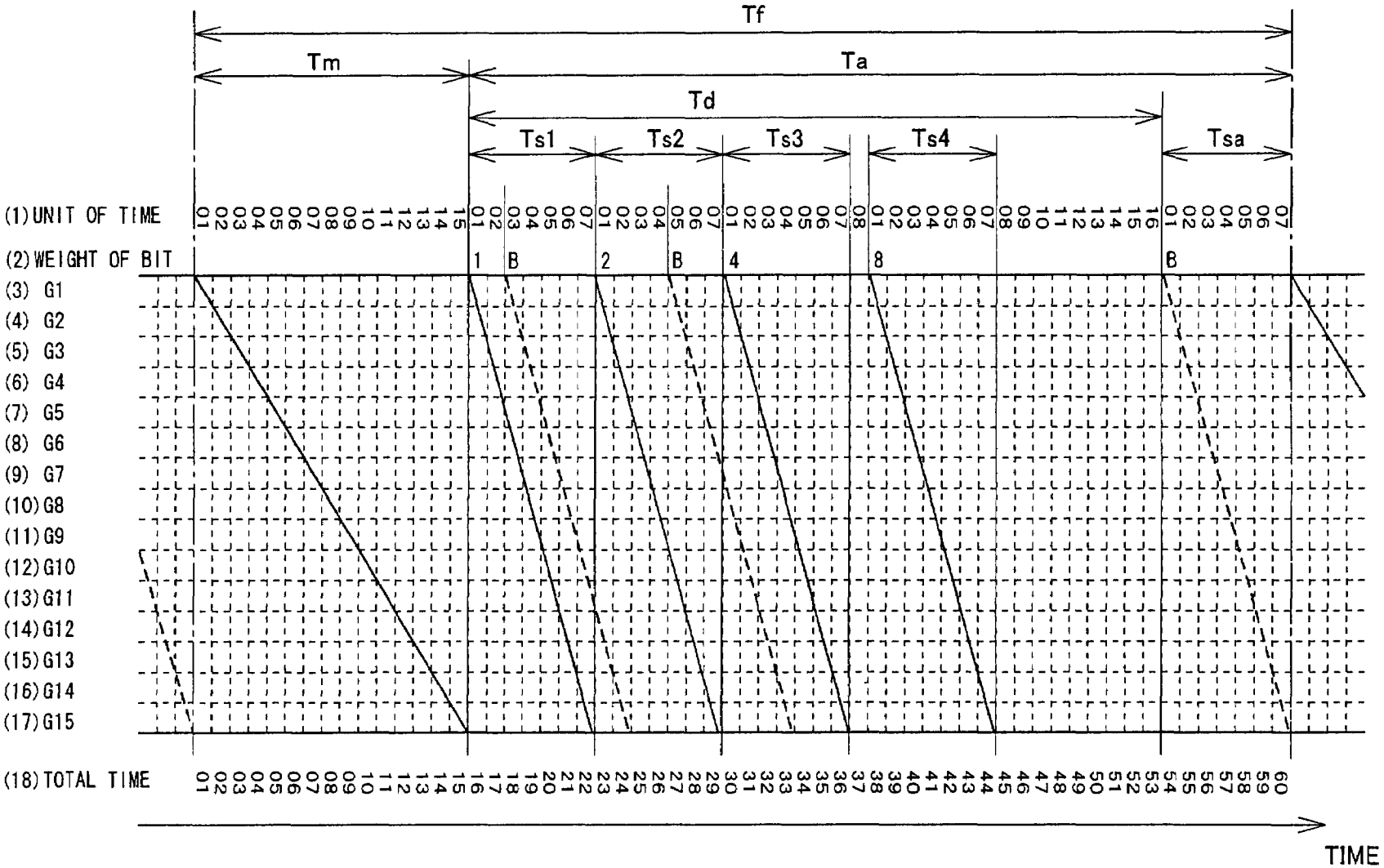
FIG. 7 illustrates an example of a driving method of the organic EL display shown in FIG. 5.

The following description will discuss a second embodiment in accordance with the present invention in reference to FIGS. 5 to 7.

FIG. 5 illustrates an overall arrangement of an organic EL display 11 in accordance with the second embodiment of the present invention. This organic EL display 11 is similar to the above-mentioned organic EL display 1, and hence members having the same functions as those described in the first embodiment are given the same numbers so that the descriptions are omitted. It should be noted that while the above-mentioned organic EL display 1 adopts an analog gradation control, this organic EL display 11 adopts a digital gradation control. Thus as FIG. 5 shows, the organic EL display 11 includes memories Mal to Man (collectively termed Ma) instead of the arithmetic circuits B1 to Bn of the organic EL display 1, and in the memories Ma, multi-bit data in accordance with each pixel, the data being sent in a serial manner, is broken down into each parallel bit, and the bits are successively supplied at scanning periods Ts 1 to Ts 4 which are described later. Incidentally, in the present embodiment, an organic EL panel 2*a* includes additional scanning signal lines S1 to Sm (collectively termed S) which are third signal lines, arranged in parallel with the scanning signal lines G1 to Gm and run through device circuits Aa11 to Aamn (collectively termed Aa), and a scanning controller 3*a* is provided so as to select and control the scanning signal lines G and S.

Now, when an organic EL device is driven as an active device, the methods for realizing gradation display are broadly divided into an analog gradation control and a digital gradation control, and the analog gradation control is, as described above, a method to control the value of the current running through the organic EL device. The device characteristics of this type of active device often exhibit variations in a threshold value, mobility, etc., and hence various methods have been developed to carry out the analog gradation control without such variations.

In the meantime, the digital gradation control is a method which can be divided into pixel division gradation and time-division gradation, and the pixel division gradation is a method arranged such that a single pixel is composed of a plurality of the organic EL devices and the graduation display is done by selectively turning on/off each organic EL device, whereas the time-division gradation is a method to control the duration of feeding the current running through the organic EL device. The pixel division gradation is arranged so that a single pixel is composed of a plurality of organic EL devices, and hence this method is not suitable for achieving high definition and hence the present invention adopts the time-division gradation. Incidentally, the time-division gradation is adopted as the digital gradation control in a PDP (Plasma Display Panel), etc.

As FIG. 4 clearly shows, while a scanning signal line Gi is selected, it is not possible to select the remaining scanning signal lines G1 to Gi−1 and Gi+1 to Gm. Thus, in the case of conducting the time-division gradation control, after a bit of the data is supplied to the scanning signal line Gi, the next bit of the data is not supplied to the line until all of the remaining scanning signal lines Gi+1 to Gm and G1 to Gi−1 receive the data, so that the display period per unit of time when a lower bit is supplied becomes longer, and the one frame period Tf also becomes longer. Thus the scanning signal lines S are provided so that the display started by the scanning signal lines G is converted to a blank display by the scanning using the scanning signal lines S, and this makes it possible to make the unit of the display time shorter than the above-identified scanning period Ts.

When the data signal supplied from the memory Ma is "1", a voltage in accordance with the data signal is supplied from the D/A conversion circuit F to the device circuit Aa via the data signal line D, meanwhile when the supplied data signal is "0", a voltage for making the organic El device P non-display is supplied from the D/A conversion circuit F to the device circuit A via the data signal line D.

FIG. 6 is an electrical circuit diagram of a device circuit Aa. Unlike the above-identified device circuit A, this device circuit Aa includes, for converting the display of the device circuit Aa into a blank display while other scanning signal lines G being selected, an n-type TFT Q3 which is a third active device and in which: a gate is connected to the scanning signal line S; a source (drain) is connected to the capacitor C1; and the drain (source) is set as an initializing (making the organic EL device P non-display) electric potential (electric potential of the power supply line E in FIG. 6). This TFT Q3 is brought into conduction so that the terminals of the capacitor C1 establish a short circuit and the stored data is erased, and hence the organic EL device P becomes a blank display. This arrangement of the device circuit Aa illustrated in FIG. 6 is disclosed in p. 924 to 927 of SID '00 DIGEST by K. Inukai et al.

FIG. 7 illustrates an example of the driving method of the organic EL display 11 in the case of the time-division gradation. In this example, 15 scanning signal lines of the organic EL panel 2*a* from G1 to G15 are set as one group, and (3) to (17) of FIG. 7 show which scanning signal line is selected from the lines G1 to G15. Also, (2) of FIG. 7 shows the weight of the bit. (1) of FIG. 7 illustrates units of time within each period whereas (18) of FIG. 7 illustrates the total time (the number of the unit of time), and one frame period Tf is composed of 60 units of time.

As in the above-identified example of the scanning in FIG. 4, this example of scanning is arranged such that the one frame period Tf is composed of the current measuring period Tm and the display period Ta, and the scanning is conducted, for instance, at intervals of several tens of [Hz]. During the current measuring period Tm, the scanning signal lines G1 to G15 are successively selected, and since the memory Ma provides a predetermined voltage for the organic EL device P of the device circuit Aa, the current characteristics of the organic EL devices P are successively measured.

The following display period Ta is also composed of the luminous period Td and the erase period Tsa. Within the luminous period Td, 4 scanning periods Ts1 to Ts4 in accordance with each of the bits are arranged. In this example, the weight of one bit corresponds to two units of time. In the first scanning period Ts1, the scanning signal lines G1 to G15 are successively selected and the data signal of bit1 is captured in the capacitor C1 so displaying is carried out, and after two units of time, blank scanning is conducted as the scanning signal lines S1 to S15 are successively selected. In the following scanning time Ts2, the scanning signal lines G1 to G15 are successively selected and the data signal of bit2 is captured in the capacitor C1 so that displaying is carried out, and after 4 units of time, the blank scanning is conducted as the scanning signal lines S1 to S15 are successively selected.

Then in the scanning period Ts3, the scanning signal lines G1 to G15 are successively selected and the data signal of bit3 is captured in the capacitor C1 so that displaying is carried out. In the case of this weight of bit3, displaying is conducted for 8 units of time without conducting the blank scanning, and in the following scanning period Ts4, the data signal of bit4 is captured so that displaying is carried out for 16 units of time. Thus the proportion of the displaying periods between the bits is 1:2:4:8. When the display of the bit4 is finished, in the erase period Tsa composed of 7 units of time, the blank scanning is conducted in preparation for the next current measuring period Tm.

As described above, in the case of conducting the digital gradation control, even the lower bits of the data can carry out short-time displaying in accordance with the weight of the bits by: providing the scanning signal lines S and the TFT Q3; converting the display started by the scanning signal lines G into a blank display by the scanning using the scanning signal lines S; and making the unit of the display time per unit shorter than the scanning period Ts, so that it becomes possible to carry out a delicate gradation control with the large number of bits.

The scanning in the luminous period Td in this driving method shown in FIG. 7 is described in p. 924 to 927 of the above-mentioned SID '00 DIGEST, however, this example shown in FIG. 7 realizes the measurement of the current while conducting the time-division gradation, by further setting the erase period Tsa and the current measuring period Tm.

In the luminous period Td, luminous potential stored in the capacitor C1 of each device circuit Aa is specified device by device in accordance with the current value of each device circuit Aa measured during the current measuring period Tm. That is to say, during the current measuring period Tm, a predetermined voltage is charged in the capacitor C1 of each device circuit Aa and at this time the current value passing through the organic EL device P of each device circuit Aa is measured using the current measuring circuit K, then based on the result of the above, the correction value of each device circuit Aa is created so as to be stored in the memory M. Then during the luminous period Td, the D/A conversion circuit F generates a voltage with reference to the correction value of each circuit Aa when the data is luminous potential, and the luminous potential is stored in the capacitor C1 of each device circuit Aa.

In this manner, the present invention is arranged such that third active devices are provided, each provided to each of the electric potential keeping means, for supplying a signal level, which is different from the signal level supplied to the second signal line, to the electric potential keeping means, in response to a selective-output supplied from a third signal line which supplies an output while the first signal lines does not supply an output, wherein the first active device sets the display signal level, meanwhile the third active device sets an erase signal level.

On this account, after the display is started by the scanning of the first signal lines, before the scanning of the first signal lines is finished, it is possible to erase the display by the scanning of the second signal lines. Thus it is possible to make the unit of display time shorter than the scanning period.

Thus, in conducting the digital gradation control, it is possible to carry out short-time displaying which precisely corresponds to the weight of lower bits, so that it becomes possible to carry out a delicate gradation control with the large number of bits.

The following description will discuss a third embodiment in accordance with the present invention in reference to FIGS. 8 to 15.

Figure 8:
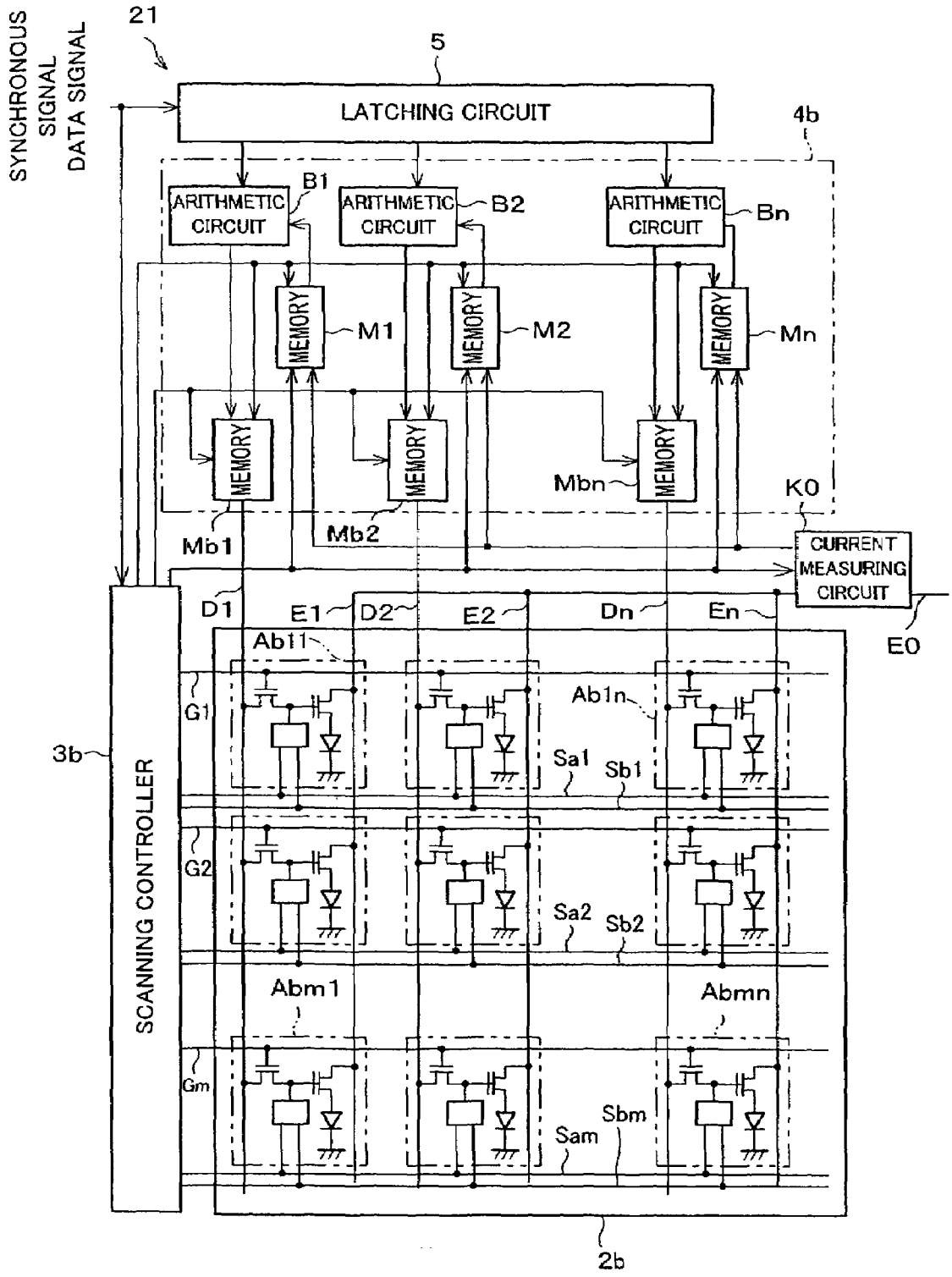
FIG. 8 illustrates an overall arrangement of an organic EL display in accordance with a third embodiment of the present invention.
Figure 9:
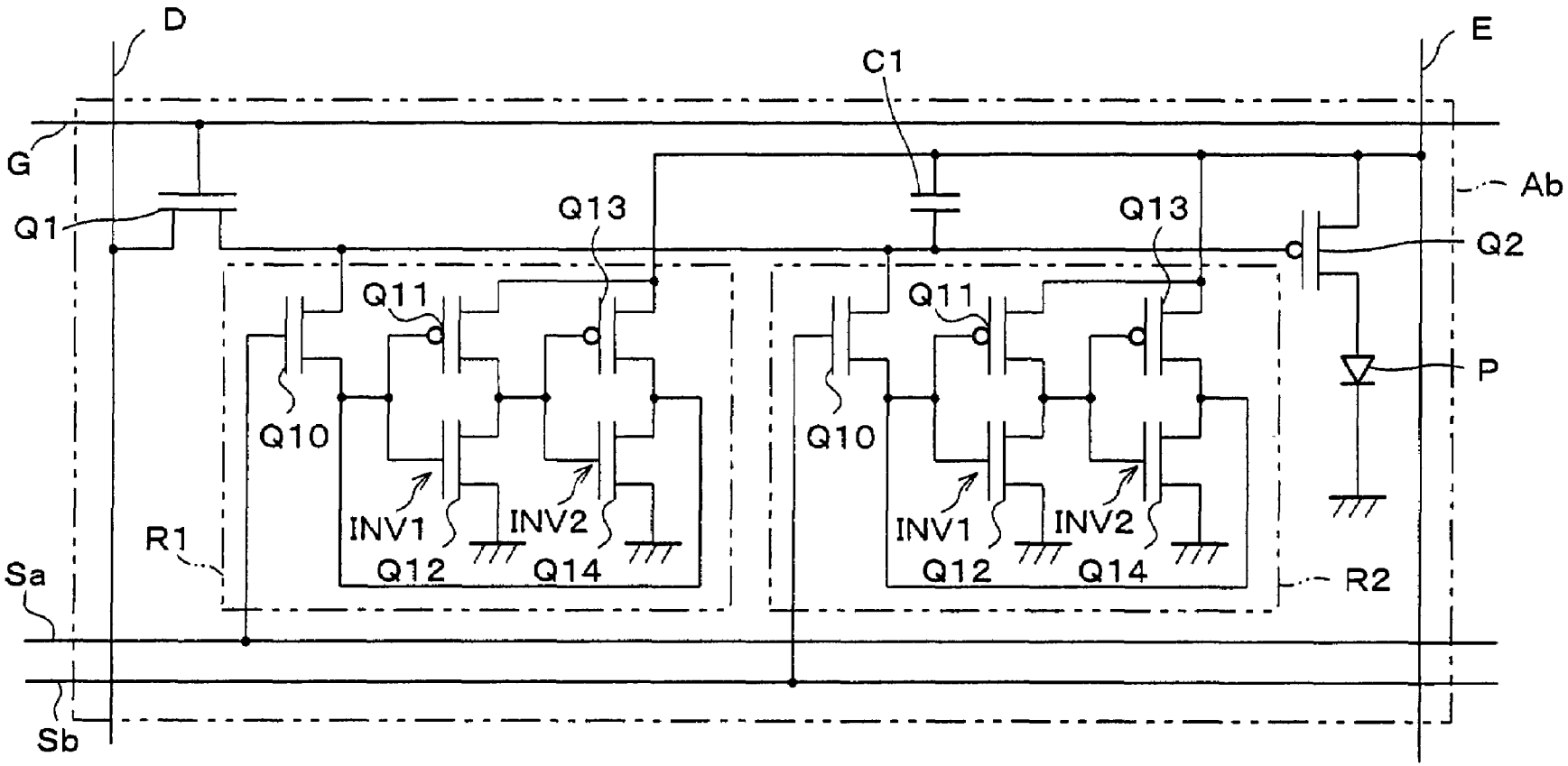
FIG. 9 is an electrical circuit diagram of a device circuit in the organic EL display shown in FIG. 8.

FIG. 8 illustrates an overall arrangement of an organic EL display 21 in accordance with the third embodiment of the present invention. FIG. 9 is an electric circuit diagram illustrating a device circuit Ab in an organic EL panel 2*b* of the organic El display 21. This organic EL display 21 is similar to the above-mentioned organic EL displays 1 and 11, and hence members having the same functions as those described are given the same numbers so that the descriptions are omitted.

This organic EL display 21 adopts a special scanning method as below, so prior to the description of this method, the above-mentioned scanning method in FIG. 7 will be described in detail. The scanning method in FIG. 7 is arranged so that scanning time necessary for the time-division gradation display for 4 bits is: 7 units (a single scanning period)×5 units (=for 4 bits+1 blank)=35 units of the time, whereas the display period Ta requires: 7 units (scanning period for the first bit)+7 units (scanning period for the second bit)+8 units (luminous period for the third bit)+16 units (luminous period for the fourth bit)+7 units (blank scanning period)=45 units of the time. In the display period Ta, the units actually used for the lighting are: 2+4+8+16=30 units of the time.

In this way, the display period Ta in the driving method in FIG. 7 includes a lot of units which are neither used for scanning nor lighting so that it is necessary to shorten the time for a single scanning and conduct a high-speed scanning, and hence the drive circuits such as the controllers 3*a* and 4 and the active device have to be accelerated. Moreover, since some units not being used for the lighting are included in the display period Ta, it is necessary to increase the luminous intensity per unit of time, and hence the current passing through the organic EL device P is increased so that the change with time is accelerated.

Figure 10:
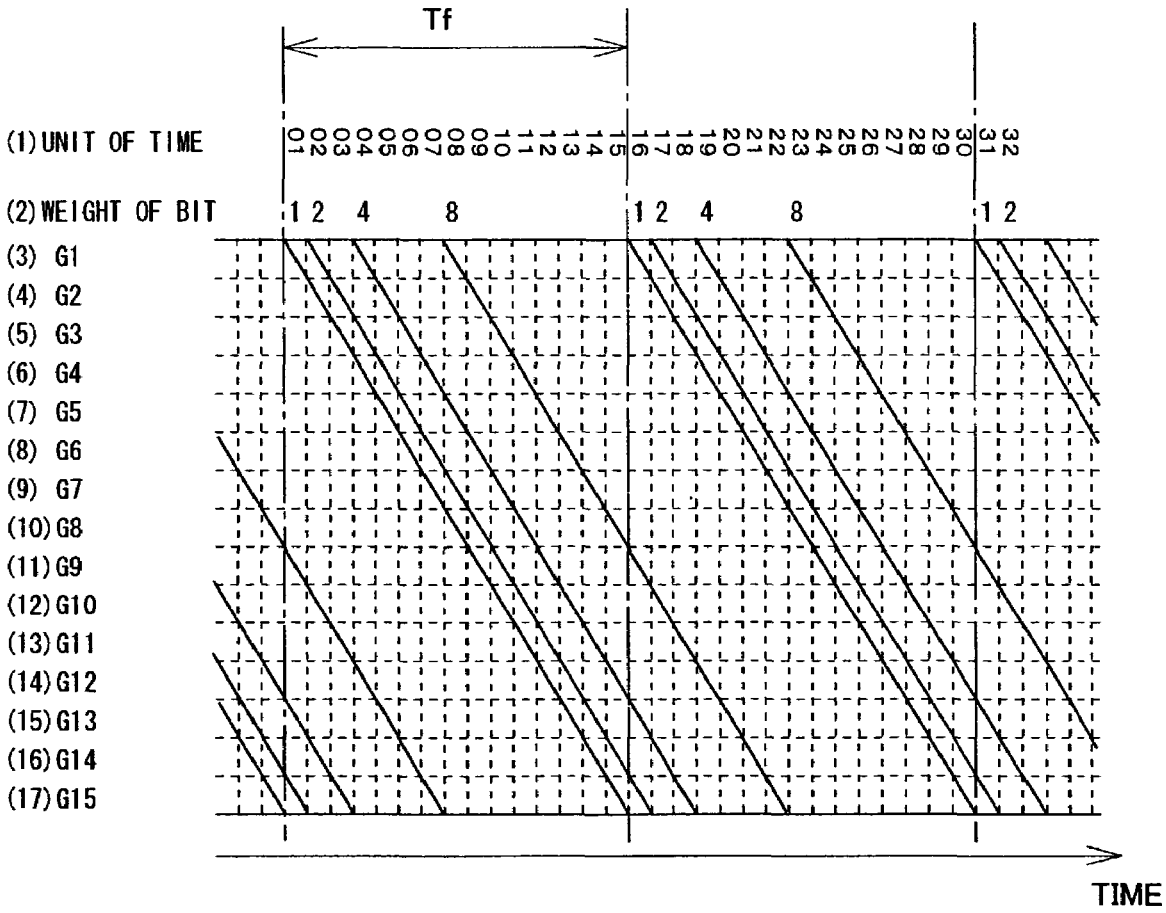
FIG. 10 illustrates a driving method of a display of the prior art.

Accordingly, it is possible to adopt a driving method disclosed in Japanese Laid-Open Patent Publication No. 63-226178/1988 (Tokukaisho 63-226178; published on Sep. 20, 1988) as a driving method of the time-division gradation in which the non-scanning time and the non-luminous time in the display period Ta are eliminated. FIG. 10 illustrates the driving method of the prior art. This example in FIG. 10 also sets 15 scanning signal lines G1 to G15 of the matrix-type display as one group, and (3) to (17) in FIG. 10 show which scanning signal line is selected from the lines G1 to G15. Each pixel realizes a gradation display of 16 gradations (4 bits), and carries out a binary display in accordance with the time in proportion to the weight of the bits, 1:2:4:8. (1) of FIG. 10 indicates a unit of time, and one frame period Tf is composed of 15 units of time. (2) of FIG. 10 shows the weight of the bits.

Each pixel is provided with electric potential keeping means so that in (3) to (17) of FIG. 10, an oblique line indicates that a pixel is selected by the scanning signal line, and the pixel is kept as such until the next oblique line. Thus the proportion of the displaying periods between the bits is 1:2:4:8 as described above.

Figure 11:
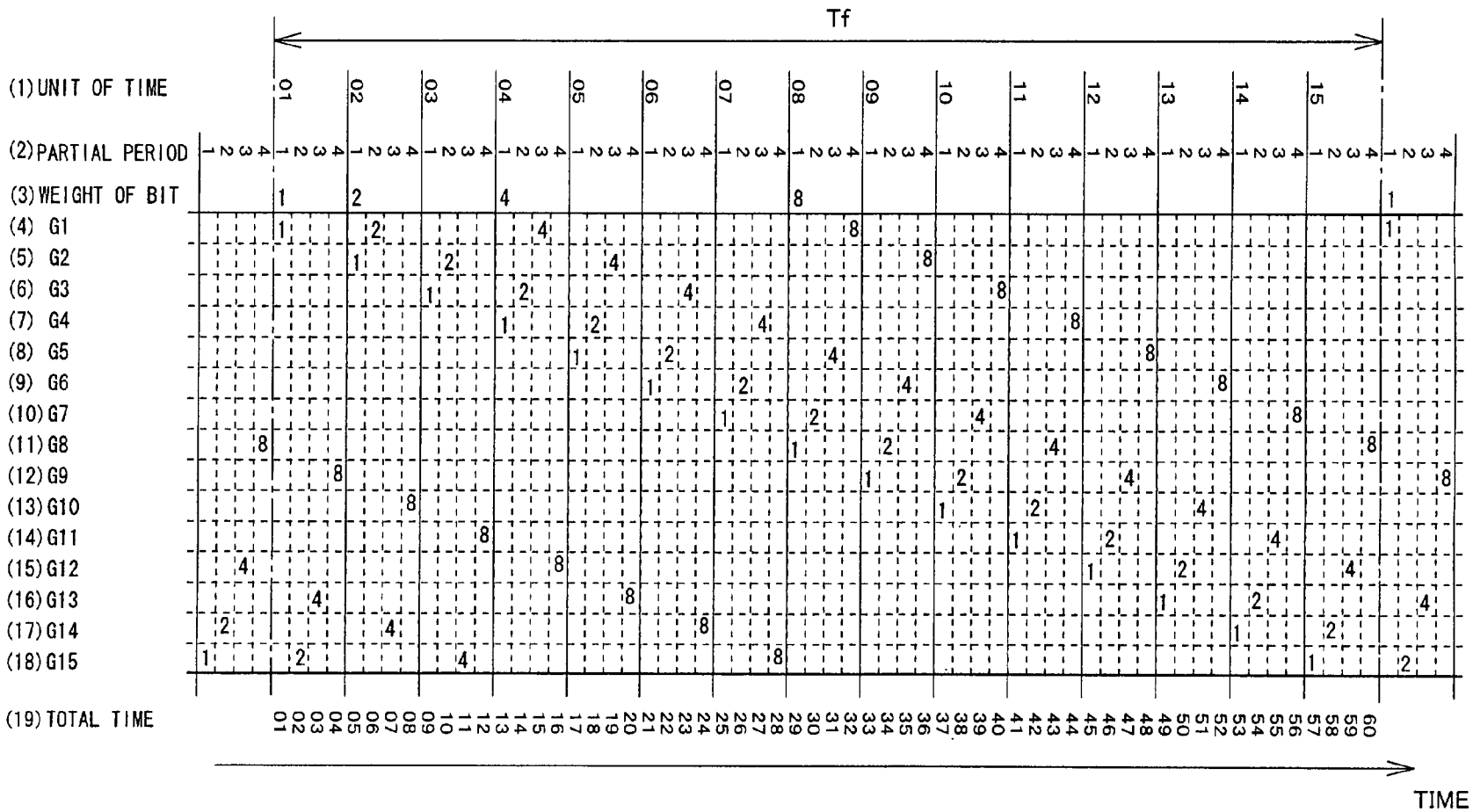
FIG. 11 illustrates a part of the driving method shown in FIG. 10 more specifically.

However, it is impossible to simultaneously write in different sets of the data to a plurality of the pixels matched with different scanning signal lines respectively, by using a common data signal line. Thus Japanese Laid-Open Patent Publication No. 63-226178/1988 is arranged such that, as a partial period in (2) of FIG. 11 indicates, each unit of time in (1) of FIG. 10 is divided into 4 (the number of the bits), and the first partial period of the unit is for the writing of the first bit, the second partial period is for the writing of the second bit, the third partial period is for the writing of the third bit, and the fourth partial period is for the writing of the fourth bit, so that this makes it possible to conduct the time-division gradation control as shown in FIG. 10. Incidentally, the unit of time shown in (1) and the weight of the bit (3) shown in FIG. 11 are matched with (1) and (2) in FIG. 10 respectively, and the states of the selection (4) to (18) of FIG. 11 are matched with (3) to (17) of FIG. 10 respectively. (19) of FIG. 11 indicates the total time of the partial periods.

However, in the driving method of the time-division gradation disclosed in Japanese Laid-Open Patent Publication No. 63-226178/1988, as FIG. 11 indicates, actual proportionality between the partial display periods is 5:9:17:29 rather than 1:2:4:8. That is, in reality, the display time is not proportional to the weight of the bits. Thus the driving method disclosed in Japanese Laid-Open Patent Publication No. 63-226178/1988 has a disadvantage such that adjusting the proportionality between the display periods to be precisely matched with the weight of the bits is difficult.

Moreover, as 01 to 05 in the total time (19) of FIG. 11 illustrate, after the scanning signal line G1 is selected, the scanning lines G15, G13, G9, G2 are selected in this order. That is, the scanning signal lines are selected in disperse manner rather than in a successive manner, and hence in addition to the above-identified disadvantage, it is difficult in this driving method to control the scanning controller in response to synchronous signals supplied from outside, the scanning controller supplying selective signals to each of the scanning signal lines.

Figure 12:
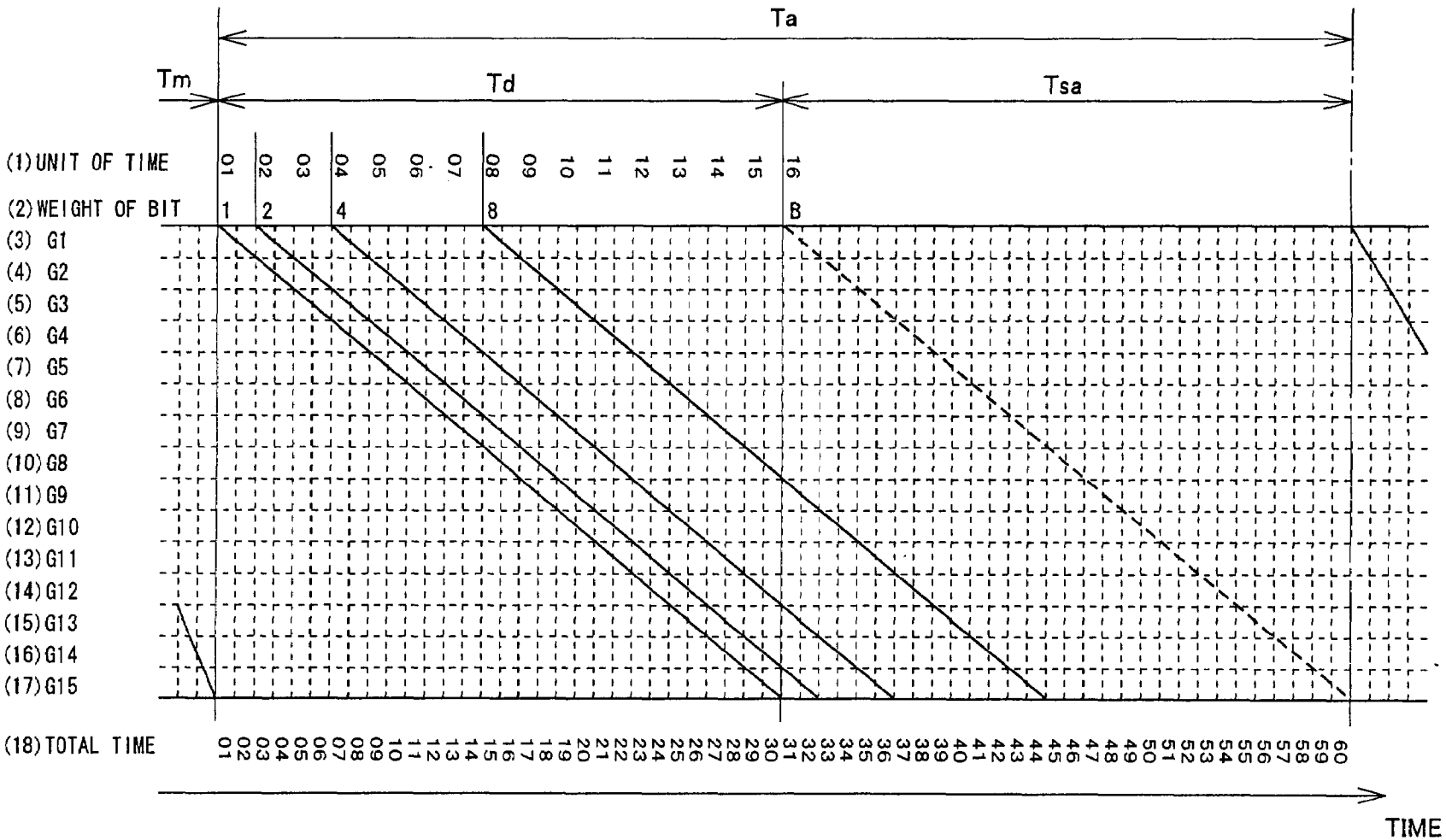
FIG. 12 illustrates a case where an erase period and a current measuring period as in the present invention are adopted in the driving method shown in FIG. 10.
Figure 13:
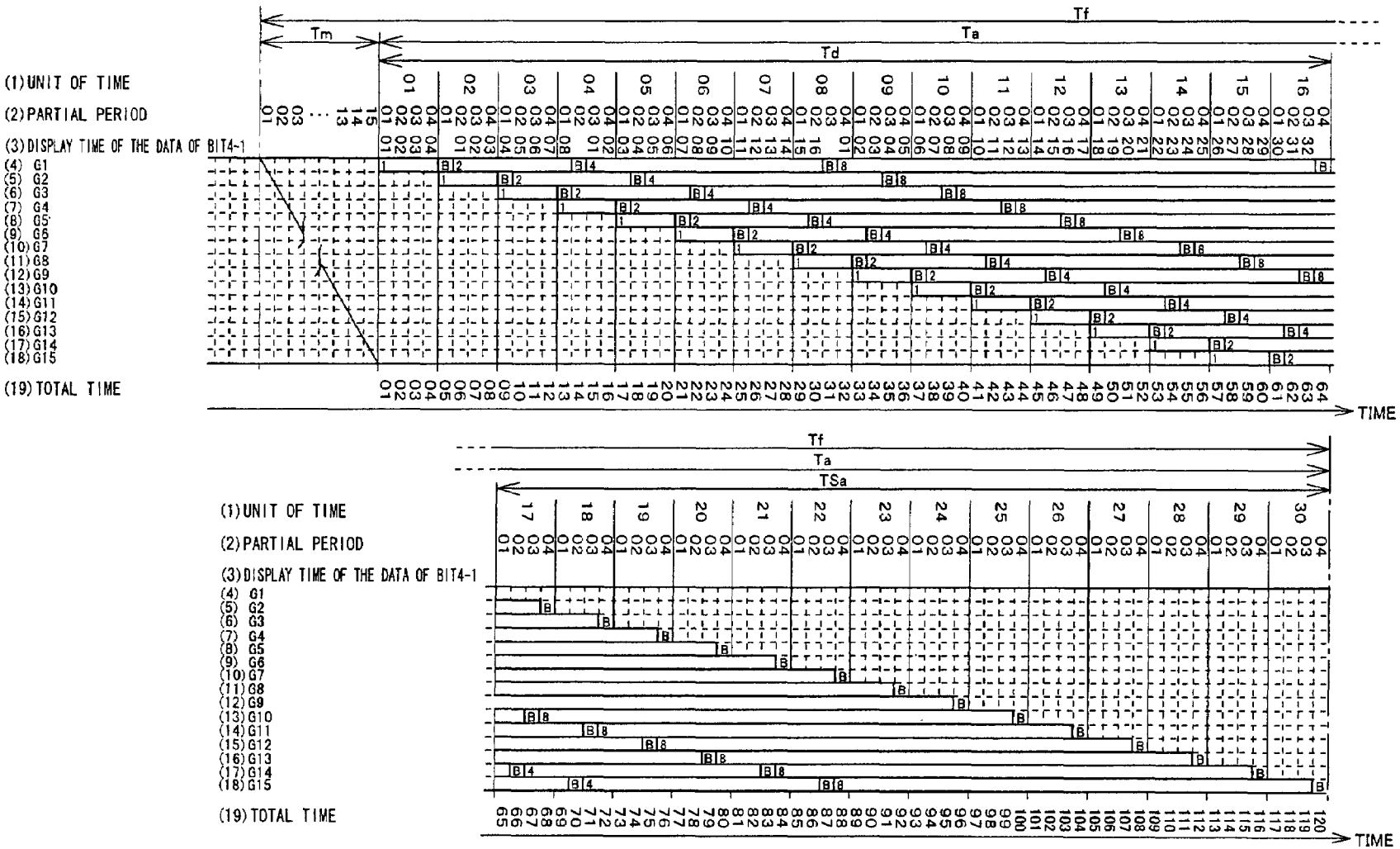
FIG. 13 illustrates a case where an erase period and a current measuring period as in the present invention are adopted in the driving method shown in FIG. 11.

FIGS. 12 and 13 illustrate the erase period Tsa and the current measuring period Tm being incorporated in the prior art. (1) to (17) of FIG. 12 are matched with (1) to (17) of FIG. 10, and (18) of FIG. 12 respectively indicates the total time. FIG. 13 illustrates both of the FIGS. 11 and 12 in detail, wherein (1) to (18) of FIG. 13 are matched with (1) to (18) of FIG. 11 respectively. (19) of FIG. 13 indicates the total time.

Thus, for instance, in device circuits Ab11 to Ab1*n* matched with the scanning signal line G1, as FIG. 12 shows, during the display period Ta, the data of the bit1 is displayed from the first unit of time, the data of the bit2 is displayed from the second unit of time, the data of the bit3 is displayed from the fourth unit of time, the data of bit4 is displayed from the eighth unit of time, and the blank data is displayed from the sixteenth unit of time, after the current measuring period Tm has been finished.

As FIG. 13 illustrates, one unit of time is composed of 4 partial periods, and each partial period corresponds to the writing matched with each different bit. In the first period of the unit of time the data of the bit1 is written in, in the second partial period the data of the bit2 is written in, in the third partial period the data of the bit3 is written in, and in the fourth partial period the data of the bit4 is written in.

That is, for instance, as (4) of FIG. 13 indicates, to the device circuits Ab11 to Ab1*n* which are matched with the scanning signal line G1, the data of the bit1 is written in so as to be displayed in the first partial period of the first unit of time and then the blank data is written in so that the data which has been written in is erased in the first partial period of the second unit of time. Accordingly, the data of the bit2 is written in so as to be displayed in the second partial period of the second unit of time and then the blank data is written in so that the data which has been written in is erased in the second partial period of the fourth unit of time, the data of the bit3 is written in so as to be displayed in the third partial period of the fourth unit of time and then the blank data is written in so that the data which has been written in is erased in the third partial period of the eighth unit of time, and the data of the bit4 is written in so as to be displayed in the fourth partial period of the eighth unit of time, and then the blank data is written in so that the data which has been written in is erased in the fourth partial period of the sixteenth unit of time. Then to device circuits Ab21 to Ab2*n* matched with the next scanning signal lines G2, as (5) of FIG. 13 illustrates, the sets of the data are written in with the delay of one unit of time from the timing in the scanning signal line G1. Hereafter, in each of the subsequent scanning signal lines, the sets of the data are written in with the delay of one unit from the timing in the previous signal lines.

However, in this driving method, although the scanning signal line G1 is supposed to return to the display of the data of the bit1 in the seventeenth unit of time, this cannot be done when the current measuring period Tm and the display period Ta are conducted in an alternating manner. Thus, as FIG. 13 illustrates, to allocate 4+8+16+32=60 partial periods for the lighting, it is necessary to further add 60 partial periods of the erase period Tsa for successively scanning the scanning signal lines G1 to G15 so as to erase the data, and hence 120 partial periods are required as the display period Ta. Moreover, the partial periods actually used for the scanning are only 60 in this display period Ta. When conducting the time-division gradation display by the display apparatus having the current measuring period Tm as in the present invention, it is necessary to adopt a scanning method being different from the conventional ones, to shorten the time not used for the scanning and the lighting in the display period Ta.

Thus, it should be noted that the organic EL display 21 is arranged such that, as illustrated in FIG. 9, each of the device circuits Ab has a plurality of (two in an example in FIG. 9) pixel memories R1 and R2, and as illustrated in FIG. 8, a scanning controller 3*b* reads the data stored in the pixel memories R1 and R2 using corresponding bit selecting lines Sa and Sb so that the data is set in the capacitor C1. The bit selecting lines Sa and Sb are provided on an organic EL panel 2*b*, so as to pass through the device circuits Ab and in parallel with the scanning signal lines G. The device circuits Ab are arranged identical with the device circuits A in FIG. 2 other than the pixel memories R1 and R2, so as to include an n-type TFT Q1 which is a first active device, in which while the TFT Q1 is selected via the scanning signal line G, the data signal is captured from the corresponding data signal line D; a capacitor C1 which is electric potential keeping means keeping the captured data signal; an organic EL device P which is an electro-optical device; and a p-type TFT Q2 for controlling a current, which runs from the power supply line E which is a first power supply line to the organic EL device P, in accordance with the charging voltage of the capacitor C1.

The pixel memories R1 and R2 are arranged so as to be identical with each other, and include: an n-type TFT Q10 which is a second active device, for controlling the writing/reading of the data signal; a CMOS inverter INV1, composed of a p-type TFT Q11 and an n-type TFT Q14, which is a first stage; and a CMOS inverter INV2, composed of a p-type TFT Q13 and an n-type TFT Q14, which is a second stage. The source voltage of the CMOS inverters INV1 and INV2 is set as a voltage between power supply line E and a grounding potential, the output of the CMOS inverter INV1 which is the first stage is supplied to the CMOS inverter INV2 which is the second stage, and the output of the CMOS inverter INV2 which is the second stage is fed back to the CMOS inverter INV1 which is the first stage as the input, so that self-hold operation is done, i.e. the data is sustained. Gates of the pixel memories R1 and R2 are connected to the bit selecting lines Sa and Sb respectively.

The CMOS inverter INV2 which is the second stage has an output impedance higher than the sum of output impedances of the data signal line D, the TFT Q1, and the TFT Q10. Setting the impedances as above makes it possible to correctly supply the electric potential of the data signal line D to the input of the CMOS inverter INV1 which is the first stage, even if the output of the CMOS inverter INV2 which is the second stage is supplied to the CMOS inverter INV1 which is the first stage.

Thus, when the scanning signal line G is selected, the TFT Q1 which is the first active device is brought into conduction so that the data signal is supplied from the data signal line D to the capacitor C1. In this state, when the bit selecting lines Sa and Sb are selected so that the TFT Q10 is brought into conduction, the data signals are supplied from the data signal line D to the pixel memories R1 and R2.

Then when the bit selecting lines Sa and Sb are selected so that the TFT Q10 is brought into conduction in the state that the scanning signal line G is not selected and the TFT Q1 is out of conduction, the data signals are read from the pixel memories R1 and R2 so as to be set in the capacitor C1. Meanwhile, when the scanning signal line G is selected so that the TFT Q1 is brought into conduction in the state that the bit selecting lines Sa and Sb are not selected and the TFT Q10 is out of conduction, the data signals are only set in the capacitor C1 without being written in the pixel memories R1 and R2.

Incidentally, for setting the data signal which is read from the pixel memories R1 and R2 in the capacitor C1, the capacity of the capacitor C1 is preferably reduced to the minimum amount which is enough to control the TFT Q2 for the longest required periods, for preventing the data stored in the pixel memories R1 and R2 being altered by the electric charges stored in the capacitor C1.

Moreover, to arrange display signal levels in the pixel memories R1 and R2 instead of the TFT Q1 and Q10, it is possible to provide a sixth active device between: the input of the CMOS inverter INV2 which is the second stage (=the output of the CMOS inverter INV1 which is the first stage) of each of the pixel memories R1 and R2; and the data signal line D. This makes it possible to arrange the display signal level in the pixel memories R1 and R2 even if the both of the TFT Q1 and Q10 are not selected.

As illustrated in FIG. 8, the organic EL display 21 is arranged so that memories Mb1 to Mbn (collectively termed Mb) are provided where the D/A conversion circuits F1 to Fn are provided in the organic EL display 1 illustrated in FIG. 1. The supplied display data are corrected in the arithmetic circuits B, based on correction values stored in the memories M, the values being measured in each of the device circuits Ab. The data calculated as such, which is supposed to be displayed in each of the device circuit Ab, are stored in the memories Mb.

Incidentally, albeit not particularly related to the above-identified scanning method, in a signal controller 4*b*, a current measuring circuit K0 is provided so as to be commonly shared by the power supply lines E1 to En, and the current measuring circuit K0 conducts a multiplex operation with respect to the power supply lines E1 to En, and the load currents are successively measured so as to be supplied to the according memories M1 to Mn. In this manner, it is possible to eliminate the variations of the measurement by adopting the common current measuring circuit K0.

However, when the current measuring circuits K1 to Kn are provided in each of the power supply lines E1 to En respectively as described above, it is possible to conduct the measurement with respect to all device circuits Ab11 to Abmn within a single current measuring period Tm. Thus the multiplex operation may be arranged such that responding to the selective output to the scanning signal lines G, all device circuits Abi1 to Abin (i represents an arbitrary line) in a single line are measured within a single scanning period in which each of the scanning signal lines are selected, that is, being identical with the examples illustrated in FIGS. 4 and 7, all device circuits Ab11 to Abmn may be measured within a single current measuring period Tm. Also, one or more device circuit per line, for instance, 3 device circuits matched with R, G, and B respectively may be measured within a single scanning period, since the number of the devices to be measured per line can be arranged in accordance with a desired periodicity of the measurement. However, it should be noted that to prevent the current measuring period Tm becoming long, it is preferable to measure 3 device circuits matched with R, G, and B respectively rather than all device circuits Ab11 to Abmn, within a single current measuring period.

Incidentally, the current measuring circuits K1 to Kn may be adopted in the organic El display 21 characterized by the scanning method as follows, and of course the current measuring circuit K0 can be adopted in the above-mentioned organic EL displays 1 and 11.

Figure 14:
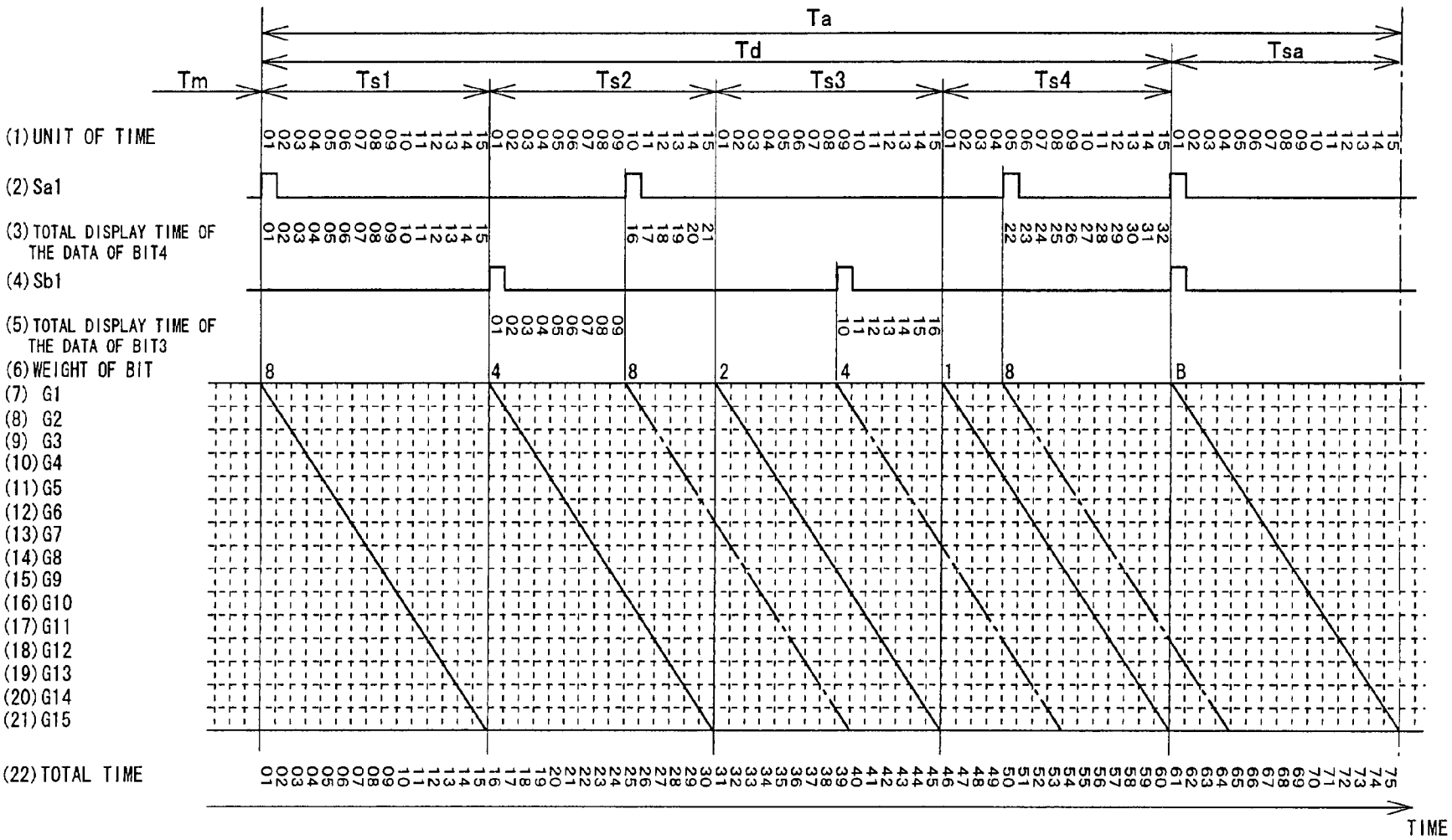
FIG. 14 illustrates an example of the driving method of the organic EL display shown in FIG. 8.

FIG. 14 illustrates an example of the driving method in the time-division gradation using the organic EL display 21. FIG. 14 illustrates the display period Ta after the current measuring period Tm is finished. Also in this example, 15 scanning signal lines of the organic EL panel 2*b* from G1 to G15 are set as one group, and (7) to (21) of FIG. 14 show which scanning signal line is selected from the lines G1 to G15. (1) of FIG. 14 shows a unit of time, and (22) of FIG. 14 indicates a total time (number of the unit of time). (3) of FIG. 14 shows a total display time of the data of the bit4, whereas (5) of FIG. 14 indicates a total display time of the data of the bit3. (6) of FIG. 14 indicates the weight of bits.

Important points in this example are: (i) selective scanning of a bit selecting line Sa1 (this should be described as Sa1 to Sa15 which are matched with the scanning signal lines G1 to G15. However, only Sa1 is described here for simplicity. A bit selecting line Sb is also simplified in an analogous manner) indicated as (2) of FIG. 14; and (ii) selective scanning of a bit selecting line Sb1 indicated as (4) of FIG. 14. The bit selecting lines Sa and Sb are basically not selected unless otherwise specified, and in (2) and (4) of FIG. 14, a HIGH signal indicates the state being selected. In the pixel memories R1 and R2, the data of the bit4 and the data of the bit3 are stored respectively. Each of the scanning periods Ts1 to Ts4 is composed of 15 units of time.

In the first scanning period Ts1 in the display period Ta, the scanning signal lines G1 to G15 are successively selected so that the data of the bit4 is displayed, at the same time the data of the bit4 is written in the pixel memory R1. Until the selection of the scanning signal lines G1 to G15 is finished, i.e. for 15 units of time, the data of the bit4 has been displayed.

After the scanning period Ts1 is finished, the scanning period Ts2 immediately follows the same and while the data to be displayed is switched from the data matched with the bit4 to the data matched with the bit3, the bit selecting line Sb is selected so that the data of the bit3 is written in the pixel memory R2. Then after displaying the data of the bit3 in this scanning period Ts2 for 9 units of time, following the selection of the bit selecting line Sb, the bit selecting line Sa is selected while the scanning signal lines G1 to G15 are in the state of non-selection, and the data of the bit4 is read from the pixel memory R1 so as to be displayed for remaining 6 units of time. Thus the total display time of the data of the bit4 is 21 units of time.

After the scanning period Ts2 as above is finished, in the scanning period Ts3, the data to be displayed is switched from the data matched with the bit4 to the data matched with the bit2 so as to be displayed for 8 units of time, and then following the selection of the bit selecting line Sa, the bit selecting line Sb is selected while the scanning signal lines G1 to G15 are in the state of non-selection, and the data of the bit3 is read from the pixel memory R2 so as to be displayed for remaining 7 units of time. Thus the total display time of the data of the bit3 is 16 units of time.

In the scanning period Ts4, the data to be displayed is switched from the data matched with the bit3 to the data matched with the bit1 so as to be displayed for 4 units of time, and then the bit selecting line Sa is selected and the data of the bit4 is read from the pixel memory R1 again, so that the data which has been read is displayed for remaining 11 units of time. On this account, the total display time of the data of the bit4 is 32 units of time and thus the proportion of the displaying periods between the bits is exactly 1:2:4:8.

Incidentally, taking the scanning signal line G1 shown in FIG. 14 for example, at the start of each of the scanning periods Ts1 to Ts4, i.e. at the total times of 01, 16, 31, and 46, a display signal level setting step is provided. In the display signal level setting step, a display signal level is set in the capacitor C1 via the TFT1 while the scanning signal line G1 is selected, and at the same time the TFT Q10 is selectively driven so that the display signal level is set in the pixel memories R1 and R2.

Also taking the scanning signal line G1 for example, at the total times of 25, 39, and 50, a display signal switching step is provided. In the display signal switching step, the TFT Q10 is selectively driven while the scanning signal line G1 is not selected so that a display signal level of the organic EL device P is switched to the display signal level corresponding to the pixel memories R1 and R2.

After the scanning period Ts4 is finished, the erase period Tsa immediately follows the same so that the data to be displayed is switched from the data matched with the bit4 read out from the pixel memory R1 to the data matched with the state of non-luminosity, and the data which has been switched is stored in the capacitors C1 and a blank display is carried out. Temporarily erasing load currents running through all circuit devices Ab by the selection in the erase period Tsa makes it possible to conduct the measurement in the following current measuring period Tm. In the erase period Tsa, as FIG. 14 indicates, the data in the pixel memories R1 and R2 may be deleted along with the data in the capacitor C1.

In the above-identified scanning, the display period Ta which is necessary for the time-division gradation display for 4 bits is: 15 (a single scanning period)×(4 bits+1 blank) =75 units of time, wherein the units actually used for the lighting is: 4+8+16+32=60 units of time.

In this manner, using the pixel memories R1 and R2 and selecting the bit selecting lines Sa and Sb while the scanning signal line G is not selected, it is possible to read the data of higher bits at an arbitrary timing and display the same. On this account, after the display of the data of the lower bits, the remaining time in the scanning period Ts of the lower bits can be used for the display of the data of the higher bits, and thus it is possible to realize a new method of the time-division gradation display which enables to shorten the time in the display period Ta, which is the time being used neither for the scanning nor the lighting, even if a plurality of the bits has the scanning period with the same interval.

Incidentally, when most of the display period Ta is used for the lighting as in the case above, it is not possible to compensate for the loss of the brightness of the display over the time by shortening the non-display time. Thus in accordance with the change of the current characteristics of one organic EL device P, the current values of the other organic EL devices matched with the remaining colors are preferably regulated to adjust the balance of R, G, and B.

Figure 15:
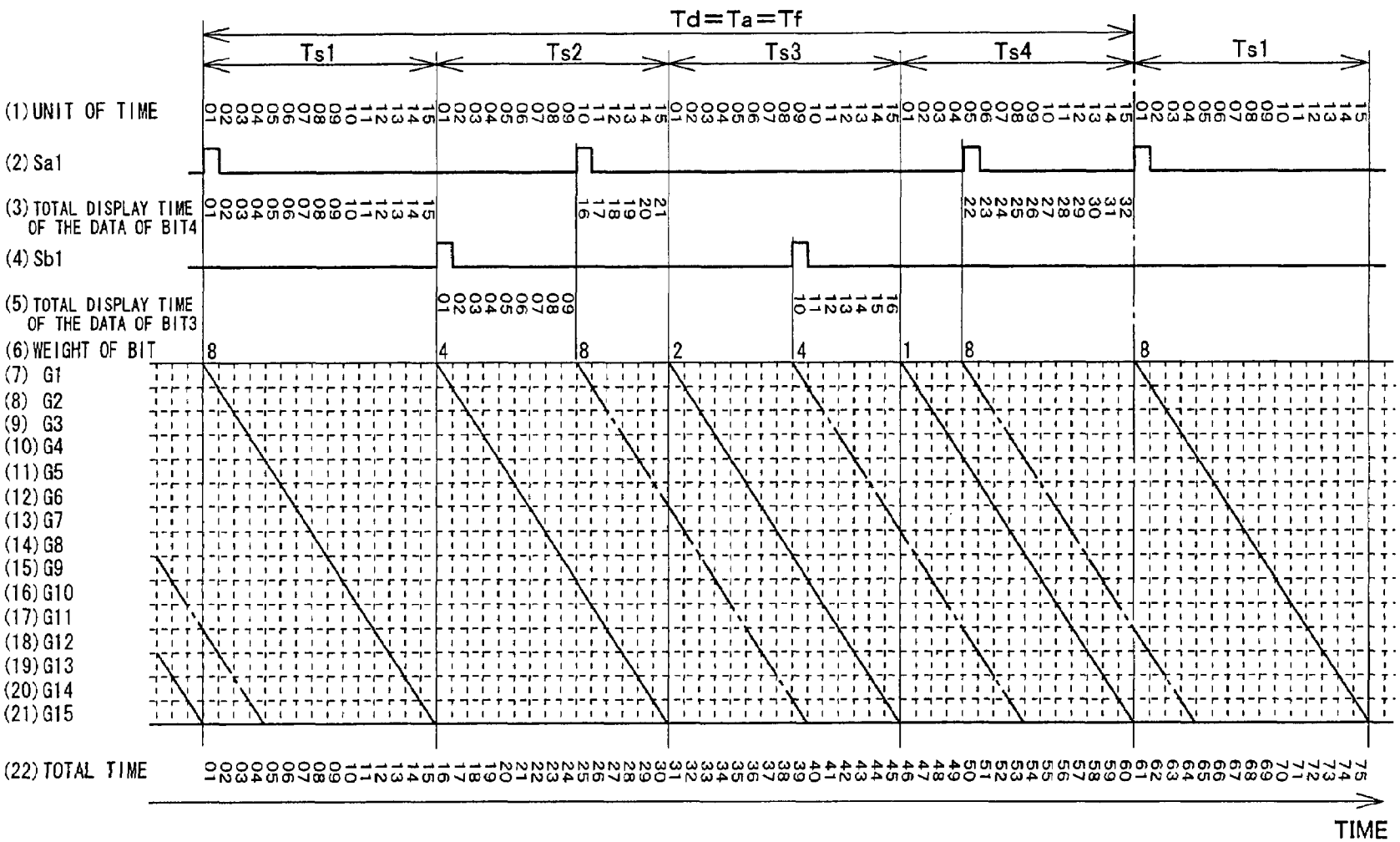
FIG. 15 illustrates a case where the driving method of FIG. 14 is with neither an erase period nor a current measuring period being specified.

The above-mentioned driving method is effective to shorten the periods of non-scanning and non-luminosity in the display period Ta so as to be also applicable to the above-mentioned arrangement in which the current measurement is not conducted. So a driving method in an arrangement without the current measuring period Tm is illustrated in FIG. 15. (1) to (22) of FIG. 15 are matched with (1) to (22) of FIG. 14 respectively. It is noted that in this arrangement, the erase period Tsa does not exist so that the luminous period Td is identical with the display period Ta and the frame period Tf.

Compared to the above-identified method of the time-division gradation display disclosed in Japanese Laid-Open Patent Publication No. 63-226178/1988, the present arrangement can obtain at least equal scanning and lighting effectiveness because the non-scanning and non-luminous periods in the display period Ta are shortened. Moreover, it is possible to exactly match the display period of each bit with the weight of each bit, and the control of the operation becomes easier since the scanning is successively done on line-by-line basis.

In the present driving method, the number of the scanning signal lines G is set as 15, for meeting an equation as follows:

The Time Used for the Lighting=The Scanning Time Necessary for the Time-Division Gradation Display (1)

Conditions meeting this equation 1 in the case of the gradation display for 4 bits is illustrated in table. 1.

TABLE 1

| a | b | c | d | e | f | g | h | | | |
|---|---|---|---|---|---|---|---|---|---|---|
| 4 | 4 | 16 | 1 | 15 | ▲ | 16 | ○ | X | X | X |
| 4 | 4 | 16 | 2 | 30 | Δ | 9 | ○ | ○ | X | X |
| 4 | 5 | 20 | 2 | 30 | Δ | 11 | ○ | ○ | X | X |
| 4 | 6 | 24 | 2 | 30 | Δ | 13 | ○ | ○ | X | X |
| 4 | 6 | 24 | 3 | 45 | Δ | 9 | ○ | ○ | X | X |
| 4 | 7 | 28 | 2 | 30 | Δ | 15 | ○ | ○ | X | X |
| 4 | 7 | 28 | 3 | 45 | Δ | 10.333 | ○ | ○ | X | X |
| 4 | 8 | 32 | 2 | 30 | ▲ | 16 | ○ | X | X | X |
| 4 | 8 | 32 | 3 | 45 | Δ | 11.667 | ○ | ○ | X | X |
| 4 | 8 | 32 | 4 | 60 | Δ | 9 | ○ | ○ | X | X |
| 4 | 9 | 36 | 2 | 30 | ▲ | 16 | ○ | X | X | X |
| 4 | 9 | 36 | 3 | 45 | Δ | 13 | ○ | ○ | X | X |
| 4 | 9 | 36 | 4 | 60 | Δ | 10 | ○ | ○ | X | X |
| 4 | 10 | 40 | 3 | 45 | Δ | 14.333 | ○ | ○ | X | X |
| 4 | 10 | 40 | 4 | 60 | Δ | 11 | ○ | ○ | X | X |
| 4 | 10 | 40 | 5 | 75 | Δ | 9 | ○ | ○ | X | X |
| 4 | 11 | 44 | 3 | 45 | Δ | 15.667 | ○ | ○ | X | X |
| 4 | 11 | 44 | 4 | 60 | Δ | 12 | ○ | ○ | X | X |
| 4 | 11 | 44 | 5 | 75 | Δ | 9.8 | ○ | ○ | X | X |
| 4 | 12 | 48 | 3 | 45 | ▲ | 16 | ○ | X | X | X |
| 4 | 12 | 48 | 4 | 60 | Δ | 13 | ○ | ○ | X | X |
| 4 | 12 | 48 | 5 | 75 | Δ | 10.6 | ○ | ○ | X | X |
| 4 | 12 | 48 | 6 | 90 | Δ | 9 | ○ | ○ | X | X |
| 4 | 13 | 52 | 3 | 45 | ▲ | 16 | ○ | X | X | X |
| 4 | 13 | 52 | 4 | 60 | Δ | 14 | ○ | ○ | X | X |
| 4 | 13 | 52 | 5 | 75 | Δ | 11.4 | ○ | ○ | X | X |
| 4 | 13 | 52 | 6 | 90 | Δ | 9.6667 | ○ | ○ | X | X |
| 4 | 14 | 56 | 3 | 45 | ▲ | 16 | ○ | X | X | X |
| 4 | 14 | 56 | 4 | 60 | Δ | 15 | ○ | ○ | X | X |
| 4 | 14 | 56 | 5 | 75 | Δ | 12.2 | ○ | ○ | X | X |
| 4 | 14 | 56 | 6 | 90 | Δ | 10.333 | ○ | ○ | X | X |
| 4 | 14 | 56 | 7 | 105 | Δ | 9 | ○ | ○ | X | X |
| 4 | 15 | 60 | 4 | 60 | ○ | 16 | ○ | ○ | X | X |
| 4 | 15 | 60 | 5 | 75 | Δ | 13 | ○ | ○ | X | X |
| 4 | 15 | 60 | 6 | 90 | Δ | 11 | ○ | ○ | X | X |
| 4 | 15 | 60 | 7 | 105 | Δ | 9.5714 | ○ | ○ | X | X |

In table. 1, (a) is the number of bits, (b) is the number of scanning signal lines, (c) is: the number of scanning signal lines×the number of bits=the scanning time necessary for the time-division gradation display, (d) is a display period per single gradation, and (e) is a gradation display period used for the lighting. (f) is the result of a judgment, so that "▲" indicates that the gradation display cannot be done in the present arrangement as: the number of scanning signal lines×the number of bits>the time-division gradation display, "Δ" indicates that the gradation display for 4 bits can be done provided that the scanning is conducted in a disperse manner, and "○" indicates that the equation 1 is met so that the gradation display can be done.

(g) describes the number of displayable gradation with the continuous scanning when indicated as "Δ" in (f) so that the gradation display can be done yet the number of displayable gradations is limited unless the scanning is conducted in a disperse manner. Moreover, (h) is the number of required devices, and the number of "○" indicates the number of the sets of the electric potential keeping means being required. Incidentally, table. 1 only shows the cases when the number of required memories is not more than two.

In the meantime, table. 2 indicates the results of the judgment of feasibility in the case of the gradation display for 2 bits, and (a) to (h) in the table are matched with the same in table. 1 respectively.

TABLE 2

| a | b | c | d | e | f | g | h | | | |
|---|---|---|---|---|---|---|---|---|---|---|
| 2 | 1 | 2 | 1 | 3 | Δ | 3 | ○ | X | X | X |
| 2 | 2 | 4 | 1 | 3 | ▲ | 4 | X | X | X | X |

TABLE 2-continued

| a | b | c | d | e | f | g | h | | | |
|---|---|---|---|---|---|---|---|---|---|---|
| 2 | 2 | 4 | 2 | 6 | Δ | 3 | ○ | X | X | X |
| 2 | 3 | 6 | 2 | 6 | ○ | 4 | ○ | X | X | X |
| 2 | 3 | 6 | 3 | 9 | Δ | 3 | ○ | X | X | X |
| 2 | 4 | 8 | 2 | 6 | ▲ | 4 | X | X | X | X |
| 2 | 4 | 8 | 3 | 9 | Δ | 3.6667 | ○ | X | X | X |
| 2 | 4 | 8 | 4 | 12 | Δ | 3 | ○ | X | X | X |
| 2 | 5 | 10 | 2 | 6 | X | 4 | X | X | X | X |
| 2 | 5 | 10 | 3 | 9 | ▲ | 4 | ○ | X | X | X |
| 2 | 5 | 10 | 4 | 12 | Δ | 3.5 | ○ | X | X | X |
| 2 | 5 | 10 | 5 | 15 | Δ | 3 | ○ | X | X | X |
| 2 | 6 | 12 | 3 | 9 | ▲ | 4 | X | X | X | X |
| 2 | 6 | 12 | 4 | 12 | ○ | 4 | ○ | X | X | X |
| 2 | 6 | 12 | 5 | 15 | Δ | 3.4 | ○ | X | X | X |
| 2 | 6 | 12 | 6 | 18 | Δ | 3 | ○ | X | X | X |

This table. 2 clarifies that the equation 1 is met when the number of the scanning signal lines is multiples of 3. Incidentally, table. 2 only shows the cases when only one memory is required.

Moreover, table. 3 indicates the results of the judgement of feasibility in the case of the gradation display for 3 bits, and (a) to (h) in the table are matched with the same respectively in tables. 1 and 2.

TABLE 3

| a | b | c | d | e | f | g | h | | | |
|---|---|---|---|---|---|---|---|---|---|---|
| 3 | 2 | 6 | 1 | 7 | Δ | 7 | ○ | X | X | X |
| 3 | 3 | 9 | 1 | 7 | ▲ | 8 | ○ | X | X | X |
| 3 | 4 | 12 | 2 | 14 | Δ | 7 | ○ | X | X | X |
| 3 | 5 | 15 | 2 | 14 | ▲ | 8 | ○ | X | X | X |
| 3 | 6 | 18 | 2 | 14 | ▲ | 8 | ○ | X | X | X |
| 3 | 6 | 18 | 3 | 21 | Δ | 7 | ○ | X | X | X |
| 3 | 7 | 21 | 3 | 21 | ○ | 8 | ○ | X | X | X |
| 3 | 8 | 24 | 3 | 21 | ▲ | 8 | ○ | X | X | X |
| 3 | 8 | 24 | 4 | 28 | Δ | 7 | ○ | X | X | X |
| 3 | 9 | 27 | 3 | 21 | ▲ | 8 | ○ | X | X | X |
| 3 | 9 | 27 | 4 | 28 | Δ | 7.75 | ○ | X | X | X |
| 3 | 10 | 30 | 3 | 21 | X | 8 | ○ | X | X | X |
| 3 | 10 | 30 | 4 | 28 | ▲ | 8 | ○ | X | X | X |
| 3 | 10 | 30 | 5 | 35 | Δ | 7 | ○ | X | X | X |
| 3 | 11 | 33 | 4 | 28 | ▲ | 8 | ○ | X | X | X |
| 3 | 11 | 33 | 5 | 35 | Δ | 7.6 | ○ | X | X | X |
| 3 | 12 | 36 | 4 | 28 | ▲ | 8 | ○ | X | X | X |
| 3 | 12 | 36 | 5 | 35 | ▲ | 8 | ○ | X | X | X |
| 3 | 12 | 36 | 6 | 42 | Δ | 7 | ○ | X | X | X |
| 3 | 13 | 39 | 4 | 28 | X | 8 | ○ | X | X | X |
| 3 | 13 | 39 | 5 | 35 | ▲ | 8 | ○ | X | X | X |
| 3 | 13 | 39 | 6 | 42 | Δ | 7.5 | ○ | X | X | X |
| 3 | 14 | 42 | 5 | 35 | ▲ | 8 | ○ | X | X | X |
| 3 | 14 | 42 | 6 | 42 | ○ | 8 | ○ | X | X | X |
| 3 | 14 | 42 | 7 | 49 | Δ | 7 | ○ | X | X | X |

According to table. 3, it is understood that the equation (1) is met when the number of the scanning signal lines is multiples of 7. By the way, FIG. 3 only shows a case that the number of the required memory is 1.

In this manner, the present embodiment is arranged so that the display apparatus is further provided with: the at least one pixel memory which corresponds to each of the electric potential keeping means and keeps the signal level captured by the first active device; and the second active device which corresponds to the at least one pixel memory and is selectively driven by the bit selecting line, wherein, the display signal level is set in the electric potential keeping means via the first active device while the bit selecting line is selected, and the second active device is selectively driven so that the display signal level is set in the at least one pixel memory, and while the first signal line is not selected, the second active device is selectively driven so that displaying is switched to the display signal level from the pixel memory.

On this account, displaying is carried out by dint of the scanning of the first signal line, and by selecting the bit selecting line, the display signal level can be written in the pixel memory corresponding to the above-identified bit selecting line. Then by selecting the bit selecting line while the first signal line is not selected, the display signal level can be read out from the pixel memory.

Thus, a novel time-division gradation display can be realized so that in one scanning period in which the scanning signal lines are successively scanned, it is possible to use the time, which is remained after displaying the data of the lower bits, for displaying the data of the higher bits, and even if a plurality of the bits has the scanning period with the same interval, a non-scanning period and non-luminous period in the display period can be shortened.

The following description will discuss a fourth embodiment in accordance with the present invention in reference to FIGS. 16 to 20.

Figure 16:
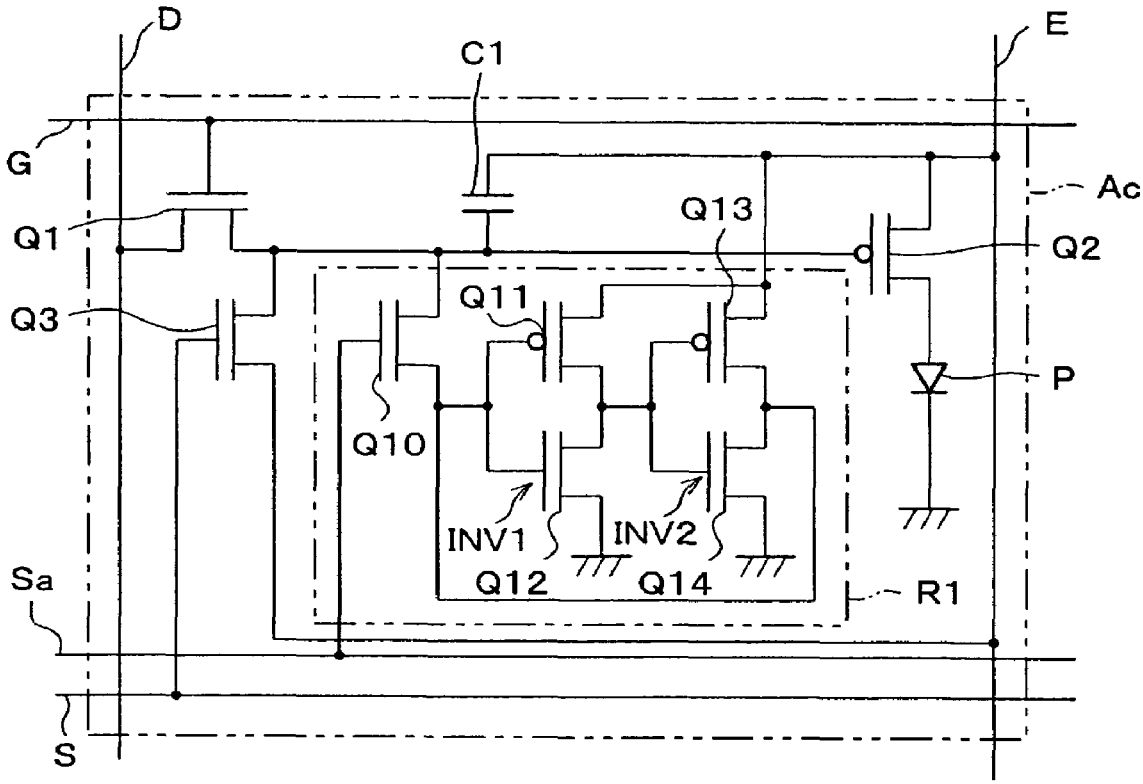
FIG. 16 is an electrical circuit diagram of a device circuit in an organic EL display in accordance with a fourth embodiment of the present invention.

FIG. 16 is an electrical circuit diagram of a device circuit Ac in an organic EL display in accordance with the fourth embodiment of the present invention. This device circuit Ac is similar to the above-mentioned device circuits Aa and Ab illustrated in FIGS. 6 and 9 respectively, and hence members having the same functions as those described are given the same numbers so that the descriptions are omitted. The important point of this embodiment is such that the device circuit Ac includes: a single pixel memory R1; and a TFT Q3 which is a third active device, for erasing stored data by connecting the capacitor C1 (and the pixel memory R1) to an initializing electric potential. Moreover, the scanning signal line S is further provided in parallel with the scanning signal line G, for driving the TFT Q3.

Figure 17:
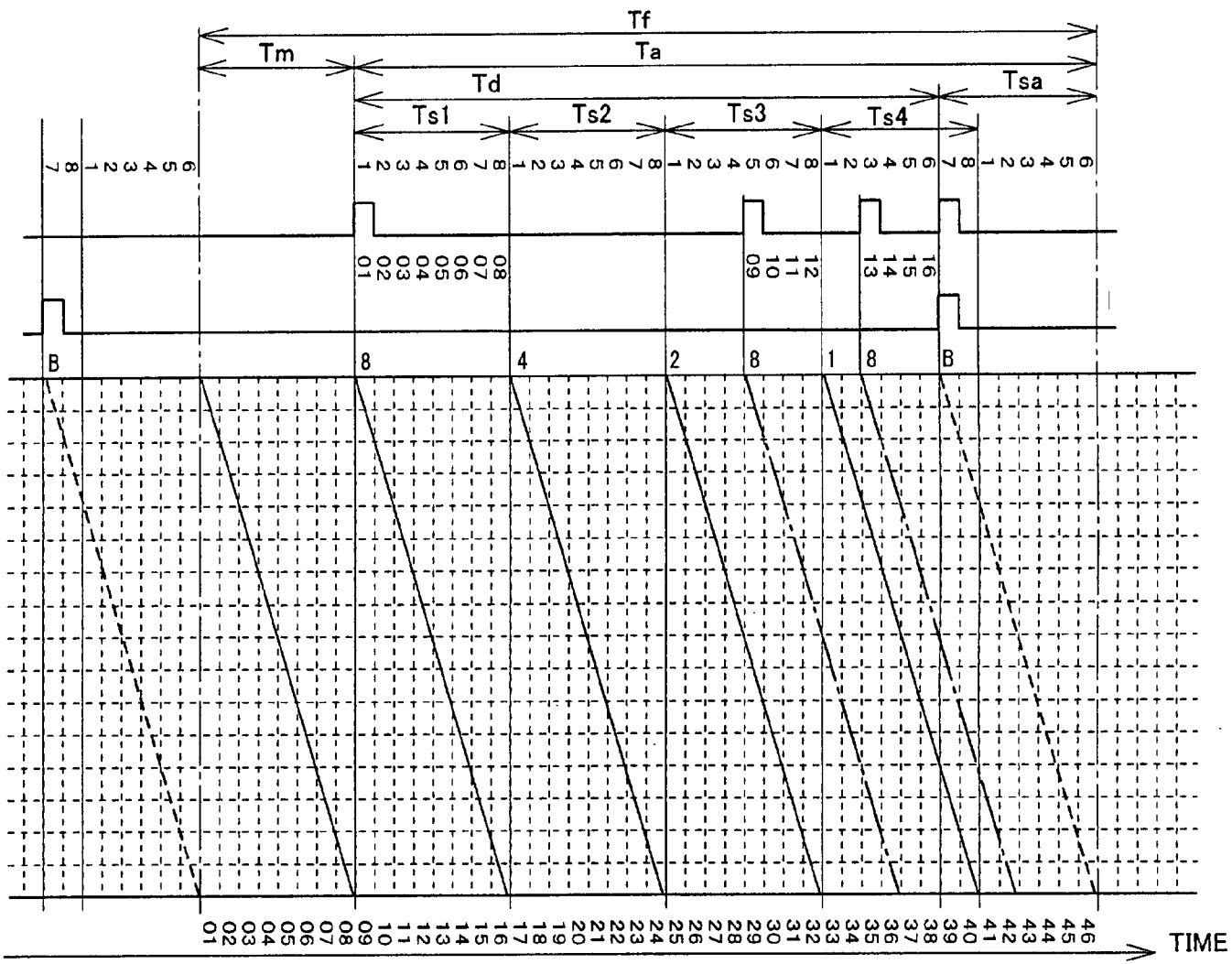
FIG. 17 illustrates an example of the driving method of the organic EL display using the device circuit which is shown in FIG. 16.

A driving method using the device circuit Ac is illustrated in FIG. 17. (1) of FIG. 17 indicates a partial period which is ⅛ of the scanning period Ts, (3) of FIG. 17 indicates a total display time of the data of the bit4, (5) of FIG. 17 signifies the weight of bits, (22) of FIG. 17 shows a total display time, (2) of FIG. 17 indicates the selective scanning of the bit selecting line Sa1, and (4) of FIG. 17 signifies the selective scanning of the scanning signal line S1. Being different from the examples above, 16 scanning signal lines from G1 to G16 are set as one group, and (6) to (21) of FIG. 17 show which scanning signal line is selected from the lines G1 to G16. The description of the current measuring period Tm is omitted and only the following display period Ta following the period Tm will be described here.

While displaying the data of the bit4 in the first scanning period Ts1 of the display period Ta, the data is stored in the pixel memory R1 via the TFT Q10. After the selection of the scanning signal lines G1 to G16 is finished, the following scanning period Ts2 immediately starts and the data to be displayed is switched from the data matched with the bit4 to the data matched with the bit3. In this process, it is possible to set the scanning period Ts to be longer than the display period matched with the data of the bit3, and conduct the scanning to switch the data to be displayed to the data of the bit4 after the display period matched with the data of the bit 3 is finished. However, in the example illustrated in FIG. 17, the scanning period Ts is identical with the data display period in accordance with the bit3, and hence the scanning above is not conducted.

When the scanning of the scanning signal lines G1 to G16, which is for displaying the data matched with the bit3, is finished, the scanning period Ts3 immediately follows the operation above and the data to be displayed is switched to the data matched with the bit2. Following this scanning operation, the selective scanning of the bit selecting line Sa is started after 4 partial periods so that data is read from the pixel memory R1 via the TFT Q10 and the data matched with the bit4 is displayed again. When the scanning of the scanning signal lines G1 to G16, for keeping the data matched with the bit2 in the capacitor C1, is finished, the following scanning period Ts4 immediately starts and the data to be displayed is switched to the data matched with the bit1. Following this scanning, data is read from the pixel memory R1 and the data matched with the bit4 is displayed again, after two partial periods. Until this final display in accordance with the data of the bit4, the display has continued for 8+4=12 partial periods, so that following the last scanning, the scanning signal line S is subjected to the selective scanning after 4 partial periods and the data of the capacitor C1 is erased, and a blank display is carried out to prepare for the next current measuring period Tm. In this process, as FIG. 17 indicates, the bit selecting line Sa may also be subjected to the selective scanning so that the data of the pixel memory R1 is deleted.

In this manner, in the device circuit Ac, if there is remaining time after the display of the data matched with the bit4 (i.e. all data displaying) in the last scanning period Ts4 is finished, the remaining time can be used for scanning which is independent from the scanning signal lines G1 to G16 and the bit selecting line Sa. Thus while in the above-identified embodiments, the troubles such as an additional scanning period is required and the number of displayable gradations is decreased may occur when the time used for the lighting for n bit(s) is not equal to the time necessary for the scanning for n bit(s), in the present embodiment, the erase scanning is conducted by the selective scanning of the scanning signal line S so that the troubles above can be avoided.

Incidentally, the number of the scanning signal lines in FIG. 17, which is 16, is determined as the number of the scanning signal lines meeting the following equations (2) to (4).

The Number of the Scanning Signal Lines≧The Display Period of the Bit3 (2)

The Time Used for the Lighting≧The Number of the Scanning Signal Lines×(4 Bits−1)+The Display Period of the Bit1 (3)

The Scanning Time Necessary for the Time-Division Gradation Display≧The Time Used for the Lighting (4)

Conditions meeting the equations (2) to (4) with respect to the gradation display for 4 bits are illustrated in table. 4.

TABLE 4

| a | b | c | d | e | f | g | h |
|---|---|---|---|---|---|---|---|
| 4 | 4 | 16 | 1 | 4 | 13 | 15 | ○ |
| 4 | 5 | 20 | 1 | 4 | 16 | 15 | ▲ |
| 4 | 6 | 24 | 1 | 3 | 19 | 15 | ▲ |
| 4 | 7 | 28 | 1 | 4 | 22 | 15 | ▲ |
| 4 | 8 | 32 | 1 | 4 | 25 | 15 | ▲ |
| 4 | 8 | 32 | 2 | 8 | 26 | 30 | ○ |
| 4 | 8 | 32 | 3 | 3 | 27 | 45 | Δ |
| 4 | 9 | 36 | 1 | 4 | 28 | 15 | ▲ |
| 4 | 9 | 36 | 2 | 8 | 29 | 30 | ○ |
| 4 | 10 | 40 | 1 | 4 | 31 | 15 | ▲ |
| 4 | 10 | 40 | 2 | 8 | 32 | 30 | ▲ |
| 4 | 11 | 44 | 1 | 4 | 34 | 15 | ▲ |
| 4 | 11 | 44 | 2 | 8 | 35 | 30 | ▲ |
| 4 | 12 | 48 | 1 | 4 | 37 | 15 | ▲ |

TABLE 4-continued

| a | b | c | d | e | f | g | h |
|---|---|---|---|---|---|---|---|
| 4 | 12 | 48 | 2 | 8 | 38 | 30 | ▲ |
| 4 | 12 | 48 | 3 | 12 | 39 | 45 | ○ |
| 4 | 13 | 52 | 1 | 4 | 40 | 15 | ▲ |
| 4 | 13 | 52 | 2 | 8 | 41 | 30 | ▲ |
| 4 | 13 | 52 | 3 | 12 | 42 | 45 | ○ |
| 4 | 14 | 56 | 1 | 4 | 43 | 15 | ▲ |
| 4 | 14 | 56 | 2 | 8 | 44 | 30 | ▲ |
| 4 | 14 | 56 | 3 | 12 | 45 | 45 | ○ |
| 4 | 15 | 60 | 1 | 4 | 46 | 15 | ▲ |
| 4 | 15 | 60 | 2 | 8 | 47 | 30 | ▲ |
| 4 | 15 | 60 | 3 | 12 | 48 | 45 | ▲ |
| 4 | 16 | 64 | 1 | 4 | 49 | 15 | ▲ |
| 4 | 16 | 64 | 2 | 8 | 50 | 30 | ▲ |
| 4 | 16 | 64 | 3 | 12 | 51 | 45 | ▲ |
| 4 | 16 | 64 | 4 | 16 | 52 | 60 | ○ |

In table. 4, (a) is the number of bits, (b) is the number of scanning signal lines, (c) is: the number of scanning signal lines×the number of bits=the scanning time necessary for the time-division gradation display, (d) is a display period per single gradation, (e) is the display period of the bit3, (f) is: the number of scanning signal lines×(4 bits−1)+the display period of the bit1, and (g) is the gradation display period used for the lighting. (h) is the result of a judgment, so that "▲" indicates that the gradation display for 4 bits can be done but the lighting is disperse, "Δ" indicates that the gradation display for 4 bits can be done with the continuous lighting, and "○" indicates that the equations (2) to (4) are met.

Table. 4 clearly shows that the equations (2) to (4) are met when the number of the scanning signal lines is 4, 8, 9, 12, 13, 14, or 16 (following numbers are omitted). The arrangement illustrated in FIG. 17 has 16 scanning signal lines G1 to G16, in which the gradation display for 4 bits is conducted and the display scanning is continuously done as the solid line indicates, so as to be matched with the result of this table. 4.

Meanwhile, table. 5 describes the results of the judgment of feasibility in the case of the gradation display for 2 bits, and (a) to (h) in the table are matched with the same in table. 4 respectively.

TABLE 5

| a | b | c | d | e | f | g | h |
|---|---|---|---|---|---|---|---|
| 2 | 1 | 2 | 1 | 1 | 2 | 3 | Δ |
| 2 | 2 | 4 | 1 | 1 | 3 | 3 | ○ |
| 2 | 2 | 4 | 2 | 2 | 4 | 6 | Δ |
| 2 | 3 | 6 | 1 | 1 | 4 | 3 | ▲ |
| 2 | 3 | 6 | 2 | 2 | 5 | 6 | ○ |
| 2 | 3 | 6 | 3 | 3 | 6 | 9 | Δ |
| 2 | 4 | 8 | 1 | 1 | 5 | 3 | ▲ |
| 2 | 4 | 8 | 2 | 2 | 6 | 6 | ○ |
| 2 | 4 | 8 | 3 | 3 | 7 | 9 | Δ |
| 2 | 4 | 8 | 4 | 4 | 8 | 12 | Δ |
| 2 | 5 | 10 | 1 | 1 | 6 | 3 | ▲ |
| 2 | 5 | 10 | 2 | 2 | 7 | 6 | ▲ |
| 2 | 5 | 10 | 3 | 3 | 8 | 9 | ○ |
| 2 | 5 | 10 | 4 | 4 | 9 | 12 | Δ |
| 2 | 5 | 10 | 5 | 5 | 10 | 15 | Δ |
| 2 | 6 | 12 | 1 | 1 | 7 | 3 | ▲ |
| 2 | 6 | 12 | 2 | 2 | 8 | 6 | ▲ |
| 2 | 6 | 12 | 3 | 3 | 9 | 9 | ○ |
| 2 | 6 | 12 | 4 | 4 | 10 | 12 | ○ |
| 2 | 6 | 12 | 5 | 5 | 11 | 15 | Δ |
| 2 | 6 | 12 | 6 | 6 | 12 | 18 | Δ |

Table. 5 clearly shows that the equations (2) to (4) are met when the number of the scanning signal lines is 2, 3, 4, 5, or 6 (following numbers are omitted).

Moreover, table. 6 describes the results of the judgment of feasibility in the case of the gradation display for 3 bits, and (a) to (h) in the table are matched with the same in tables. 4 and 5 respectively.

TABLE 6

| a | b | c | d | e | f | g | h |
|---|---|---|---|---|---|---|---|
| 3 | 2 | 6 | 1 | 2 | 5 | 7 | Δ |
| 3 | 3 | 9 | 1 | 2 | 7 | 7 | ○ |
| 3 | 3 | 9 | 2 | 3 | 8 | 14 | Δ |
| 3 | 4 | 12 | 1 | 2 | 9 | 7 | ▲ |
| 3 | 4 | 12 | 1 | 2 | 9 | 7 | ▲ |
| 3 | 4 | 12 | 2 | 4 | 10 | 14 | Δ |
| 3 | 4 | 12 | 3 | 3 | 11 | 21 | Δ |
| 3 | 5 | 15 | 1 | 2 | 11 | 7 | ▲ |
| 3 | 5 | 15 | 2 | 4 | 12 | 14 | ○ |
| 3 | 6 | 18 | 1 | 2 | 13 | 7 | ▲ |
| 3 | 6 | 18 | 2 | 4 | 14 | 14 | ○ |
| 3 | 6 | 18 | 2 | 4 | 14 | 14 | ○ |
| 3 | 6 | 18 | 3 | 6 | 15 | 21 | Δ |
| 3 | 7 | 21 | 1 | 2 | 15 | 7 | ▲ |
| 3 | 7 | 21 | 2 | 4 | 16 | 14 | ▲ |
| 3 | 7 | 21 | 3 | 6 | 17 | 21 | ○ |
| 3 | 8 | 24 | 1 | 2 | 17 | 7 | ▲ |
| 3 | 8 | 24 | 2 | 4 | 18 | 14 | ▲ |
| 3 | 8 | 24 | 3 | 6 | 19 | 21 | ○ |
| 3 | 8 | 24 | 4 | 8 | 20 | 28 | Δ |
| 3 | 9 | 27 | 1 | 2 | 19 | 7 | ▲ |
| 3 | 9 | 27 | 2 | 4 | 20 | 14 | ▲ |
| 3 | 9 | 27 | 3 | 6 | 21 | 21 | ○ |
| 3 | 9 | 27 | 4 | 8 | 22 | 28 | Δ |
| 3 | 10 | 30 | 1 | 2 | 21 | 7 | ▲ |
| 3 | 10 | 30 | 2 | 4 | 22 | 14 | ▲ |
| 3 | 10 | 30 | 3 | 6 | 23 | 21 | ▲ |
| 3 | 10 | 30 | 4 | 8 | 24 | 28 | ○ |
| 3 | 10 | 30 | 5 | 10 | 25 | 35 | Δ |

Table. 6 clearly shows that the equations (2) to (4) are met when the number of the scanning signal lines is 3, 5, 6, 7, 8, 9, or 10 (following numbers are omitted).

Figure 18:
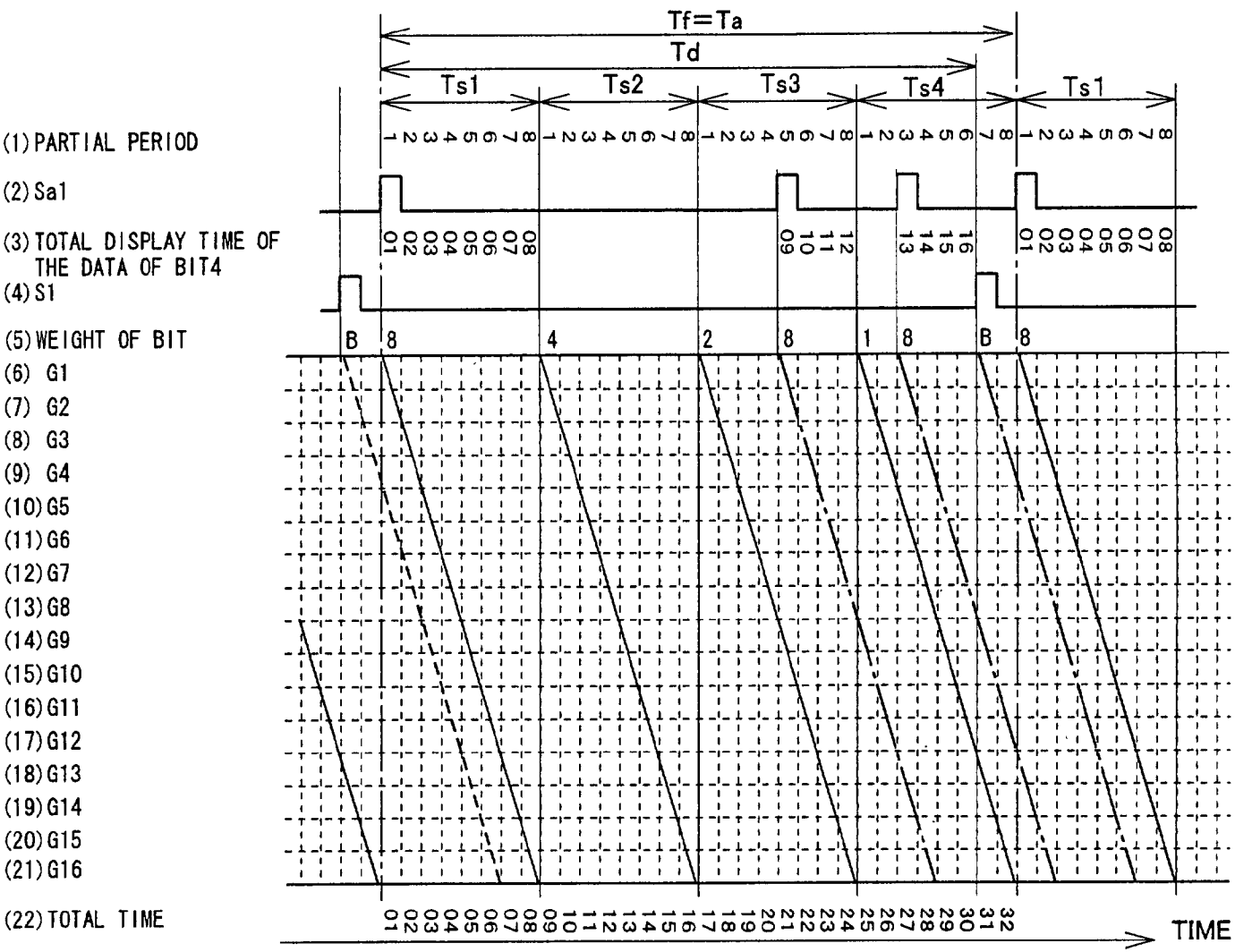
FIG. 18 illustrates a case where the driving method of FIG. 17 is with neither an erase period nor a current measuring period being specified.

Also to the scanning method in FIG. 17, it is possible to adopt the arrangement in which the current measurement is not conducted, as to the scanning method in FIG. 14. An example of the driving method for this scanning method is illustrated in FIG. 18. (1) to (22) of FIG. 18 are matched with (1) to (22) of FIG. 17 respectively. Adopting this driving method makes it possible to conduct the scanning in which: the time used for the lighting for n bit(s) □ the time required for the scanning for n bit(s), even if the arrangement in which the current measurement is not conducted is adopted.

Figure 19:
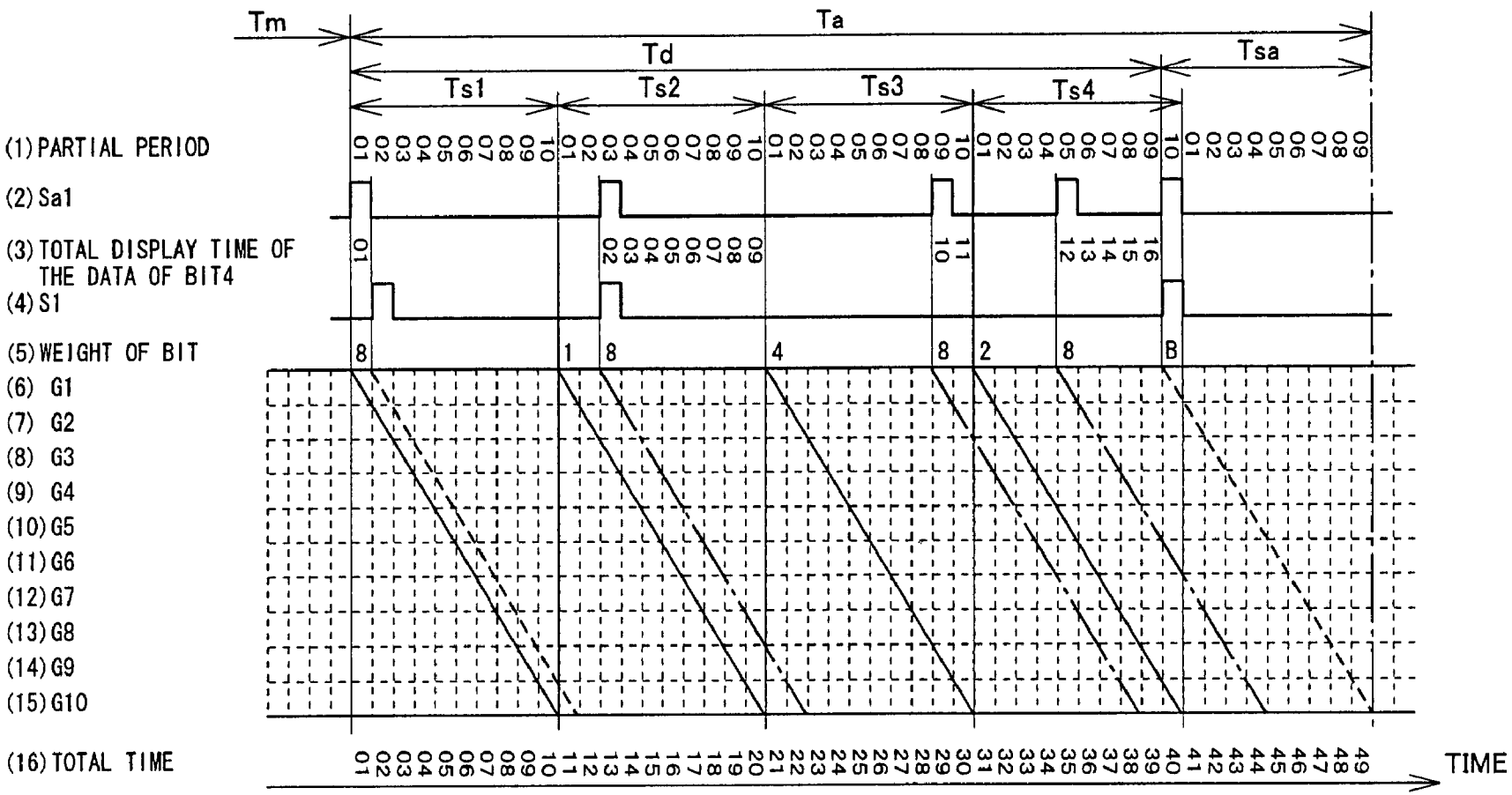
FIG. 19 illustrates an example of the driving method when the organic EL display using the device circuit shown in FIG. 16 emits light in a disperse manner.

FIG. 19 illustrates an example of the driving method in a case that the lighting is disperse as illustrated in FIG. 4. This example in FIG. 19 is an example of the judgment as 10 scanning signal lines G1 to G10 are used and the result is "▲" in (h) of table. 4 so that the display with the gradation for 4 bits can be done with the disperse lighting. (1) to (5) and (16) of FIG. 19 are matched with (1) to (5) and (22) of FIG. 17 respectively, and the states of the selection of the scanning signal lines G1 to G10 is indicated in (6) to (15) of FIG. 19 respectively. In (1) of FIG. 19, the scanning period Ts is divided into 10 periods.

While displaying the data of the bit4 in the first scanning period Ts1 in the display period Ta, the data is stored in the pixel memory R1 via the TFT Q10. Then immediately after this scanning, the scanning signal line S is selectively scanned after one partial period and the data in the capacitor C1 is erased so that a blank display is carried out. When selecting the scanning signal lines G1 to G10 by this scanning is finished, the following scanning period Ts2 immediately starts and the data to be displayed is switched from the data of the bit4 to the data of the bit1. Following this scanning, the bit selecting line Sa is selectively scanned after two partial periods, and data is read from the pixel memory R1 via the TFT Q10 so that the data matched with the bit4 is displayed.

After finishing the scanning of the scanning signal lines G1 to G10, the scanning being arranged for displaying the data matched with the bit1, the following scanning period Ts3 immediately starts and the data to be displayed is switched to the data of the bit3. Following this scanning, the selective scanning of the bit selecting line Sa starts after 8 partial periods, and data is read from the pixel memory R1 via the TFT Q10 so that the data matched with the bit4 is displayed. After finishing the scanning of the scanning signal lines G1 to G10, the scanning being arranged for storing the data matched with the bit3 in the capacitor C1, the following scanning period Ts4 immediately starts and the data to be displayed is switched to the data of the bit2. Following this scanning, data is read from the pixel memory R1 so that the data matched with the bit4 is displayed again after 4 partial periods. Until this final display in accordance with the data of the bit4, the display has continued for 1+8+2=11 partial periods, so that following this scanning, the scanning signal line S is subjected to the selective scanning after 5 partial periods and the data of the capacitor C1 is erased, and a blank display is carried out to prepare for the next current measuring period Tm.

In this manner, provided that one frame period Tf includes the discrete display period Td, it is possible to realize the scanning in which: the time used for the lighting for n bit(s) □ the time necessary for the scanning for n bit(s), as in the above-identified scanning illustrated in FIG. 17.

Figure 20:
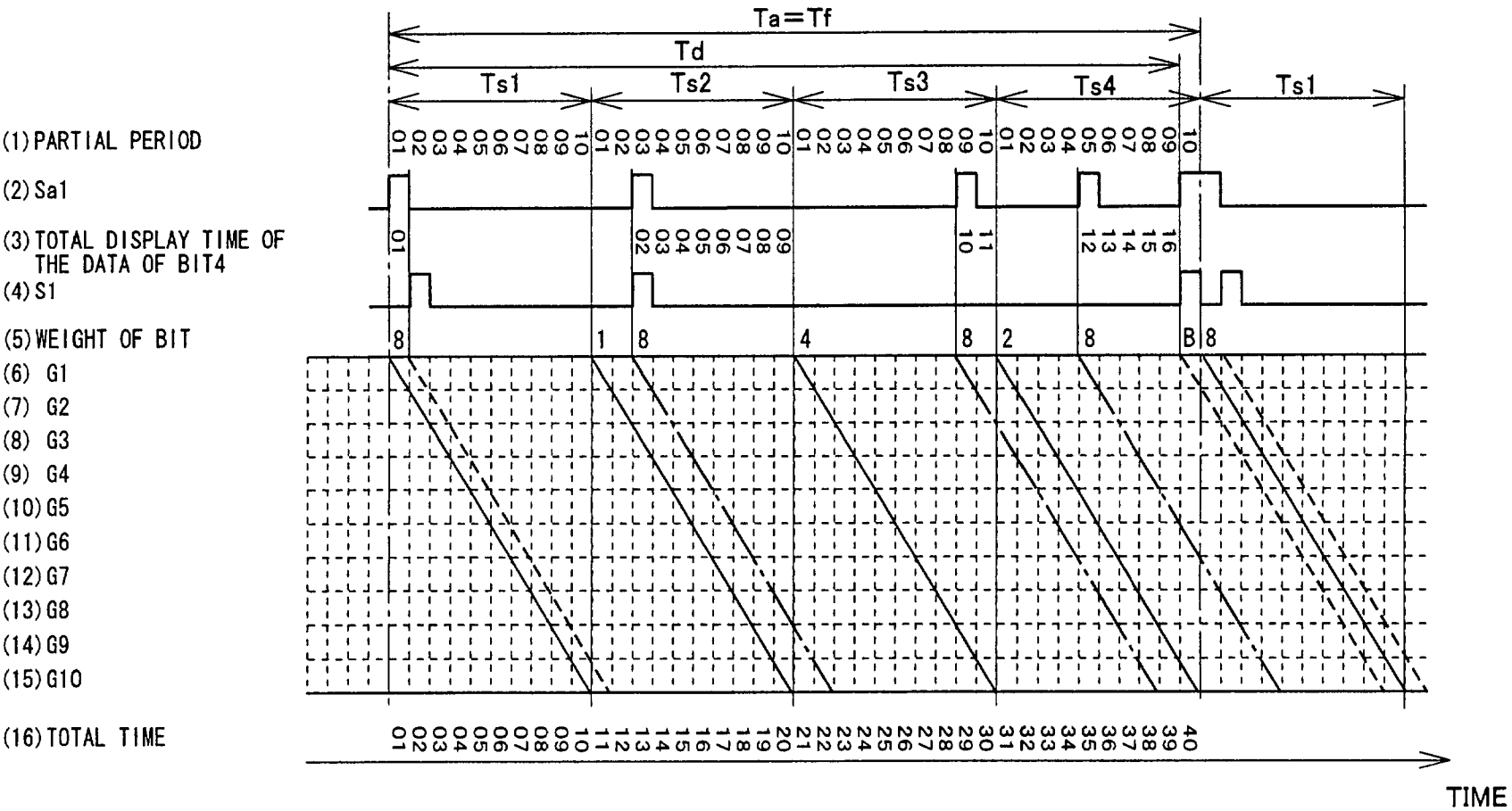
FIG. 20 illustrates a case where the driving method of FIG. 19 is with neither an erase period nor a current measuring period being specified.

As in the case of the driving methods in FIGS. 14 and 17, this driving method in FIG. 19 can also adopt the arrangement in which the current measurement is not conducted. An example of the driving method arranged as such is illustrated in FIG. 20. (1) to (16) of FIG. 20 are matched with (1) to (16) of FIG. 19 respectively.

Figure 21:
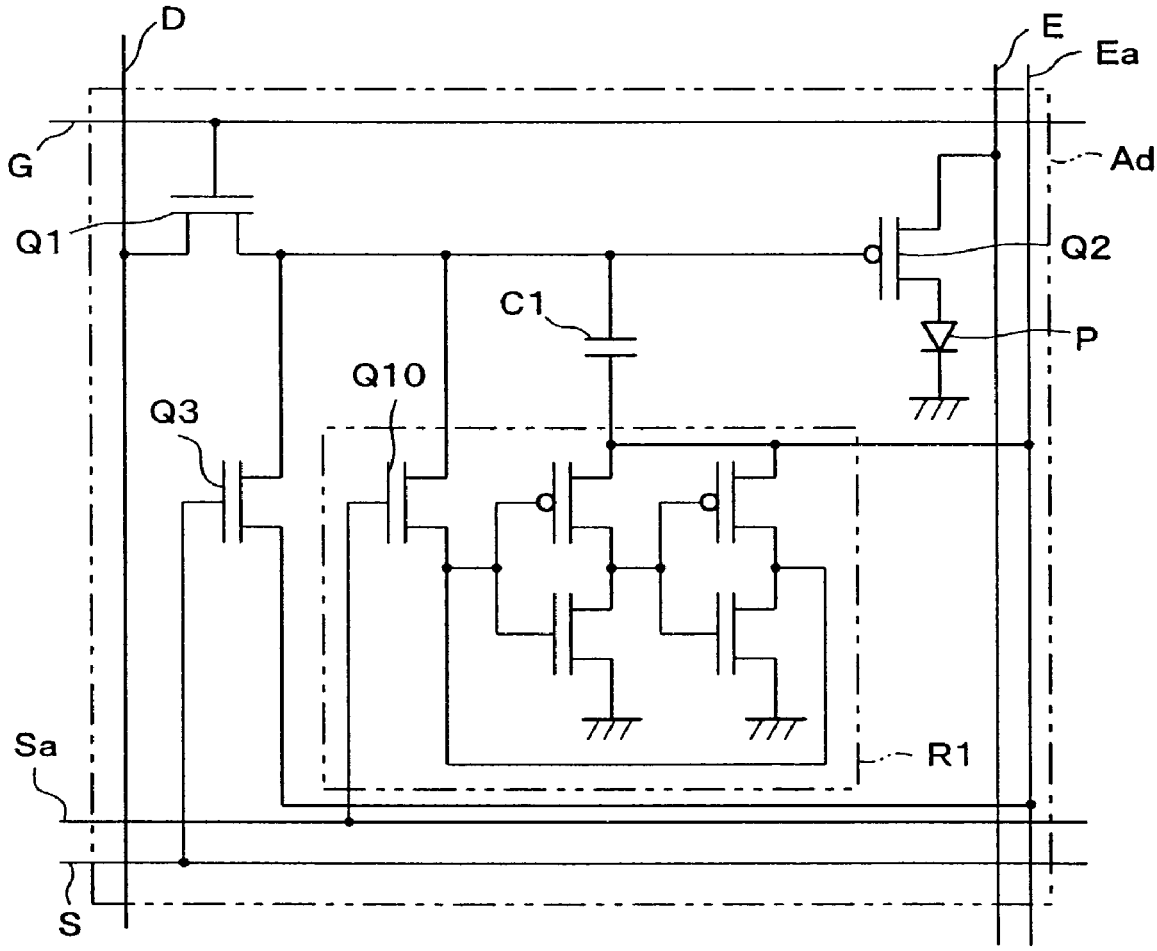
FIG. 21 is an electrical circuit diagram of a device circuit in an organic EL display in accordance with a fifth embodiment of the present invention.
Figure 22:
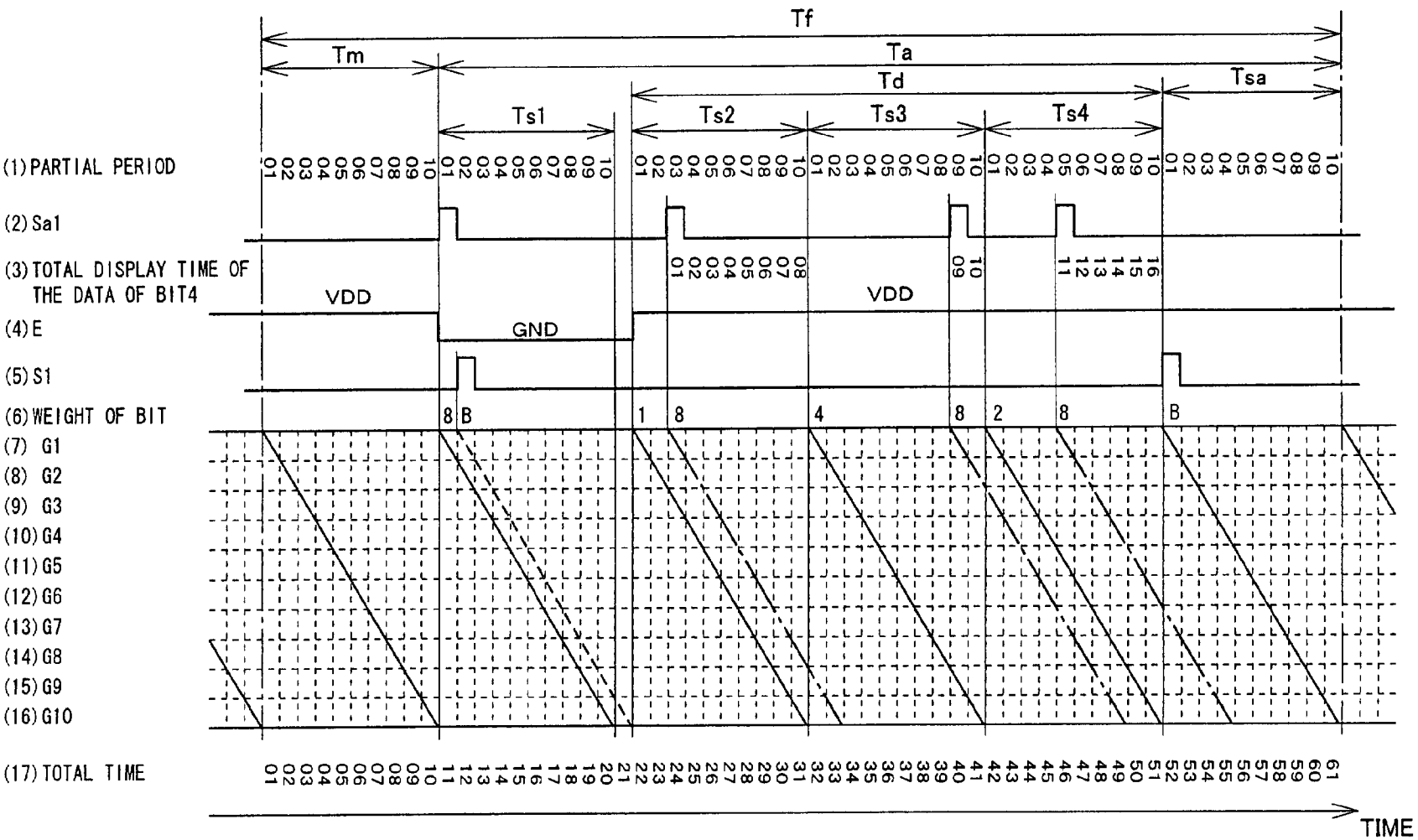
FIG. 22 illustrates an example of the driving method of the organic EL display using the device circuit which is shown in FIG. 21.
Figure 23:
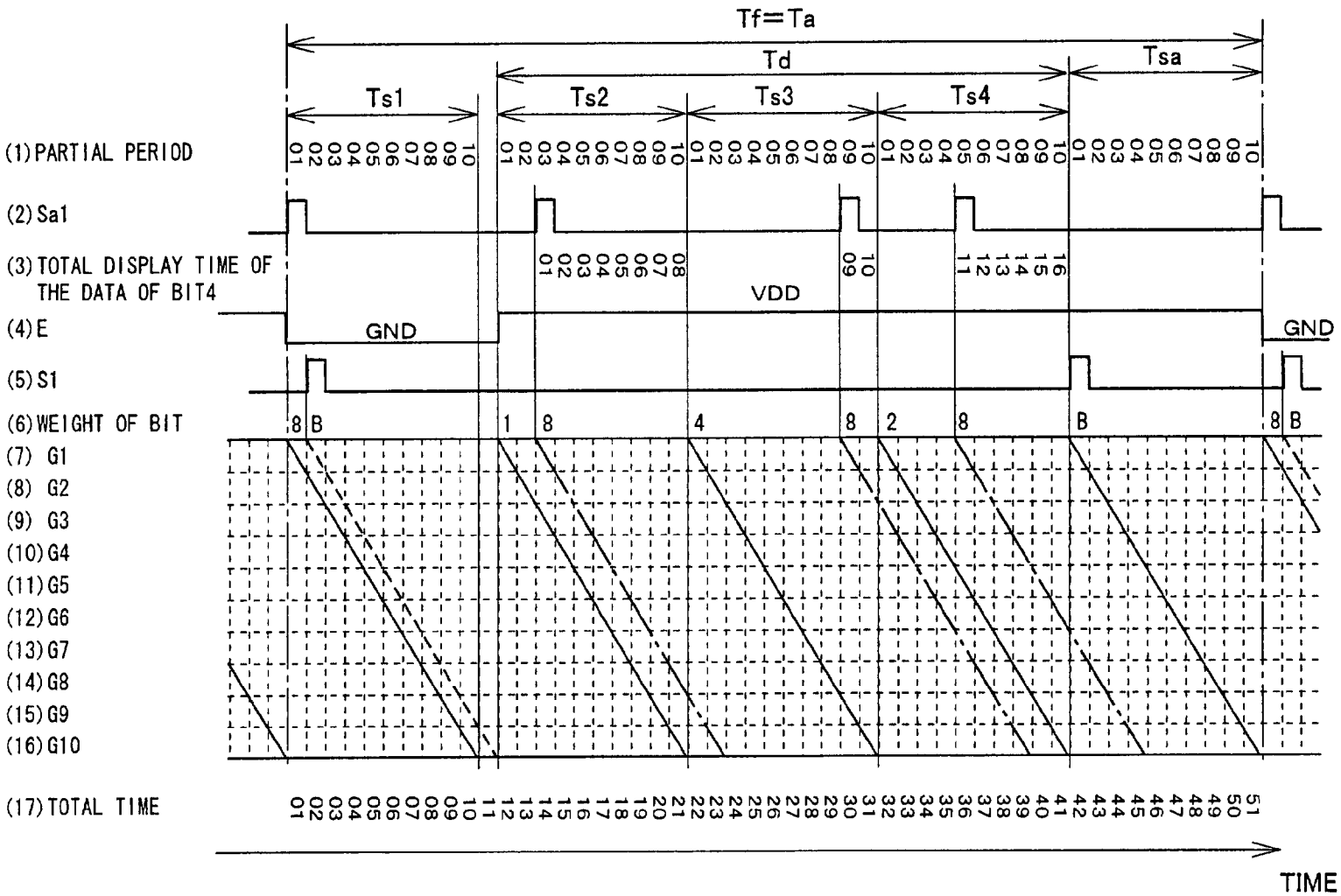
FIG. 23 illustrates a case where the driving method of FIG. 22 is with neither an erase period nor a current measuring period being specified.

The following description will discuss a fifth embodiment in accordance with the present invention in reference to FIGS. 21 to 23.

FIG. 21 is an electrical circuit diagram of a device circuit Ad in an organic EL display in accordance with the fifth embodiment of the present invention. This device circuit Ad is similar to the above-mentioned device circuit Ac illustrated in FIG. 16, and hence members having the same functions as those described are given the same numbers so that the descriptions are omitted. It is noted that this device circuit Ad includes a second power supply line Ea which is provided for logic operations and independent from the power supply line E, wherein the capacitor C1 and the pixel memory R1 are connected to the power supply line Ea.

Incidentally, to the second power supply line Ea, a voltage equal to the voltage, which is applied to the first power supply line E in the device circuit Ac shown in FIG. 16, is applied.

This additional power supply line Ea for logic operations is provided so that the scanning in FIG. 19 can be modified to be an arrangement illustrated in FIG. 22. (1) to (3) of FIG. 22 and (5) to (17) of FIG. 22 are matched with (1) to (3) of FIG. 19 and (4) to (16) of FIG. 19 respectively. (4) of FIG. 22 indicates the voltage of the power supply line E, and the voltage can vary within the range between the VDD potential and the GND potential.

First of all, the current measuring period Tm is arranged at the beginning of one frame period Tf, and in this current measuring period Tm, the power supply line E is set to have the GND potential and the current running through the device circuit Ad is measured. Then in the scanning period Ts1, the power supply line E is set as the GND potential and the data of the bit4 is stored in the pixel memory R1. Following this scanning, a blank display starts after one unit of time while the capacitor C1 keeps the potential matched with the state of non-luminosity. In this scanning period Ts1, the power supply line E has the GND potential as described above so that the organic EL device P does not emit light.

After the process of writing the data of the bit4 into the pixel memory R1 is successively done with respect to the scanning signal lines G1 to G10, the power supply line E is set to have the VDD potential and then the following scanning period Ts2 starts and the data matched with the bit1 is displayed. Then following this scanning, data is read from the pixel memory R1 after two units of time so that the data matched with the bit4 is displayed for the first time.

Then in the scanning period Ts3, the data matched with the bit3 is displayed, and following this scanning, data is read from the pixel memory R1 after 8 units of time so that the data matched with the bit4 is displayed again. Then also in the scanning period Ts4, after the data matched with the bit2 is displayed, data is read from the pixel memory R1 so that the data of the bit4 is displayed again. In this manner, the data matched with the bit4 has been displayed for 8+2+6=16 units of time. Then in the erase period Tsa, the sets of the current running through all device circuits Ad are temporarily cleared and this makes it possible to conduct the current measurement in the next current measuring period Tm.

In this way, writing the data in the pixel memory R1 while controlling the power supply line E of the organic EL device P enables any kind of the numbers of scanning signal lines which are judged as "▲" in the judgment (h) in table. 4 to continuously carry out displaying (in frames equivalent to each other). Thus the restriction of the number of the scanning signal lines as described above can be eliminated.

Being similar to the driving methods illustrated in FIGS. 14 and 17, this driving method shown in FIG. 22 can adopt the arrangement in which the current measurement is not conducted, and an example of the driving method arranged as such is indicated in FIG. 23. (1) to (17) of FIG. 23 are matched with (1) to (17) of FIG. 22 respectively.

In this manner, the present invention is arranged so that to the electric potential keeping means, power is supplied via the second power supply line which is provided to be independent from the first power supply line which supplies the load current to the electro-optical device.

On this account, while the first active device is selected, if an electric potential of the first power supply line is set as an electric potential with which the load current does not run through such as the GND potential, it becomes possible to control the display period of the electro-optical device, the display period being based the data stored in the electric potential keeping means and the pixel memory, independently of the scanning period of the first active device and without carrying out displaying, so that the time-division gradation display can be realized within the display period.

Figure 24:
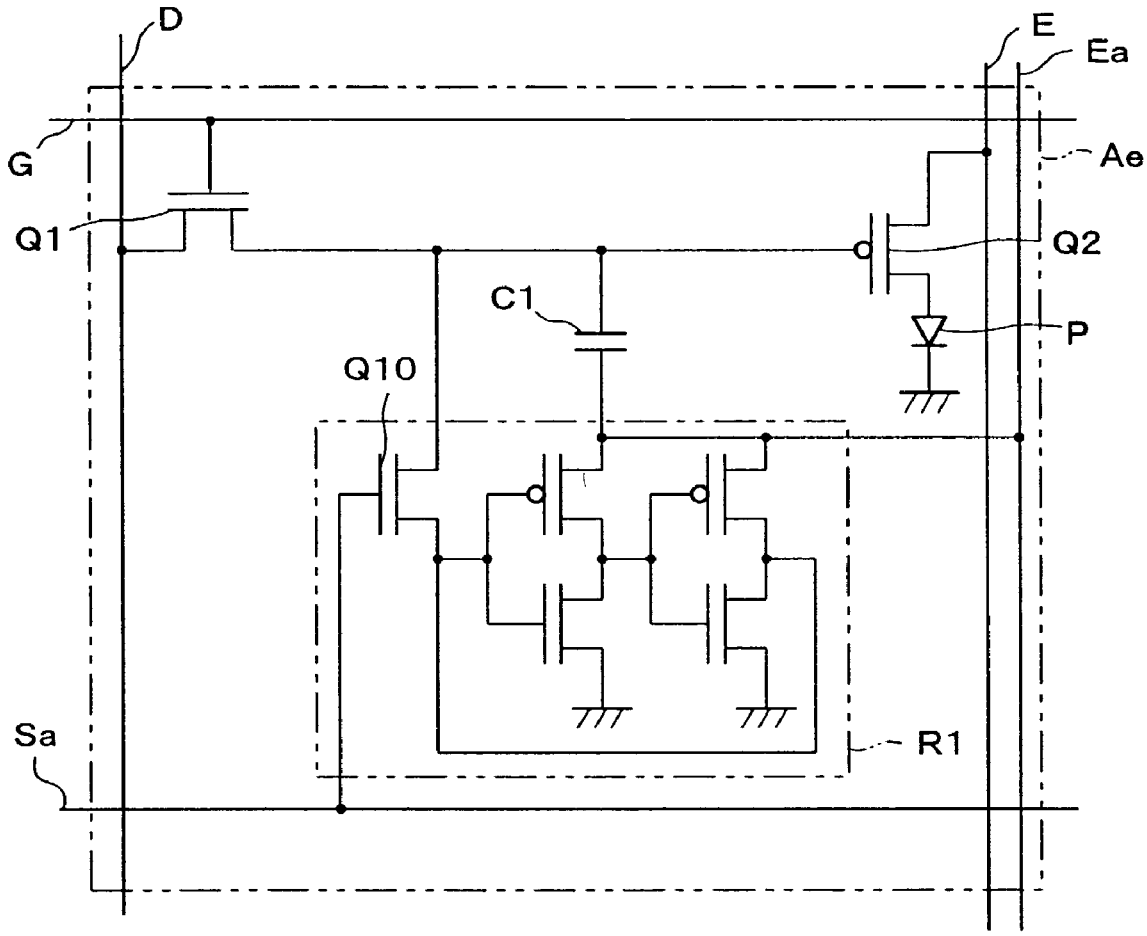
FIG. 24 is an electrical circuit diagram of a device circuit in an organic EL display in accordance with a sixth embodiment of the present invention.
Figure 25:
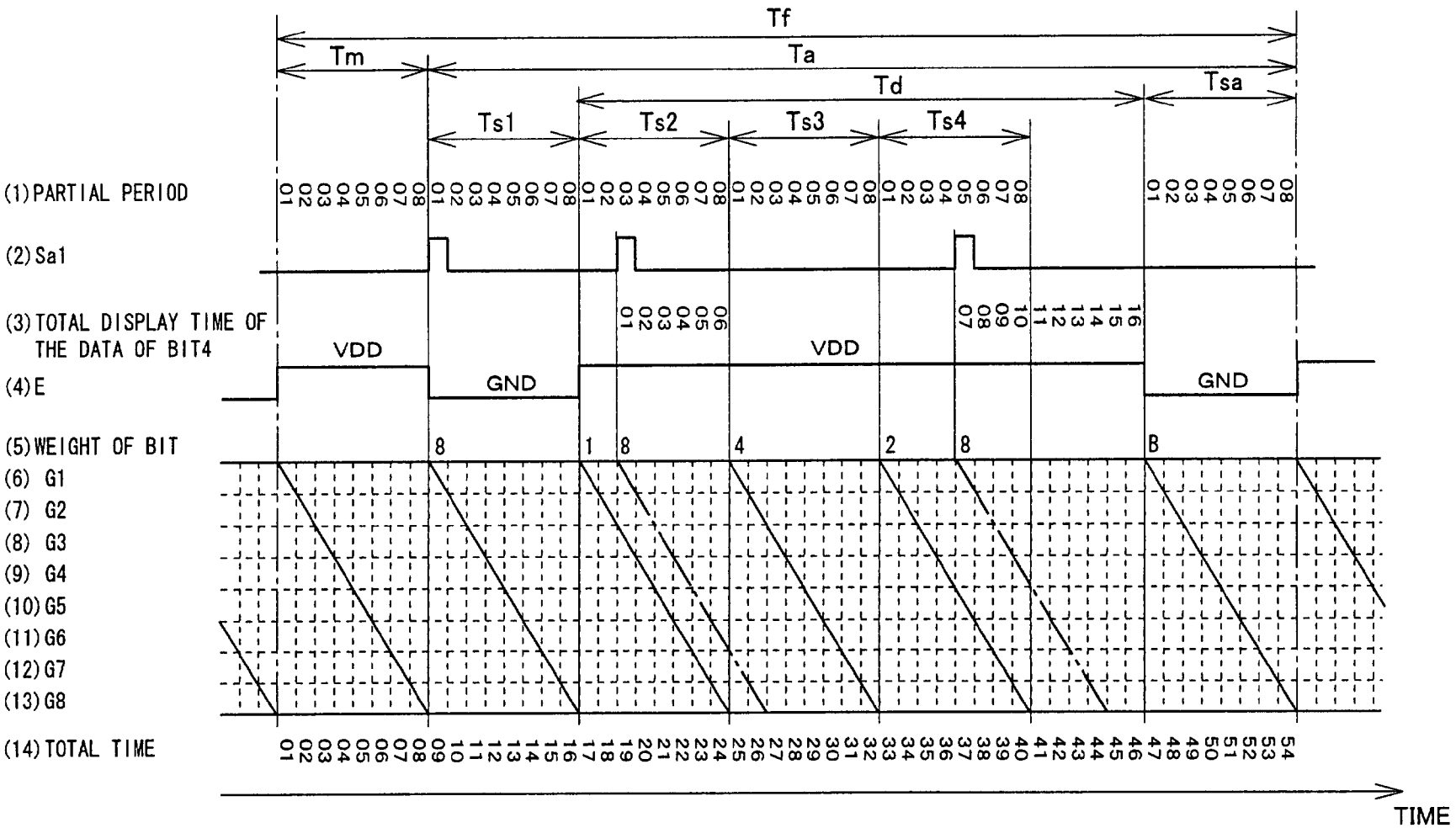
FIG. 25 illustrates an example of the driving method of the organic EL display using the device circuit which is shown in FIG. 24.
Figure 26:
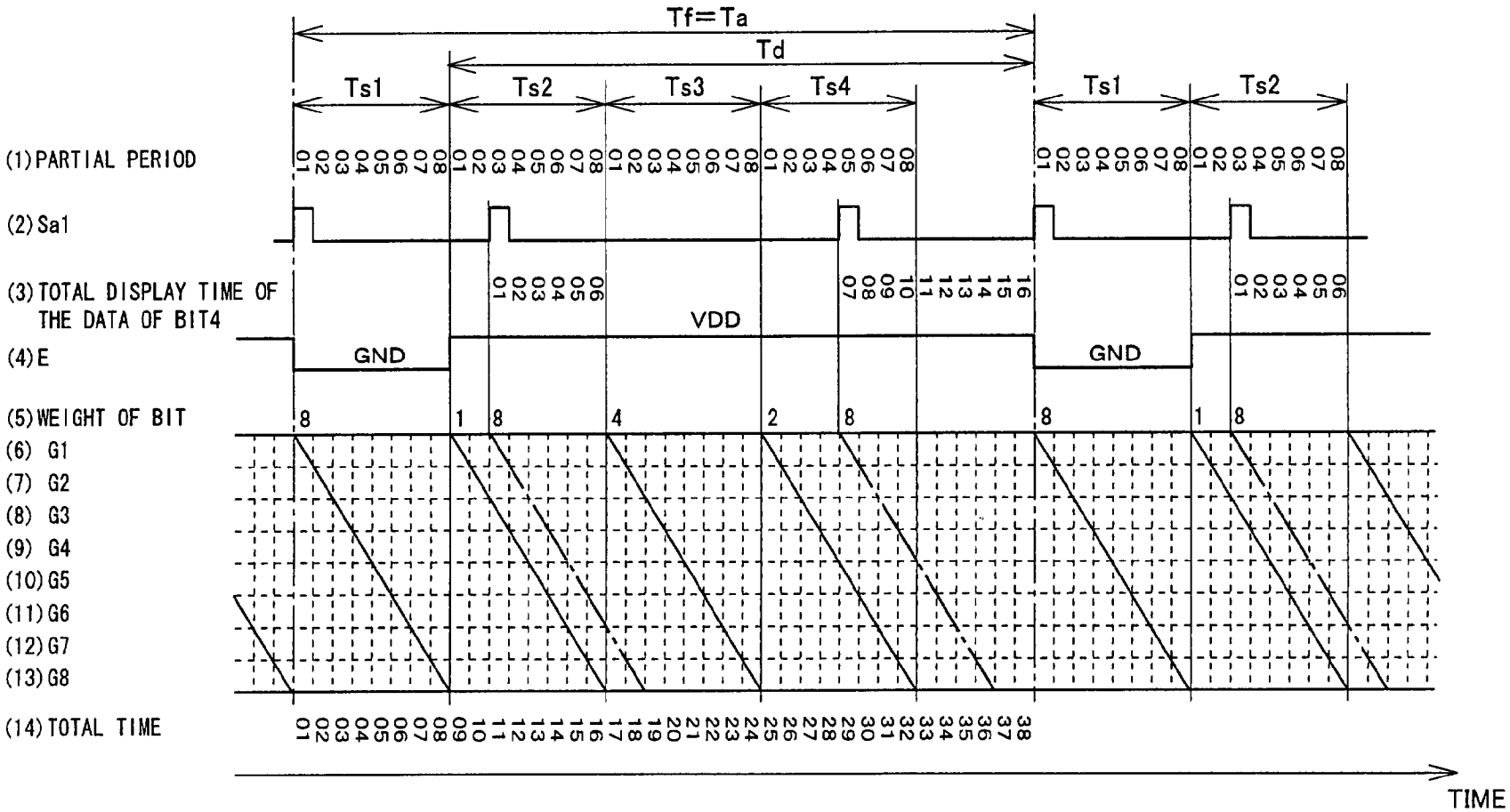
FIG. 26 illustrates a case where the driving method of FIG. 25 is with neither an erase period nor a current measuring period being specified.

The following description will discuss a sixth embodiment in accordance with the present invention in reference to FIGS. 24 to 26.

FIG. 24 is an electrical circuit diagram of a device circuit Ae in an organic EL display in accordance with the sixth embodiment of the present invention. This device circuit Ae is similar to the above-mentioned device circuit Ad illustrated in FIG. 21, and hence members having the same functions as those described are given the same numbers so that the descriptions are omitted. It is noted that the device circuit Ae is not provided with the selecting signal line S and the according TFT Q3. That is to say, when the power supply line E of the organic EL device P and the power supply line Ea of the pixel memory R1 are individually controlled as in the above-mentioned device circuit Ad, the quality of the display is not degraded even if a device circuit such as the device circuit Ae which does not include the TFT Q3 for initializing is adopted. Also, the capacitor C1 can keep an electric potential using the gate stray capacitance of the TFT Q2, without the TFT Q3 being formed therein.

FIG. 25 illustrates an example of the driving method of the device circuit Ae. (1) to (4), (5), and (14) of FIG. 25 are matched with (1) to (4), (6), and (17) of FIG. 22 respectively. In this example, there are 8 scanning signal lines from G1 to G8, and (6) to (13) of FIG. 25 indicates which scanning signal line is selected. In (1) of FIG. 25, the scanning period Ts is divided into 8 periods.

First of all, the current measuring period Tm is arranged at the beginning of one frame period Tf, and in this current measuring period. the power supply line E is set to have the VDD potential so that the current running through the device circuit Ae is measured. Then in the scanning period Ts1, the power supply line E is set to have the GND potential so that the data of the bit4 is stored in the pixel memory R1. In the above-identified device circuit Ad, the data for a blank display is set in the capacitor C1 following the scanning above. In the meantime, although this device circuit Ae does not conduct the blank scanning, the electric potential of the power supply line E is set as GND so that the organic EL device P does not emit light.

When the data of the bit4 is successively written in each of the pixel memories R1 via the scanning signal lines G1 to G8, the power supply line E is set to have the VDD potential and then the following scanning period Ts2 starts so that the data matched with the bit1 is displayed. Following this scanning, data stored in the pixel memory R1 is read after 2 units of time, and the display matched with the data of the bit4 is carried out for the first time.

Then in the scanning period Ts3, the data matched with the bit3 is displayed for all 8 units of time of the scanning period Ts3. After the display of the data of the bit3 is finished, the following scanning period Ts4 starts, and after the data matched with the bit2 is displayed, data stored in the pixel memory R1 is read after 4 units of time so that the data of the bit4 is displayed again. When this reading of the data of the bit4 with respect to all of the scanning signal lines G1 to G8 finishes, the data matched with the bit4 has been displayed for: 6+8=14 units of time. Then the erase period Tsa starts after 2 units of time. In this period the electric potential of the power supply line E is set as GND so that the sets of the current running through all of the circuit devices Ae are temporarily cleared, and this makes it possible to measure a current in the following current measuring period Tm.

The above-identified scanning can be done on the occasion as:

$$\text{The Time Used for the Lighting} \geqq (\text{The Number of the Scanning Signal Line} \times (4\ \text{bits} - 1) + \text{The Display Period of the Bit1}) \quad (5)$$

Thus, even conditions, which are judged as "▲" in the judgement (f) in table 1 so that displaying cannot be done, can meet equation (5), and hence in these conditions, although the scanning is disperse as illustrated in FIG. 25, it is possible to carry out displaying with the predetermined gradation for 4 bits. In this manner, adopting the arrangement of the present embodiment makes it possible to loosen the above-mentioned limit of the number of the scanning signal lines.

FIG. 26 shows an example of the driving method illustrated in FIG. 25, when the current measurement is not conducted. (1) to (14) of FIG. 26 are matched with (1) to (14) of FIG. 25 respectively.

Figure 27:
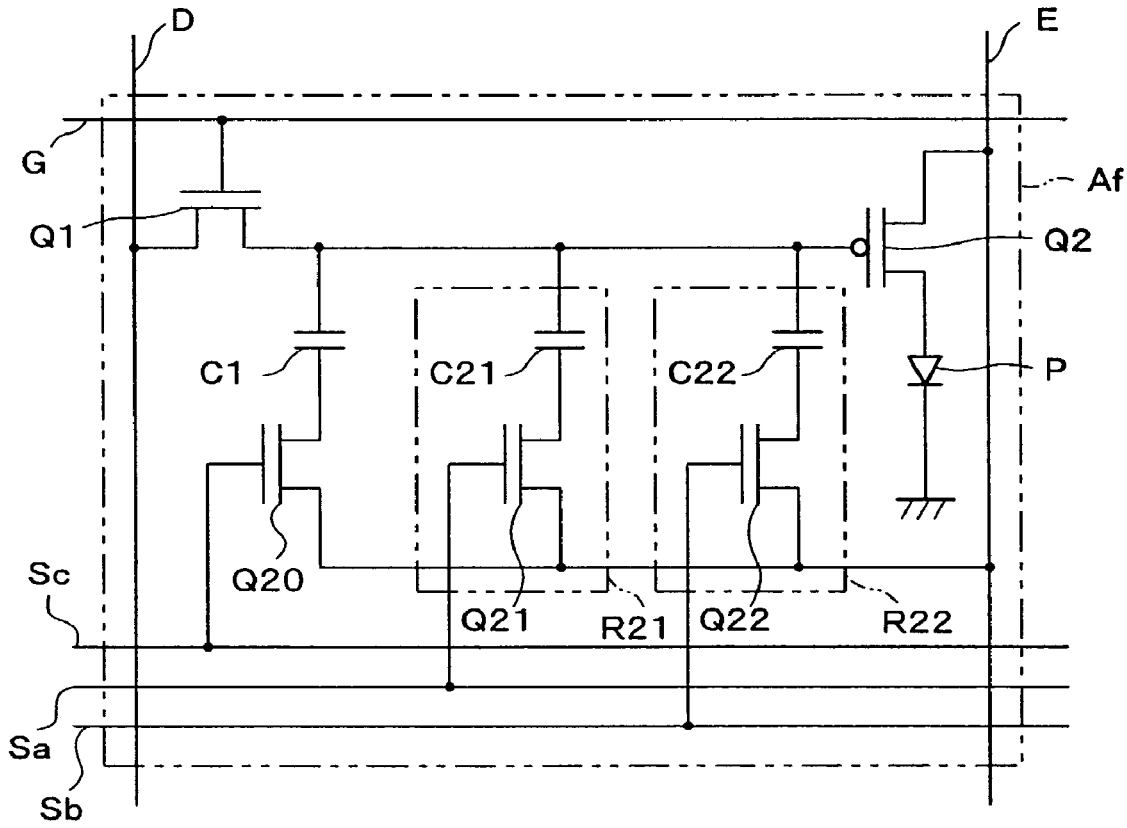
FIG. 27 is an electrical circuit diagram of a device circuit in an organic EL display in accordance with a seventh embodiment of the present invention.
Figure 28:
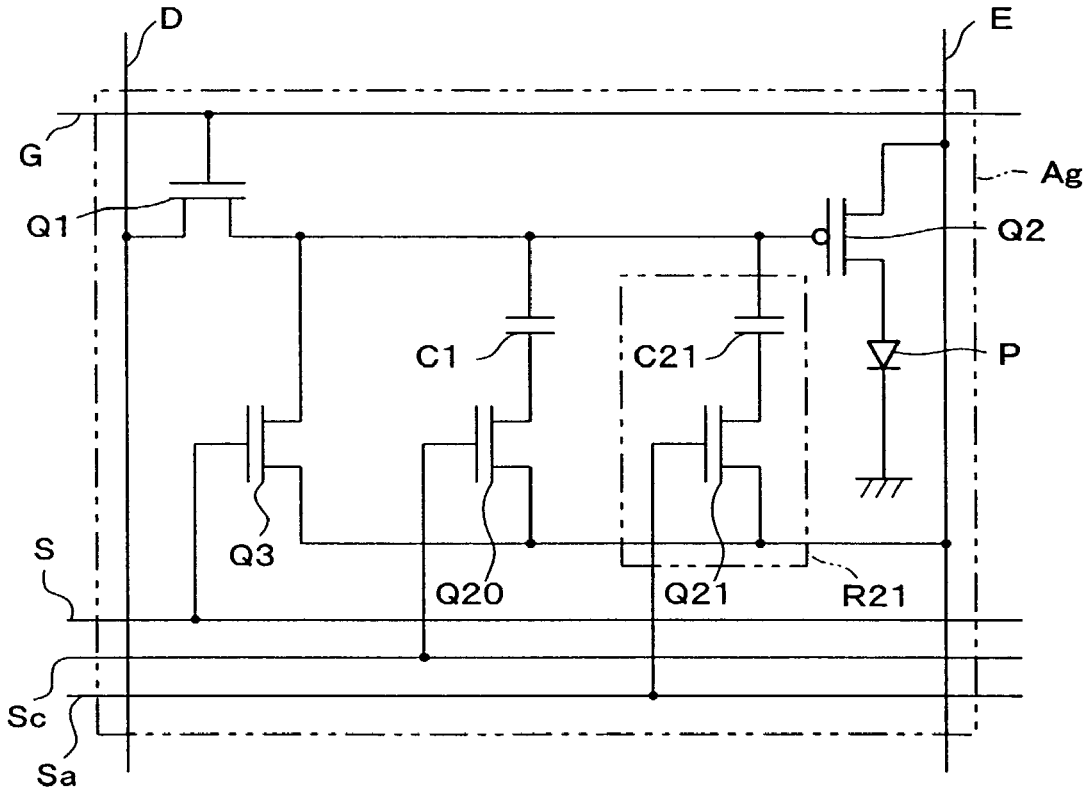
FIG. 28 is an electrical circuit diagram of a device circuit which is similar to the device circuit shown in FIG. 27.

The following description will discuss a seventh embodiment in accordance with the present invention in reference to FIGS. 27 and 28.

FIG. 27 is an electrical circuit diagram of a device circuit Af in an organic EL display in accordance with the seventh embodiment of the present invention. This device circuit Af is similar to the above-mentioned device circuit Ad illustrated in FIG. 21, and hence members having the same functions as those described are given the same numbers so that the descriptions are omitted. It is noted that the device circuit Af includes 2 pixel memories R21 and R22, composed of: capacitors C21 and 22; and n-type TFT Q21 and Q22 being connected in series and inserted into the capacitors C21 and 22. Meanwhile, the capacitor C1 is connected to the power supply line E via an n-type TFT Q20 which is controlled by a selecting line Sc.

Therefore, while the above-mentioned pixel memories R1 and R2 store digital data by way of a static memory arrangement composed of the CMOS inverters INV1 and INV2, the pixel memories R21 and R22 store analog data by way of a dynamic memory arrangement composed of the capacitors C21 and C22 so that an analog gradation control using the voltage value can be used along with the above-mentioned digital gradation control. If the time for storing required by the pixel memories R21 and R22 is shorter than one frame period Tf described above which is not less than several Hz, this type of dynamic memory arrangement does not cause any significant problems, provided that active devices Q20 are provided in series in the capacitor C1. Moreover, this arrangement makes it possible to keep the potential using the stray capacitance which is accompanied with: active devices such as the TFT Q20; and the organic EL device P, without the capacitors C21 and C22 being provided.

When both of the TFT Q21 and Q22 are out of conduction on account of the bit selecting lines Sa and Sb, the TFT Q20 is brought into conduction by the selecting line Sc so that writing/erasing/reading of the data with respect to the capacitor C1 are done. This arrangement makes it possible to conduct the luminance correction of the organic EL device P by concurrently using the digital gradation control and the analog gradation control.

Moreover, the device circuit Ag in FIG. 28 is similar to the device circuit Af so as to separately realize the non-luminous state of the organic EL device P and the control of the state of writing/erasing/reading of the data with respect to the capacitor C1.

Figure 29:
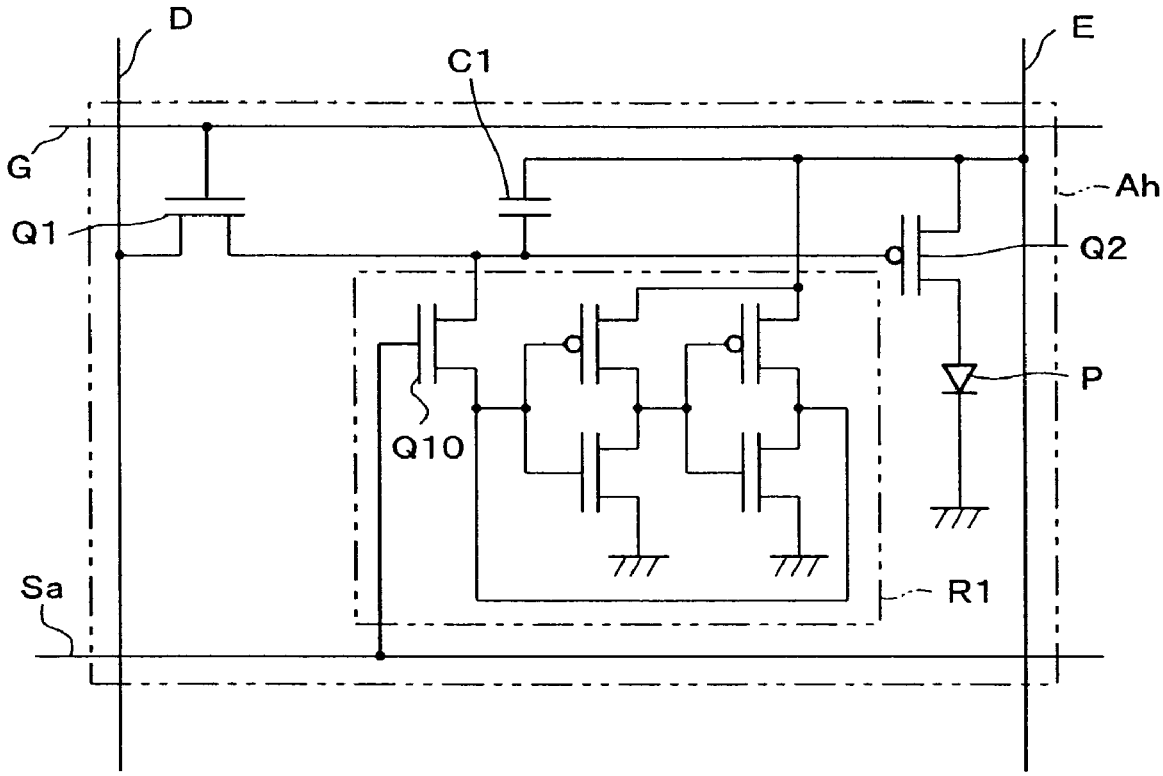
FIG. 29 is an electrical circuit diagram of a device circuit in an organic EL display in accordance with an eighth embodiment of the present invention.
Figure 30:
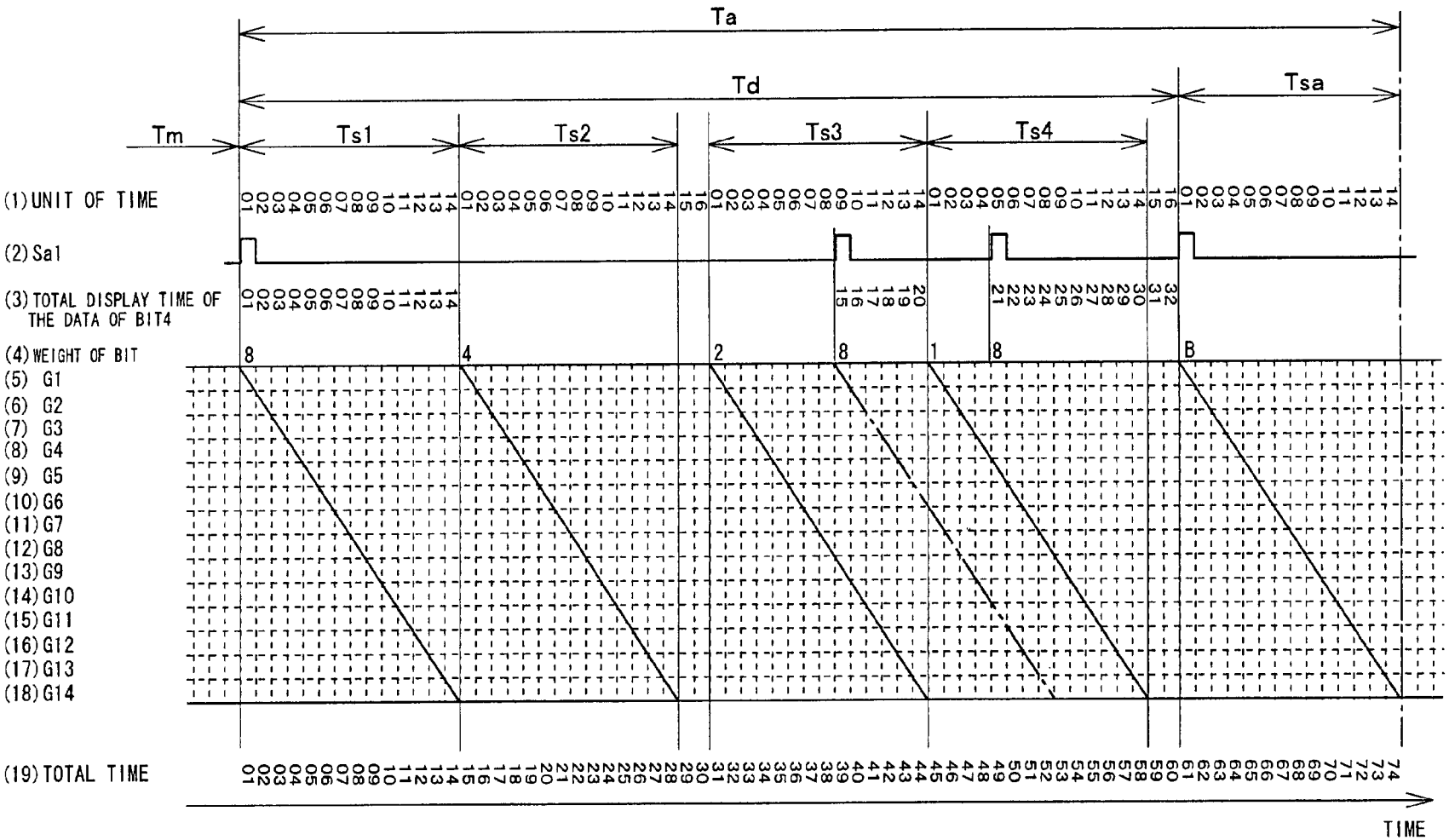
FIG. 30 illustrates an example of the driving method of the organic EL display using the device circuit which is shown in FIG. 29.
Figure 31:
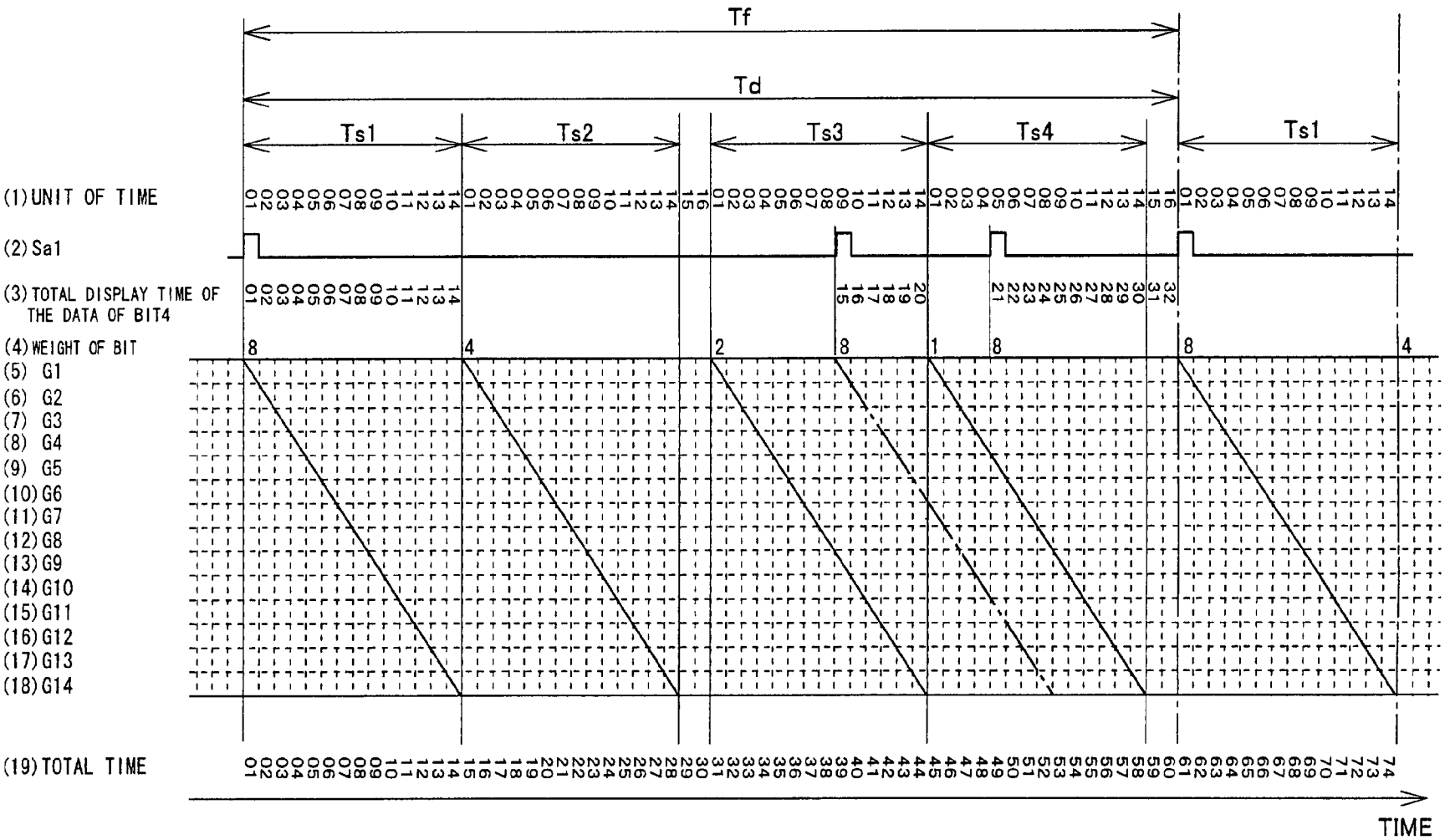
FIG. 31 illustrates a case where the driving method of FIG. 30 is with neither an erase period nor a current measuring period being specified.

The following description will discuss an eighth embodiment in accordance with the present invention in reference to FIGS. 29 to 31.

FIG. 29 is an electrical circuit diagram of a device circuit Ah in an organic EL display in accordance with the eighth embodiment of the present invention. This device circuit Ah is similar to the above-mentioned device circuit Ab illustrated in FIG. 9, and hence members having the same functions as those described are given the same numbers so that the descriptions are omitted. It is noted that unlike the device circuit Ab, this device circuit Ah is not provided with the pixel memory R2 and thus includes only the pixel memory R1. Although having only one memory R1, as described below, the device circuit R1 can perform the gradation display for 4 bits as the device circuit Ae does, by conducting the scanning in a disperse manner as the device circuit Ab does.

FIG. 30 shows an example of the driving method of the device circuit Ah. This FIG. 30 describes the display period Ta after the current measuring time Tm is finished. In this example, 14 scanning signal lines G1 to G14 are set as one group, and (5) to (18) in FIG. 30 show which scanning signal line is selected from the lines G1 to G14. (1) of FIG. 30 is the display of a unit if time, while (19) of FIG. 30 describes the total time (number of the units of time). (3) of FIG. 30 indicates the total display time of the data of the bit4, and (4) of FIG. 30 shows the weight of the bit. (2) of FIG. 30 describes the selective scanning of the bit selecting line Sa1.

In the first scanning period Ts1 in the display period Ta, the scanning signal lines G1 to G14 are successively selected so that the data of the bit4 is displayed, and at the same time the bit selecting lines Sa are selected so that the data of the bit4 is written in the pixel memory R1. Until the selection of the scanning signal lines G1 to G14 finishes, i.e. for 14 units of time, the data of the bit4 has been displayed.

After the scanning period Ts1, the following scanning period Ts2 immediately starts, and while the data to be displayed is switched from the data of the bit4 to the data of the bit3, the data of the bit3 is displayed for 16 units of time. Since the scanning period Ts2 consists of 14 units of time, there is idle time for 2 units of time after the selective-scanning of the scanning signal line G14.

After the idle time, in the scanning period Ts3, the data to be displayed is switched from the data of the bit3 to the data of the bit2 and the switched data is displayed for 8 units of time. Then in the state that none of the scanning signal lines G1 to 14 is selected, following the above-identified switching of the data, the bit selecting line Sa is selected so that the data of the bit4 is read from the pixel memory R1 so as to be displayed for remaining 6 units of time. Thus the data of the bit4 has been displayed for 20 units of time in total.

In the scanning period Ts4, the data to be displayed is switched from the data matched with the bit4 to the data matched with the bit1 and the switched data is displayed for 4 units of time. Then the bit selecting line Sa is selected so that the data of the bit4 is read from the pixel memory R1 again, so as to be displayed for remaining 10 units of time. This data of the bit4 is continuously displayed during the idle time for 2 units of time, which is after the scanning period Ts4. Thus the data of the bit4 has been displayed for 32 units of time in total, and hence the proportion of the displaying periods between the bits is exactly 1:2:4:8.

After the idle time, the following erase period Tsa starts and the data to be displayed is switched from the data of the bit4 stored in the pixel memory R1 to the data matched with the non-luminosity so that the switched data is kept in the capacitor C1 while a blank display is carried out.

Conducting this type of disperse scanning with the idle time enables the gradation display for 4 bits with only one pixel memory R1. In other words, the above-identified arrangement can adopt any number of the bit(s) and the scanning signal line(s). The time required for the scanning in this arrangement is longer than the time required for the scanning in the arrangement in which the TFT Q3 for erasing is provided such as in the device circuit Ac illustrated in FIG. 16. The proportion is illustrated in table. 7.

TABLE 7

| a | b | c | d | e | f | h |
|---|---|---|---|---|---|---|
| 4 | 10 | 40 | 3 | 12 | 45 | 1.125 |
| 4 | 11 | 44 | 3 | 12 | 45 | 1.023 |
| 4 | 12 | 48 | 4 | 16 | 60 | 1.250 |
| 4 | 13 | 52 | 4 | 16 | 60 | 1.154 |
| 4 | 14 | 56 | 4 | 16 | 60 | 1.071 |
| 4 | 15 | 60 | 5 | 20 | 75 | 1.250 |
| 4 | 16 | 64 | 5 | 20 | 75 | 1.172 |
| 5 | 20 | 100 | 4 | 32 | 124 | 1.240 |
| 5 | 21 | 105 | 4 | 32 | 124 | 1.181 |
| 5 | 22 | 110 | 4 | 32 | 124 | 1.127 |
| 5 | 23 | 115 | 4 | 32 | 124 | 1.078 |
| 5 | 24 | 120 | 5 | 40 | 155 | 1.292 |
| 5 | 25 | 125 | 5 | 40 | 155 | 1.240 |
| 5 | 26 | 130 | 5 | 40 | 155 | 1.192 |
| 6 | 40 | 240 | 5 | 80 | 315 | 1.313 |
| 6 | 41 | 246 | 5 | 80 | 315 | 1.280 |
| 6 | 42 | 252 | 5 | 80 | 315 | 1.250 |
| 6 | 43 | 258 | 5 | 80 | 315 | 1.221 |
| 6 | 44 | 264 | 5 | 80 | 315 | 1.193 |
| 6 | 45 | 270 | 5 | 80 | 315 | 1.167 |
| 6 | 46 | 276 | 5 | 80 | 315 | 1.141 |
| 6 | 47 | 282 | 5 | 80 | 315 | 1.117 |
| 6 | 48 | 288 | 6 | 96 | 378 | 1.313 |

In table. 7, (a) is the number of bits (4 in FIG. 30), (b) is the number of scanning signal lines (14 in FIG. 30), (c) is the time originally required for the scanning (4×14=56 units of time in FIG. 30), (d) is the display period per single gradation, (e) is the display period of the second bit (16 units of time in FIG. 30), (f) is the time actually used in the present driving method (60 units of time in FIG. 30) and (h) is the ratio of the time actually used to the time originally required for the scanning.

This table. 7 illustrates some examples matched with the cases when the number of bits is 4, 5, or 6 respectively, including the case shown in FIG. 30. The table shows that although the percentage of the scanning time in the display period falls by around 20%, conducting the above-identified disperse scanning makes it unnecessary to add the TFT Q3 for erasing and the scanning signal lines S accompanied therewith so that the increase of the number of the TFTs and lines can be avoided.

FIG. 31 illustrates an example of the driving method shown in FIG. 30, in which the current measurement is not conducted. (1) to (19) of FIG. 31 are matched with (1) to (19) of FIG. 30. Incidentally, when the current measurement is not conducted, while the non-luminous time exists as shown in FIG. 18 in the case of the device circuit Ac illustrated in FIG. 16, the above-mentioned time does not exist as shown in this FIG. 31 in the case of the device circuit Ah illustrated in FIG. 18, so that the latter is preferable. That is to say, if the non-luminous time does not exist, it is possible to lower the luminance per unit of time, which is required to keep the average luminance in one frame period Tf. Lowering the instant luminance of the organic EL device generally prolong the life of the device so that the driving method in FIG. 31 is thought to be better than the driving method in FIG. 18.

Figure 32:
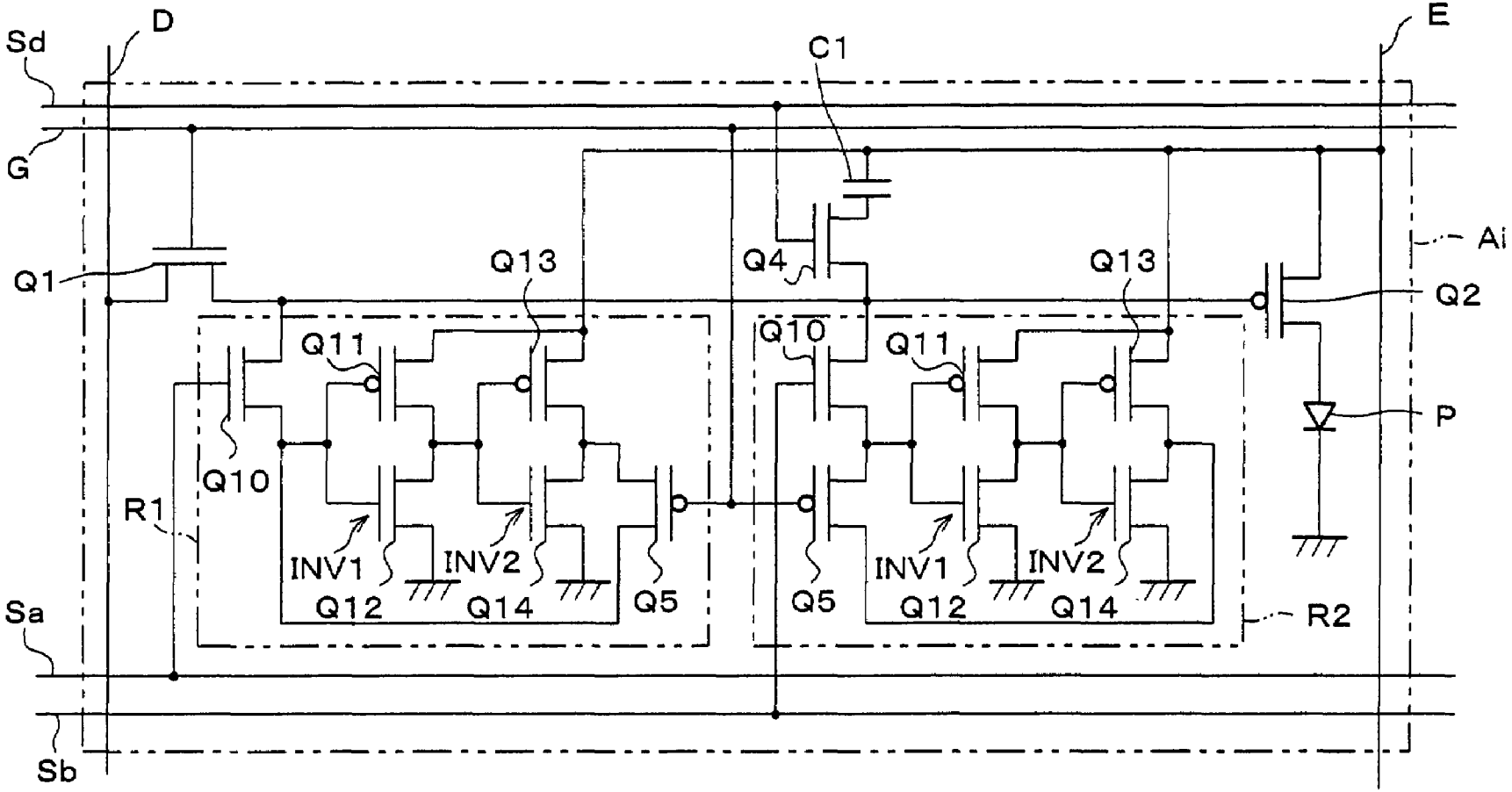
FIG. 32 is an electrical circuit diagram of a device circuit in an organic EL display in accordance with a ninth embodiment of the present invention.
Figure 33:
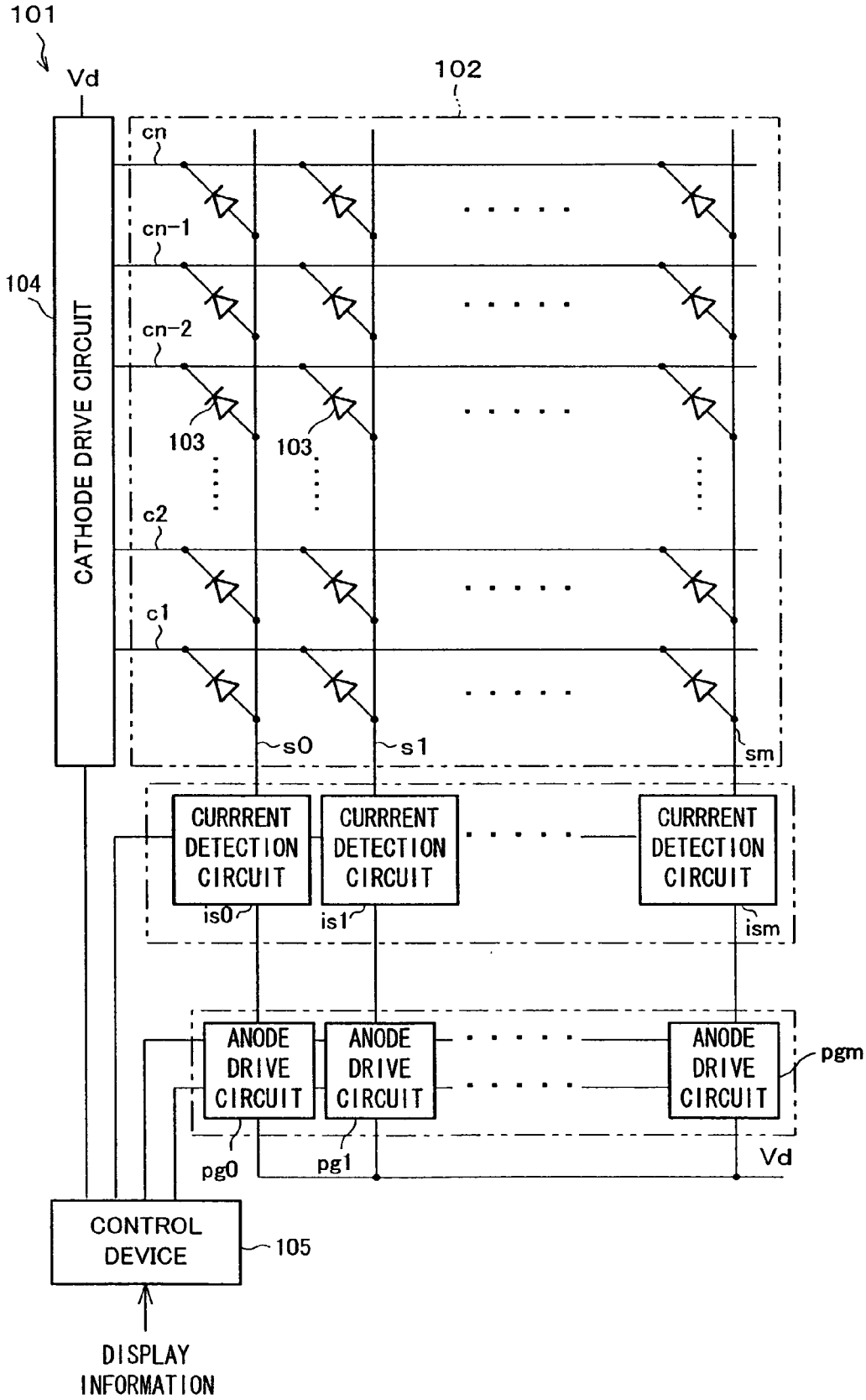
FIG. 33 illustrates an example of a conventional organic EL display in which luminance correction using current detection means is conducted.
Figure 34:
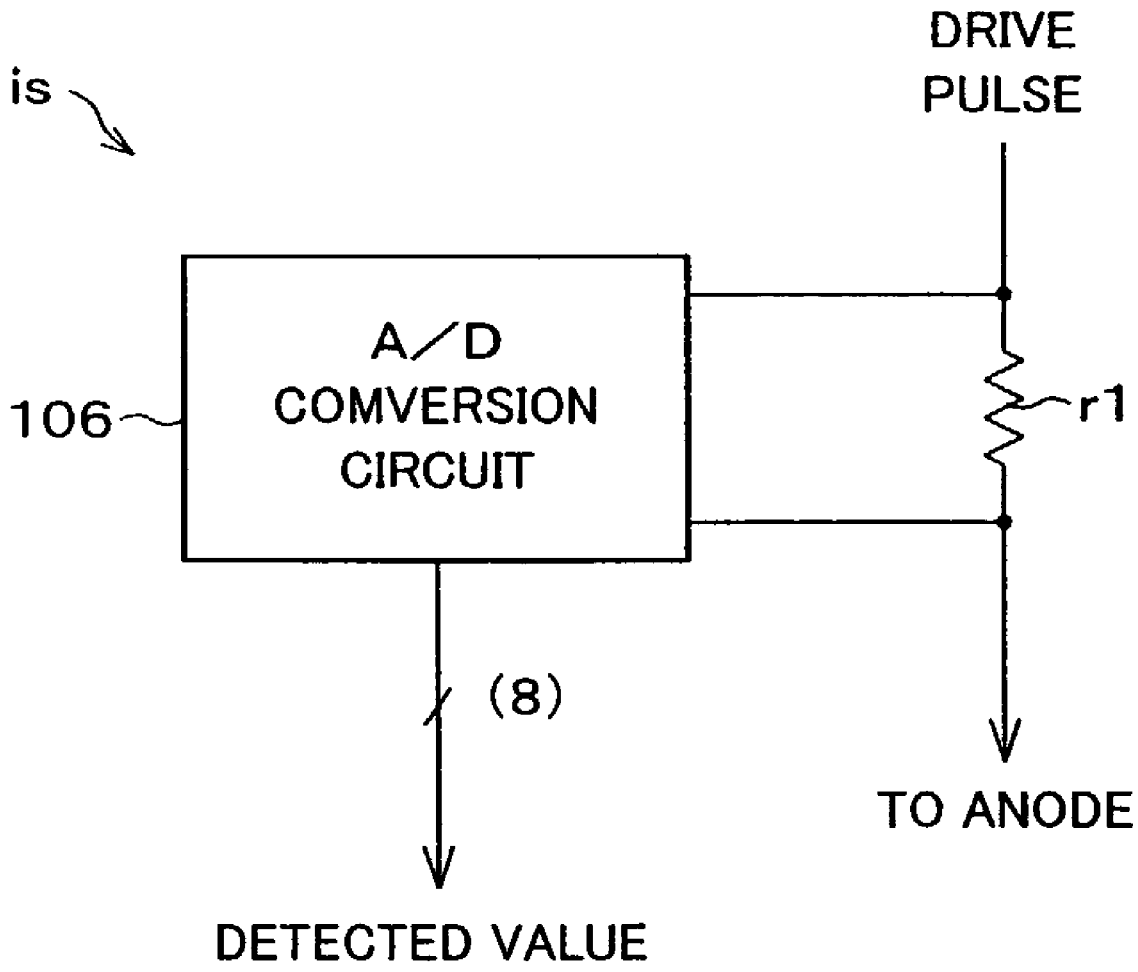
FIG. 34 is a block diagram illustrating a current detection circuit used in the organic EL display shown in FIG. 33.
Figure 35:
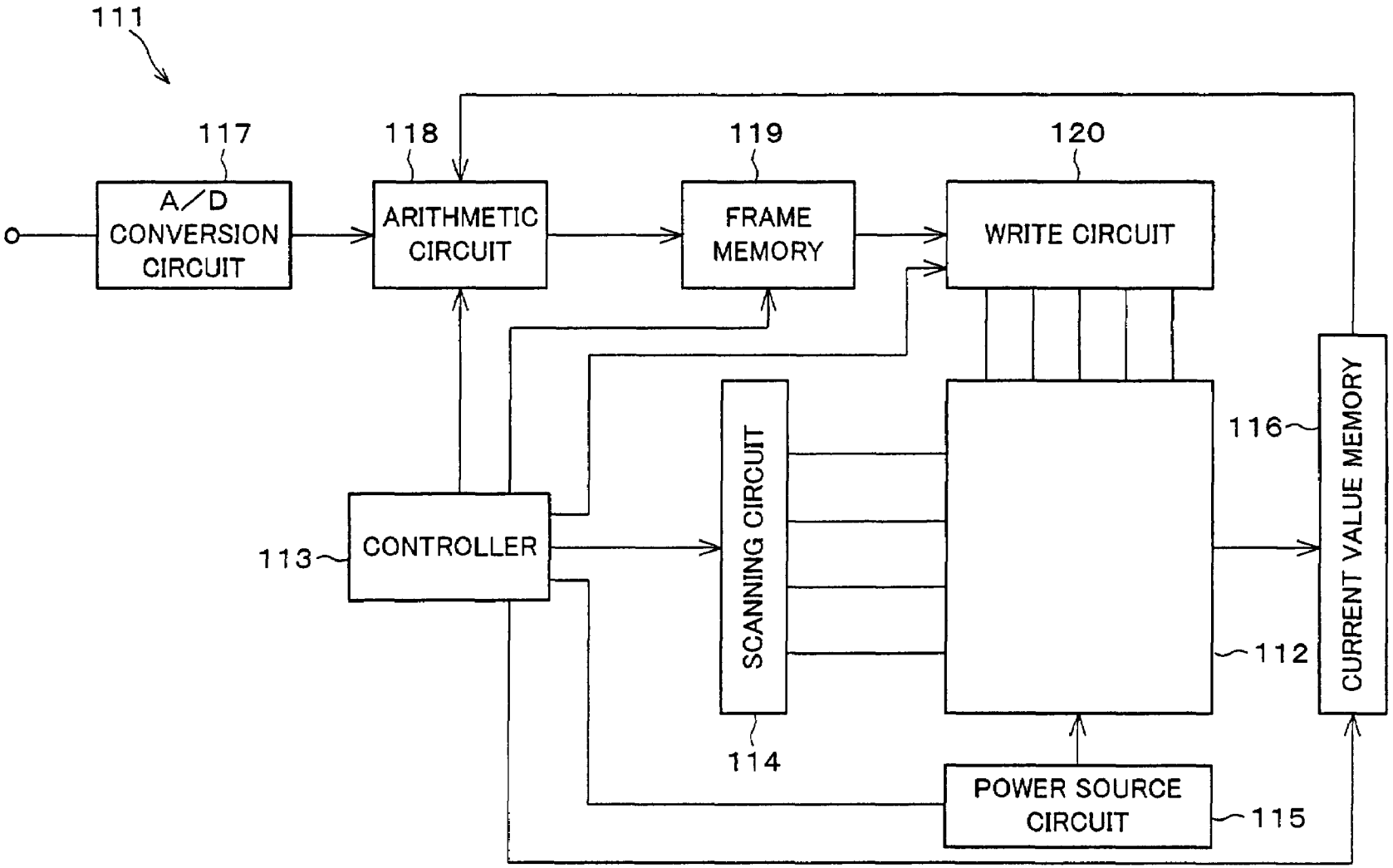
FIG. 35 illustrates another example of a conventional organic EL display in which luminance correction using current detection means is conducted.
Figure 36:
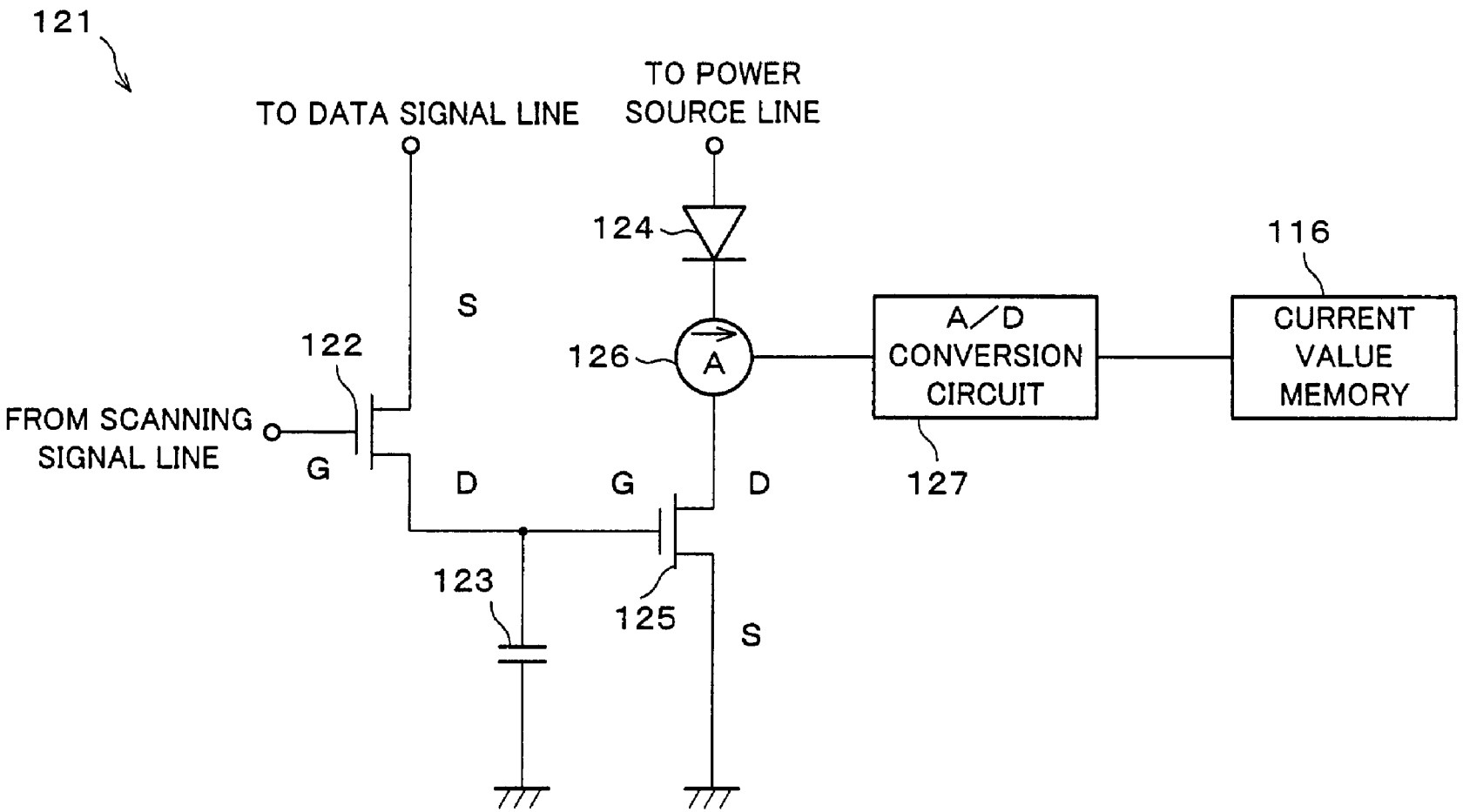
FIG. 36 is a block diagram of a pixel used in the organic EL display shown in FIG. 35.

The following description will discuss a ninth embodiment in accordance with the present invention in reference to FIG. 32.

FIG. 32 is an electrical circuit diagram of a device circuit Ai in an organic EL display in accordance with the ninth embodiment of the present invention. This device circuit Ai is similar to the above-mentioned device circuit Ab illustrated in FIG. 9, and hence members having the same functions as those described are given the same numbers so that the descriptions are omitted. It is noted that this device circuit Ai is arranged such that the electric potential keeping means is composed of a TFT Q4 which is a fourth active device and the capacitor C1 connected in series with the TFT Q4.

As described above, the device circuit Ab is arranged so that for setting the data signals which are read from the pixel memories R1 and R2 in the capacitor C1, the capacity of the capacitor C1 is reduced to the minimum, for preventing the data stored in the pixel memories R1 and R2 being altered by the electric charges stored in the capacitor C1.

In the meantime, the present embodiment is arranged such that: the TFT Q4 is connected in series with the capacitor C1; the TFT Q10 is subjected to the selective driving when the scanning signal line G is not selected; and the TFT Q10 is subjected to the non-selective driving, so that in this embodiment it is possible to prevent the display signal levels kept in the pixel memories R1 and R2 being unnecessarily altered by the influence of the capacitor C1.

Then when the display signal levels are written in the capacitor C1 again, the TFT Q4 is subjected to the selective driving. Alternatively, the TFT Q4 may be subjected to the selective driving when the TFT Q1 is subjected to the selective driving and the display signal level is written in the pixel memories R1 and R2, so that the display signal level is written in the capacitor C1.

On this account, it is possible to increase the capacitance of the capacitor C1 and hence reduce the fluctuation of the electric potential of the capacitor C1.

Moreover, it is noted that the device circuit Ai is arranged so that a TFT Q5 which is a fifth active device is provided between the output of the pixel memory R1 and the input of the pixel memory R2, and the TFT Q5 is not selected, when the scanning line G is selected and the display signal level of the pixel memories R1 and R2 is determined.

Thus when the scanning signal line G is not selected, the TFT Q5 is selected so that it is possible to arrange the output of the CMOS inverter INV2 in the second stage being fed back to the input of the CMOS inverter INV1 which is in the first stage to form the above-mentioned static memory, meanwhile when the TFT Q5 is not selected, it is possible to arrange the output of the CMOS inverter INV2 which is in the second stage not to influence on the input of the CMOS inverter INV1 which is in the first stage.

On this account, it is unnecessary to strictly control the output impedance of the CMOS inverter INV2 which is in the second stage.

The organic EL device P may be alternatively constructed by forming a transparent anode made of ITO, etc. on a glass substrate on which cathodes such as an organic multilayer film and Al are formed. The organic muitilayer film is preferably arranged such that: (i) a hole implantation layer (or an anode buffer layer) made of CuPc; (ii) a hole transmission layer made of TPD; (iii) an emission layer made of DPVBi, Zn(oxz)2, Alq using DCM as dopant; and (iv) an electron transmission layer made of Alq, etc. are deposited.

In the meantime, the above-mentioned TFT for driving the organic EL device P must be manufactured by a polycrystalline silicon process having high charge mobility. This manufacturing process can be realized by, for instance, Japanese Laid-Open Patent Publication No. 10-301536/1998. In this process, the maximum temperature can be limited around 600 EC at the time of forming a gate insulating film, and hence it is possible to adopt a high-heat-resistant glass.

As described above, the display apparatus in accordance with the present invention is arranged such that the electro-optical devices arranged in a matrix manner are driven by the first active devices, and when load currents are measured so that display data are corrected in accordance with the measured data, the current measurement is periodically carried out every unit of time or once in several units of time.

Thus, to dynamically correct the display data, which is for obtaining a desired gradation, in accordance with the variation of the temperature of the surroundings, it is unnecessary to provide the current measuring means in each of the electro-optical devices so that it is possible to effectively detect the current value of each of the electro-optical devices and increase the numerical aperture.

Moreover, as described above, in the arrangement including the electric potential keeping means, light is emitted without conducting the scanning if the display data is provided, so that when the load current of one particular electro-optical device is measured with the provision of a predetermined signal level, the load currents of other electro-optical devices influence on the result of the measurement. Thus the scanning to make the electro-optical devices in a state of non-luminosity is conducted.

On this account, it is possible to eliminate the influence of other electro-optical devices, and measure the load current of the particular electro-optical device precisely.

As described above, the display apparatus in accordance with the present invention, including the electro-optical devices arranged in a matrix manner, each of the electro-optical devices being driven by the first active device, comprises: at least one second active device provided in each of the electro-optical device; the pixel memory for keeping a signal level captured by the second active device; and the electric potential keeping means for keeping a signal level captured by the first active device, wherein the second active device is selectively driven when the first active device is not selected, so that a display signal level of the electro-optical device is switched to a display signal level matched with the pixel memory.

Thus, it is possible to use the time, which is remained after displaying the data of the lower bits, for displaying the data of the higher bits, so that the time-division gradation display in which the display period of each bit is precisely matched with the weight of each bit can be realized.

As described above, the display apparatus in accordance with the present invention further comprises a third active device in accordance with the electric potential keeping means, wherein the display signal level is set by the first active device whereas an erase signal level is set by the third active device.

Thus, after displaying is started by dint of the scanning of the first active device, it is possible to erase the display by the selective-scanning of the third active device before all of the first signal lines G is scanned. In other words, it is possible to make the unit of the display time shorter than the scanning period. Thus, in conducting the digital gradation control, it is possible to carry out short-time displaying which is precisely matched with the weight of lower bits, so that it becomes possible to carry out a delicate gradation control with the large number of bits.

Moreover, as described above, the display apparatus in accordance with the present invention is arranged so that the electric potential keeping means is constituted by a fourth active device and a capacitor.

Thus, when the second active device is selectively driven while the first active device is not selected, by subjecting the fourth active device to the non-selective driving, it is possible to prevent the display signal levels kept in the pixel memory being unnecessarily altered by the influence of the capacitor, and hence it is possible to enlarge the capacity of the capacitor so that it is possible to reduce the variation of the electric potential of the capacitor, which occurs with the passage of time.

The display apparatus in accordance with the present invention is, as described above, arranged such that a fifth active device is provided between an input of one pixel memory and an output of another pixel memory, and while the fifth active device is subjected to non-selective driving, the display signal level of the pixel memory is set.

Thus, provided that the pixel memory is constituted by two-staged inverter circuits, the fifth active device is subjected to the non-selective driving when the display signal level is supplied to the input terminal of the first inverter circuit so that it is possible to eliminate the influence of the output of the second inverter circuit on the display signal level supplied to the input terminal of the first inverter circuit.

Furthermore, as described above, the display apparatus in accordance with the present invention is arranged so that the electric potential keeping means receives power from the second power supply line which is independent from the first power supply line that provides a load current to the electro-optical device.

Thus, while the first active device is selected, it is possible to set the electric potential of the first power supply line to have an electric potential such as the GND potential with which the load current cannot pass through the first power supply line so as to write signal levels in the electric potential keeping means and the pixel memory without carrying out displaying. Moreover, it is possible to control the display period of the electro-optical device in accordance with the data stored in the electric potential keeping means and the pixel memory in isolation from the scanning period of the first active device, so that time-division gradation display can be realized in the display period.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A display apparatus, comprising:

electro-optical devices in respective areas partitioned by a plurality of first signal lines and a plurality of second signal lines intersecting with each other, each of the electro-optical devices being driven so as to carry out displaying in accordance with a signal level supplied via the second signal line while a first active device being selected via the corresponding first signal line;

at least one second active device corresponding to the electro-optical device;

at least one pixel memory, corresponding to the at least one second active device, for storing a signal level captured by the at least one second active device;

electric potential keeping means for keeping a signal level captured by the first active device; and at least one bit selecting line for selectively driving the at least one second active device, wherein, while the first signal line is selected and a display signal level is set in the electric potential keeping means through the first active device, the at least one second active device is selectively driven so that the display signal level is also set in the at least one pixel memory, and the at least one second active device is selectively driven when the first signal lines is not selected, so that a display signal level of the electric potential keeping means is switched to the display signal level in the at least one pixel memory, and when time-division gradation display is carried out using an active organic EL, a bit appearing more than once in one frame is kept in an SRAM, while a bit appearing only once in one frame is kept in a capacitor, and when display period of weight is less than scanning time, the gap is filled as a data display period of the pixel memory, and time-division gradation driving is carried out.

2. The display apparatus as defined in claim 1, further comprising third active devices each provided to each of the electric potential keeping means, for supplying a signal level, which is different from the signal level supplied to the second signal line, to the electric potential keeping means, in response to a selective-output supplied from a third signal line which supplies an output while the first signal lines does not supply an output, wherein the first active device sets the display signal level, meanwhile the third active device sets an erase signal level.

3. The display apparatus as defined in claim 1, wherein the electric potential keeping means is constituted by a fourth active device and a capacitor.

4. The display apparatus as defined in claim 1, wherein a fifth active device is provided between an input of the at least one pixel memory and an output of the at least one pixel memory, and while the fifth active device is subjected to non-selective driving, the display signal level of the at least one pixel memory is set.

5. The display apparatus as defined in claim 1, wherein the at least one pixel memory receives power from a second power supply line which is independent from a first power supply line that provides a load current to the electro-optical device.

6. A display apparatus, including device circuits provided in a matrix manner, comprising:

first signal lines each provided to a different row of the device circuits;

bit selecting lines each provided to a different row of the device circuits; and second signal lines each provided to a different column of the device circuits, wherein, each of the device circuits further includes:

a first active device which is selected via the corresponding first signal line so as to capture a signal supplied to the corresponding second signal line;

a pixel memory including a second active device which is selected via the corresponding bit selecting line, the pixel memory either (i) keeping the signal captured by the first signal line when the first signal line is selected, or (ii) outputting the signal which has been kept therein when the first signal line is not selected, in response. to the selection of the second signal line;

signal keeping means which keeps either (i) the signal captured by the first active device instead of a signal which has been kept therein or (ii) the signal which is output from the pixel memory instead of a signal which has been kept therein; and an electro-optical device for emitting light in accordance with the signal kept in the signal keeping means, and carrying out time-division gradation display using an active organic EL, and when display period of weight is less than scanning time, the gap is filled as a data display period of the pixel memory, and time-division gradation driving is carried out.

7. The display apparatus as defined in claim 6, wherein a plurality of the bit selecting lines is provided to a different row of the device circuits, and each of the device circuits includes a plurality of the pixel memories corresponding to the plurality of the bit selecting lines, and carrying out time-division gradation display using an active organic EL.

8. The display apparatus as defined in claim 6, further comprising third signal lines each provided to a different row of the device circuits, wherein, each of the device circuits further includes a third active device for erasing the signal kept in the signal keeping means in response to selection via the corresponding third signal line and when time-division gradation display is carried out using an active organic EL, a bit appearing more than once in one frame is kept in an SRAM, while a bit appearing only once in one frame is kept in a capacitor.

9. The display apparatus as defined in claim 8, further comprising:

first power supply lines each provided to a different column of the device circuits; and second power supply lines each provided to a different column of the device circuits, wherein, in each of the device circuits, the electro-optical device is driven by a current supplied through the corresponding first power supply line, and the pixel memory and the signal keeping means are driven by a voltage supplied through the corresponding second power supply line.

10. The display apparatus as defined in claim 6, further comprising:

first power supply lines each provided to a different column of the device circuits; and second power supply lines each provided to a different column of the device circuits, wherein, in each of the device circuits, the electro-optical device is driven by a current supplied through the corresponding first power supply line, and the pixel memory and the signal keeping means are driven by a voltage supplied through the corresponding second power supply line.

11. The display apparatus as defined in claim 6, wherein the pixel memory includes a static memory to which an input of an inverter circuit and an output of another inverter circuit are connected, and the pixel memory keeps a signal on account of the static memory.

12. The display apparatus as defined in claim 6, wherein the pixel memory includes a capacitor, and the pixel memory keeps a signal on account of the capacitor, and carrying out time-division gradation display using an active organic EL.

13. The display apparatus as defined in claim 6, further comprising selecting lines each provided to a different row of the device circuits, wherein the signal keeping means is provided with (i) a capacitor for keeping a signal and (ii) a fourth active device, which is situated between the capacitor and the pixel memory, for bringing the capacitor and the pixel memory into conduction when selected via the corresponding selecting line.

14. A display method of a display apparatus including electro-optical devices in respective areas partitioned by a plurality of first signal lines and a plurality of second signal lines intersecting with each other, each of the electro-optical devices carrying out displaying in accordance with a signal level supplied via the corresponding second signal line while a first active device being selected via the corresponding first signal line, comprising the steps of:

setting a display signal level in an electric potential keeping means via the first active device while the first signal line is selected, and selectively driving the second active device so that the display signal level is set in the pixel memory; and switching a display signal level of the electro-optical device to the display signal level set in the pixel memory, by selectively-driving the second active device while the first signal line is not selected; and when time-division gradation display is carried out using an active organic EL, a bit appearing more than once in one frame is kept in an SRAM, while a bit appearing only once in one frame is kept in a capacitor, and when display period of weight is less than scanning time, the gap is filled as a data display period of the pixel memory, and time-division gradation driving is carried out.

15. A display method of a display apparatus provided with:

device circuits provided in a matrix manner; first signal lines each provided to a different row of the device circuits;

bit selecting lines each provided to a different row of the device circuits; and second signal lines each provided to a different column of the device circuits, each of the device circuits including:

a first active device which captures a display signal supplied via the corresponding second signal line, in response to selection of the first active device by the corresponding first signal line;

a pixel memory including a second active device which is selected by the corresponding bit selecting line, the pixel memory either (i) keeping the signal captured by the first signal line when the first signal line is selected, or (ii) outputting the signal which has been kept therein when the first signal line is not selected, in response to the selection of the second active device;

signal keeping means which keeps either (i) the signal captured by the first active device or (ii) the signal which is output from the pixel memory; and an electro-optical device for emitting light in accordance with the signal kept in the signal keeping means, comprising the steps of:

setting a display signal level in the signal keeping means via the first active device while the first signal line is selected, and selecting the bit selecting line so as to set a display signal in the pixel memory via the first and second active devices; and selecting the bit selecting line while the first signal line is not selected, and switching a display signal of the signal keeping means to the display signal set in the pixel memory, and carrying out time-division gradation display using an active organic EL, wherein when display period of weight is less than scanning time, the gap is filled as a data display period of the pixel memory, and time-division gradation driving is carried out.

* * * * *